US007303863B2

(12) United States Patent
Suzuki et al.

(10) Patent No.: US 7,303,863 B2
(45) Date of Patent: Dec. 4, 2007

(54) SILVER HALIDE EMULSION AND SILVER HALIDE PHOTOGRAPHIC LIGHT-SENSITIVE MATERIAL

(75) Inventors: Hiroyuki Suzuki, Minami-ashigara (JP); Toshihiro Kariya, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/356,009

(22) Filed: Feb. 17, 2006

(65) Prior Publication Data

US 2006/0188829 A1 Aug. 24, 2006

(30) Foreign Application Priority Data

Feb. 18, 2005 (JP) ..... 2005-041924

(51) Int. Cl.

| | |
|---|---|
| ***G03C 1/06*** | (2006.01) |
| ***G03C 1/00*** | (2006.01) |
| ***G03C 1/005*** | (2006.01) |
| ***G03C 1/494*** | (2006.01) |

(52) U.S. Cl. ..... 430/598; 430/599; 430/607; 430/603; 430/550; 430/567

(58) Field of Classification Search ..... 430/598, 430/599, 600, 550, 603, 607, 567
See application file for complete search history.

(56) References Cited

U.S. PATENT DOCUMENTS

| | | | |
|---|---|---|---|
| 4,116,697 | A | 9/1978 | Bigelow |
| 5,342,750 | A | 8/1994 | Sasaki et al. |
| 2005/0048424 | A1 * | 3/2005 | Suzuki et al. ..... 430/567 |

FOREIGN PATENT DOCUMENTS

| | | | |
|---|---|---|---|
| JP | 6-317867 | A | 11/1994 |
| JP | 7-140579 | A | 6/1995 |
| JP | 7-301880 | A | 11/1995 |
| JP | 10-186563 | A | 7/1998 |

* cited by examiner

*Primary Examiner*—Geraldina Visconti
(74) *Attorney, Agent, or Firm*—Sughrue Mion Pllc.

(57) ABSTRACT

A silver halide emulsion, which is chemically sensitized by a compound of formula (1):

Formula (1)

wherein Ch represents a sulfur, selenium, or tellurium atom; $X^1$ represents $NR^1$ or $N^+(R^2)R^3Y^-$; $R^1$ represents a hydrogen atom or a substituent; $R^2$ and $R^3$ each represent an alkyl group or another substituent; $Y^-$ represents an anionic ion; $X^2$ represents $OR^4$, $N(R^5)R^6$, or another substituent; $R^4$ to $R^6$ each represent a hydrogen atom or a substituent; and E is a group selected from groups represented by formula (2) to (5):

Formula (2)

Formula (3)

Formula (4)

Formula (5)

wherein, in formulas (2) to (5), Z represents a hydrogen atom or a substituent; $A^1$ and $A^2$ each represent an oxygen atom, etc.; and $R^{10}$ to $R^{16}$ each represent a hydrogen atom or a substituent; W represents a substituent; n is an integer from 0 to 4; L represents a divalent linking group; and EWG represents an electron withdrawing group.

13 Claims, No Drawings

SILVER HALIDE EMULSION AND SILVER HALIDE PHOTOGRAPHIC LIGHT-SENSITIVE MATERIAL

FIELD OF THE INVENTION

The present invention relates to a silver halide emulsion. Further, the present invention relates to a silver halide photographic light-sensitive material, and specifically to a silver halide photographic light-sensitive material, which is achieved by using a specific chalcogen compound, which is high in sensitivity and low in fogging, and which is less in occurrence of fogging and in variation of photographic properties after storage.

BACKGROUND OF THE INVENTION

Silver halide emulsions for use in silver halide photographic light-sensitive materials are, in general, chemically sensitized by using various chemical substances to obtain, for example, desired sensitivity and gradation. As typical methods for the chemical sensitization, various sensitizing methods, such as sulfur sensitization, selenium sensitization, tellurium sensitization; noble metal sensitization using, for example, gold; and combinations of these sensitizing methods, are known. Various improvements in the aforementioned sensitizing methods have been recently made to cope with a strong need, for example, for excellent granularity, high sharpness, and high sensitivity of silver halide photographic light-sensitive materials, and further rapid processing promoted by accelerating development.

Although there is a case in which a selenium sensitizer has a greater sensitizing effect than a sulfur sensitizer used in the fields of the art, such a sensitizer largely tends to cause much fogging, to result softened gradation, and to cause increased variation of sensitivity during storage. Many patent publications have been disclosed aiming to improve these drawbacks. However, satisfactory results have not yet been brought by these improvements, and there has been a strong need for basic improvement; in particular, for greater suppression of the occurrence of fogging. Also, if sulfur sensitization, selenium sensitization, or tellurium sensitization is used in combination with gold sensitization, respectively, sensitivity is significantly increased in each case. However, fogging is increased at the same time. Although, particularly, gold-selenium sensitization and gold-tellurium sensitization result in greater sensitivity than gold-sulfur sensitization, they also largely apt to result in much fogging, increased gradation softness, and increased variation in sensitivity during storage. There remains, therefore, a strong need for development of a chemical sensitization method that gives increased sensitivity, less fogging, increased gradation hardness, and less variation in sensitivity during storage.

In this situation, chalcogen compounds having a specific structure are known to act as a chemical sensitizer. For example, specific examples of a selenocarboxylic acid (Se-ester) compound are disclosed in JP-A-7-140579 ("JP-A" means unexamined published Japanese patent application), and specific examples of a cyclic selenium compound containing a nitrogen atom are disclosed in JP-A-6-317867 and JP-A-10-186563. It is also disclosed that, if these compounds are used, fogging can be suppressed to a lower level, and a rise in sensitivity can be accomplished. However, these compounds described in the above publications also have not reached a satisfactory stage, and therefore, compounds that can suppress fogging to a lower level and attain higher sensitivity have been desired.

It is also known that many selenium compounds and tellurium compounds generally have lower stability than corresponding sulfur compounds. Not a few selenium compounds and tellurium compounds to be used as chemical sensitizers have less comparative stability. When these compounds are stored in a solution state, they resultantly gradually decompose. There is, therefore, a tendency for there to be a large difference in sensitivity, fogging, gradation, and the like, between the case of producing a light-sensitive emulsion just after a solution of a selenium compound or a tellurium compound is prepared, and the case of producing a light-sensitive emulsion a while after the solution is prepared. Therefore, chemical sensitizers that suppress fogging to attain high sensitivity are desired to have higher stability.

In this situation, there has been a strong need for development of sensitizing technologies of silver halide emulsions using a chalcogen sensitizer that attain a higher rise in sensitivity; that lower occurrence of fogging; that give a contrasty image, and that are superior in storage stability and production aptitude.

SUMMARY OF THE INVENTION

The present invention resides in a silver halide emulsion, which is chemically sensitized by a compound represented by formula (1):

Formula (1)

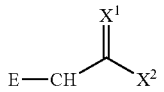

wherein, in formula (1), Ch represents a sulfur atom, a selenium atom, or a tellurium atom; $X^1$ represents $NR^1$, or $N^+(R^2)R^3Y^-$, in which $R^1$ represents a hydrogen atom, an alkyl group, an alkenyl group, an alkynyl group, an aryl group, or a heterocyclic group, and $R^2$ and $R^3$ each independently represent an alkyl group, an alkenyl group, an alkynyl group, an aryl group, or a heterocyclic group, and $Y^-$ represents an anionic ion; $X^2$ represents a hydrogen atom, an alkyl group, an alkenyl group, an alkynyl group, an aryl group, a heterocyclic group, $OR^4$, or $N(R^5)R^6$, in which $R^4$, $R^5$, and $R^6$ each independently represent a hydrogen atom, an alkyl group, an alkenyl group, an alkynyl group, an aryl group, or a heterocyclic group; and E is a group selected from groups represented by formula (2), (3), (4), or (5):

Formula (2)

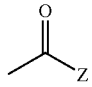

Formula (3)

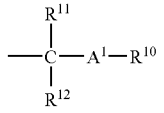

Formula (4)

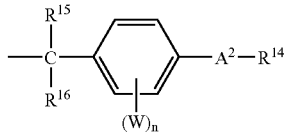

Formula (5)

wherein, in formula (2), Z represents a hydrogen atom, an alkyl group, an alkenyl group, an alkynyl group, an aryl group, a heterocyclic group, $OR^7$, or $N(R^8)R^9$, in which $R^7$, $R^8$, and $R^9$ each independently represent a hydrogen atom, an alkyl group, an alkenyl group, an alkynyl group, an aryl group, or a heterocyclic group;

wherein, in formula (3), $A^1$ represents an oxygen atom, a sulfur atom, or $NR^{13}$; and $R^{10}$, $R^{11}$, $R^{12}$, and $R^{13}$ each independently represent a hydrogen atom, an alkyl group, an alkenyl group, an alkynyl group, an aryl group, or a heterocyclic group;

wherein, in formula (4), $A^2$ represents an oxygen atom, a sulfur atom, or $NR^{17}$; $R^{14}$ represents a hydrogen atom, an alkyl group, an alkenyl group, an alkynyl group, an aryl group, a heterocyclic group, or an acyl group; $R^{15}$, $R^{16}$, and $R^{17}$ each independently represent a hydrogen atom, an alkyl group, an alkenyl group, an alkynyl group, an aryl group, or a heterocyclic group; W represents a substituent; n is an integer from 0 to 4; when n is 2 or more, Ws may be the same or different;

wherein, in formula (5), L represents a divalent linking group; and EWG represents an electron withdrawing group.

The present invention also resides in a silver halide photographic light-sensitive material having, on a support, at least one silver halide emulsion layer, wherein at least one layer of the at least one silver halide emulsion layer contains at least one silver halide emulsion chemically sensitized by using the compound represented by formula (1).

Other and further features and advantages of the invention will appear more fully from the following description.

DETAILED DESCRIPTION OF THE INVENTION

According to the present invention, there is provided the following means:

(1) A silver halide emulsion, which is chemically sensitized by a compound represented by formula (1):

Formula (1)

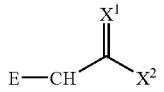

wherein, in formula (1), Ch represents a sulfur atom, a selenium atom, or a tellurium atom; $X^1$ represents $NR^1$, or $N^+(R^2)R^3Y^-$, in which $R^1$ represents a hydrogen atom, an alkyl group, an alkenyl group, an alkynyl group, an aryl group, or a heterocyclic group, and $R^2$ and $R^3$ each independently represent an alkyl group, an alkenyl group, an alkynyl group, an aryl group, or a heterocyclic group, and $Y^-$ represents an anionic ion; $X^2$ represents a hydrogen atom, an alkyl group, an alkenyl group, an alkynyl group, an aryl group, a heterocyclic group, $OR^4$, or $N(R^1)R^6$, in which $R^4$, $R^5$, and $R^6$ each independently represent a hydrogen atom, an alkyl group, an alkenyl group, an alkynyl group, an aryl group, or a heterocyclic group; and E is a group selected from groups represented by formula (2), (3), (4), or (5):

Formula (2)

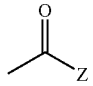

-continued

Formula (3)

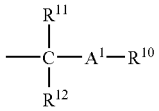

Formula (4)

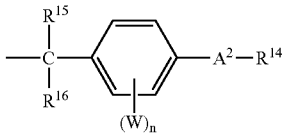

Formula (5)

wherein, in formula (2), Z represents a hydrogen atom, an alkyl group, an alkenyl group, an alkynyl group, an aryl group, a heterocyclic group, $OR^7$, or $N(R^8)R^9$, in which $R^7$, $R^8$, and $R^9$ each independently represent a hydrogen atom, an alkyl group, an alkenyl group, an alkynyl group, an aryl group, or a heterocyclic group;

wherein, in formula (3), $A^1$ represents an oxygen atom, a sulfur atom, or $NR^{13}$; and $R^{10}$, $R^{11}$, $R^{12}$, and $R^{13}$ each independently represent a hydrogen atom, an alkyl group, an alkenyl group, an alkynyl group, an aryl group, or a heterocyclic group;

wherein, in formula (4), $A^2$ represents an oxygen atom, a sulfur atom, or $NR^{17}$; $R^{14}$ represents a hydrogen atom, an alkyl group, an alkenyl group, an alkynyl group, an aryl group, a heterocyclic group, or an acyl group; $R^{15}$, $R^6$, and $R^{17}$ each independently represent a hydrogen atom, an alkyl group, an alkenyl group, an alkynyl group, an aryl group, or a heterocyclic group; W represents a substituent; n is an integer from 0 to 4; when n is 2 or more, Ws may be the same or different;

wherein, in formula (5), L represents a divalent linking group; and EWG represents an electron withdrawing group;

(2) The silver halide emulsion according to the above item (1), wherein, in formula (1), $X^2$ represents $N(R^5)R^6$;

(3) The silver halide emulsion according to the above item (2), wherein, in formula (1), E is a group selected from groups represented by formula (3) or (4);

(4) The silver halide emulsion according to the above item (3), wherein, in formula (1), Ch is a selenium atom; and (5) A silver halide photographic light-sensitive material having, on a support, at least one silver halide emulsion layer, wherein at least one layer of said at least one silver halide emulsion layer contains the silver halide emulsion according to any one of the items (1) to (4).

The present invention relates to a silver halide emulsion that has high sensitivity, and that is reduced in fogging and has high storage stability, and the present invention also relates to a highly sensitive silver halide color photographic light-sensitive material that uses the silver halide emulsion and gives a reduced increase in fogging during storage.

The silver halide photographic light-sensitive material of the present invention has, on a support, at least one silver halide emulsion layer, wherein at least one layer of the at least one silver halide emulsion layer is chemically sensitized by a compound represented by formula (1). It is thereby possible to obtain a silver halide photographic light-sensitive material that has high sensitivity; that is reduced in fogging, and that also has a reduced increase in fogging during storage. Although silver halide photographic light-sensitive materials having an emulsion subjected to selenium sensitization or tellurium sensitization have a tendency for the variation in fogging caused by a change in the temperature of a developer to be large, the use of the compound according to the present invention produces the unexpected effect of suppressing this variation in fogging.

The compound represented by formula (1) for use in the present invention is described in detail below.

In formula (1), Ch is an atom having a nature to form a compound constituted by combining a precious metal (e.g. silver or gold) on silver halide grains, to thereby be able to improve the light-sensitivity of the silver halide grains. Specifically, Ch represents a sulfur atom, a selenium atom, or a tellurium atom; preferably a sulfur atom or a selenium atom, and more preferably a selenium atom.

In formula (1), $X^1$ represents $NR^1$, or $N^+(R^2)R^3Y^-$; $R^1$ represents a hydrogen atom, an alkyl group, an alkenyl group, an alkynyl group, an aryl group, or a heterocyclic group; $R^2$ and $R^3$ each independently represent an alkyl group, an alkenyl group, an alkynyl group, an aryl group, or a heterocyclic group; $Y^-$ represents an anionic ion.

Hereinafter, the term "alkyl group" means a straight-chain, branched, or cyclic, substituted or unsubstituted alkyl group. Preferred examples thereof include a straight-chain or branched, substituted or unsubstituted alkyl group having 1 to 30 carbon atoms (e.g., a methyl group, an ethyl group, an isopropyl group, a n-propyl group, a n-butyl group, a t-butyl group, a 2-pentyl group, a n-hexyl group, a n-octyl group, a t-octyl group, a 2-ethylhexyl group, a 1,5-dimethylhexyl group, a n-decyl group, a n-dodecyl group, a n-tetradecyl group, a n-hexadecyl group, a hydroxyethyl group, a hydroxypropyl group, a 2,3-dihydroxypropyl group, a carboxymethyl group, a carboxyethyl group, a sodiumsulfoethyl group, a diethylaminoethyl group, a diethylaminopropyl group, a butoxypropyl group, an ethoxyethoxyethyl group, and a n-hexyloxypropyl group); a substituted or unsubstituted cycloalkyl group having 3 to 18 carbon atoms (e.g., a cyclopropyl group, a cyclopentyl group, a cyclohexyl group, a cyclooctyl group, an adamanthyl group, and a cyclododecyl group); a substituted or unsubstituted bicycloalkyl group having 5 to 30 carbon atoms (that is, a monovalent group formed by removing one hydrogen atom from a bicycloalkane having 5 to 30 carbon atoms, e.g., a bicyclo[1,2,2]heptane-2-yl group, a bicyclo[2,2,2]octane-3-yl group); and a cycloalkyl group having more ring structures, such as a tricycloalkyl group.

Examples of the alkenyl group include an alkenyl group having 2 to 16 carbon atoms (e.g., an allyl group, a 2-butenyl group, and a 3-pentenyl group).

Examples of the alkynyl group include an alkynyl group having 2 to 10 carbon atoms (e.g., a propargyl group, and a 3-pentynyl group).

Preferred examples of the aryl group include a substituted or unsubstituted aryl group having 6 to 30 carbon atoms; e.g., phenyl, p-tolyl, naphthyl, m-chlorophenyl, o-hexadecanoylaminophenyl.

The heterocyclic group means a 5- to 7-membered, substituted or unsubstituted, and saturated or unsaturated heterocyclic group containing at least one nitrogen, oxygen, or sulfur atom. These may be monocyclic, or further form a condensed ring together with other aryl or heterocyclic ring. Preferable examples of the heterocyclic group include a 5- to 6-membered heterocyclic group, e.g. a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a triazolyl group, a tetrazolyl group, quinolyl group, an isoquinolyl group, an indolyl group, an indazolyl group, a benzoimidazolyl group, a furyl group, a pyranyl group, a chromenyl group, a thienyl, an oxazolyl group, an oxadiazolyl group, a thiazolyl group, a thiadiazolyl group, a benzoxazolyl group, a benzothiazolyl group, a morpholino group, and a morpholinyl group.

$R^1$ to $R^3$ each may have a substituent. Examples of the substituent include a halogen atom (e.g. fluorine atom, chlorine atom, bromine atom, and iodine atom), an alkyl group, an alkenyl group, an alkynyl group, an aryl group, a heterocyclic group, an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group (including its salt), an oxalyl group, an oxamoyl group, a cyano group, a formyl group, a hydroxy group, an alkoxy group (including a group containing an ethyleneoxy group or propyleneoxy group unit repeatedly), an aryloxy group, a heterocyclic oxy group, an acyloxy group, an alkoxycarbonyloxy group, an aryloxycarbonyloxy group, a carbamoyloxy group, a sulfonyloxy group, a silyloxy group, a nitro group, an amino group, an alkyl-, aryl-, or heterocyclic-amino group, an acylamino group, a sulfonamido group, a ureido group, a thioureido group, an N-hydroxyureido group, an imido group, an alkoxycarbonylamino group, an aryloxycarbonylamino group, a sulfamoylamino group, a semicarbazide group, a thiosemicarbazide group, a hydrazino group, an ammonio group, an oxamoylamino group, an N-(alkyl or aryl)-sulfonylureido group, an N-acylureido group, an N-acylsulfamoylamino group, a hydroxyamino group, a heterocyclic group containing a quaternary nitrogen atom (e.g., a pyridinio group, an imidazolio group, a quinolinio group, and an isoquinolinio group), an isocyano group, an imino group, an alkylthio group, an arylthio group, a heterocyclic thio group, an alkyl-, aryl-, or heterocyclic-dithio group, an alkyl- or arylsulfonyl group, an alkyl- or aryl-sulfinyl group, a sulfo group (including its salt), a sulfamoyl group, an N-acylsulfamoyl group, an N-sulfonylsulfamoyl group (including its salt), and a silyl group. Herein, the term "salt" means salts of a cation, such as an alkali metal, alkali earth metal, and heavy metal, or of an organic cation, such as an ammonium ion and phosphonium ion. The preferable number of carbon atoms of the substituent alkyl group, alkenyl group, alkynyl group, or aryl group is the same as the preferable number of carbon atoms of each of these groups in the above $X^1$.

In the present invention, $R^1$ is preferably a hydrogen atom, an alkyl group, an aryl group, or a heterocyclic group, more preferably a hydrogen atom or an alkyl group, and further more preferably a hydrogen atom. $R^2$ and $R^3$ each independently are preferably an alkyl group, an aryl group, or a heterocyclic group, more preferably an alkyl group or an aryl group, and further more preferably an alkyl group.

$Y^-$ represents an anion and examples of the so-called anion here include halogen ions, such as $Cl^-$, $Br^-$, and $I^-$; carboxylic acid anions, such as an acetate ion; sulfonic acid anions, such as a benzene sulfonate ion; and inorganic anions, such as a perchlorate ion. In the present invention, $Y^-$ is preferably a halogen ion.

In the present invention, the case where $X^1$ represents $NR^1$ is preferable.

In formula (1), $X^2$ represents a hydrogen atom, an alkyl group, an alkenyl group, an alkynyl group, an aryl group, a heterocyclic group, $OR^4$, or $N(R^5)R^6$, and $R^4$ to $R^6$ each independently represent a hydrogen atom, an alkyl group, an alkenyl group, an alkynyl group, an aryl group, or a heterocyclic group. The so-called alkyl group, alkenyl group, alkynyl group, aryl group, and heterocyclic group here have the same meanings as those explained above, and the preferable range of each group is also the same. Also, $R^4$ to $R^6$ may respectively have a substituent, and examples of the substituent include the same groups previously given as the examples of substituent. In the present invention, $R^4$ to $R^6$ each independently are preferably a hydrogen atom, an alkyl group, an aryl group, or a heterocyclic group, more preferably a hydrogen atom, an alkyl group, or an aryl group, and still more preferably a hydrogen atom or an alkyl group.

In the present invention, $X^2$ is preferably an alkyl group, an alkenyl group, an alkynyl group, an aryl group, or $NR^5R^6$, and more preferably $N(R^5)R^6$.

$X^1$ and $X^2$ may be combined with each other to form a cyclic structure.

In formula (1), E is selected from groups represented by formulae (2) to (5).

In formula (2), Z represents a hydrogen atom, an alkyl group, an alkenyl group, an alkynyl group, an aryl group, a heterocyclic group, $OR^7$, or $N(R^8)R^9$; and $R^7$, $R^8$, and $R^9$ each independently represent a hydrogen atom, an alkyl group, an alkenyl group, an alkynyl group, an aryl group, or a heterocyclic group. The so-called alkyl group, alkenyl group, alkynyl group, aryl group, and heterocyclic group here have the same meanings as those explained above, and the preferable range of each group is also the same. Also, these groups may respectively have a substituent, and examples of the substituent include the same groups previously given as the examples of substituent. In the present invention, among the groups represented by formula (2), the case where Z is an alkyl group, an aryl group, $OR^7$, or $N(R^8)R^9$ is preferable, and the case where Z is an alkyl group or an aryl group is more preferable.

In formula (3), $R^{10}$, $R^{11}$, $R^{12}$, and $R^{13}$ each independently represent a hydrogen atom, an alkyl group, an alkenyl group, an alkynyl group, an aryl group, or a heterocyclic group. The so-called alkyl group, alkenyl group, alkynyl group, aryl group, and heterocyclic group here have the same meanings as those explained above, and the preferable range of each group is also the same. Also, these groups may respectively have a substituent, and examples of the substituent include the same groups previously given as the examples of substituent. In the present invention, $R^{10}$ is preferably an alkyl group. $R^{11}$ and $R^{12}$ respectively represent, preferably, a hydrogen atom, an alkyl group, or an aryl group, and more preferably a hydrogen atom or an alkyl group. It is still more preferable that one of $R^{11}$ and $R^{12}$ represent a hydrogen atom and the other represent a hydrogen atom or an alkyl group. $R^{13}$ is preferably a hydrogen atom, an alkyl group, or an aryl group, more preferably a hydrogen atom or an alkyl group, and still more preferably an alkyl group.

In formula (3), $A^1$ represents an oxygen atom, a sulfur atom, or $NR^{13}$. In the present invention, $A^1$ is preferably an oxygen atom or a sulfur atom, and more preferably an oxygen atom.

In the present invention, among the groups represented by formula (3), preferred is a case where $A^1$ represents an oxygen atom, a sulfur atom, or $NR^{13}$; $R^{10}$ represents an alkyl group or an aryl group; $R^{11}$ and $R^{12}$ each independently represent a hydrogen atom, an alkyl group, an aryl group, or a heterocyclic group; and $R^{13}$ represents a hydrogen atom, an alkyl group, or an aryl group. More preferred is a case where $A^1$ represents an oxygen atom or a sulfur atom; $R^{10}$ represents an alkyl group or an aryl group; and $R^{11}$ and $R^{12}$ each independently represent a hydrogen atom, an alkyl group, an aryl group, or a heterocyclic group. Further more preferred is a case where $A^1$ represents an oxygen atom, $R^{10}$ represents an alkyl group or an aryl group, and $R^{11}$ and $R^{12}$ each independently represent a hydrogen atom or an alkyl group.

$R^{10}$ and $R^{11}$ may combine with each other to form a cyclic structure.

The alkyl group, alkenyl group, alkynyl group, aryl group, and heterocyclic group represented by $R^{14}$ to $R^{17}$ in formula (4) have the same meanings as those described above, and the preferable range of each group is also the same. Also, they may respectively have a substituent, and examples of the substituent include the same groups previously given as the examples of substituent. Examples of the acyl group represented by $R^{14}$ include an acetyl group, a formyl group, a benzoyl group, a pivaloyl group, a caproyl group, and an n-nonanoyl group. These groups may have a substituent, and examples of the substituent include those previously given as the examples of substituent.

W in formula (4) represents a substituent, and examples of the substituent include those previously given as the examples of substituent. Also, W may have a substituent, and examples of the substituent include those previously given as the examples of substituent.

In the present invention, preferred examples of W include a halogen atom, an alkyl group, an aryl group, a heterocyclic group, an acyl group, an alkoxycarbonyl group, an aryloxycarbonyl group, a carbamoyl group, an N-acylcarbamoyl group, an N-sulfonylcarbamoyl group, an N-carbamoylcarbamoyl group, a thiocarbamoyl group, N-sulfamoylcarbamoyl group, a carbazoyl group, a carboxy group (including a salt thereof), a cyano group, a formyl group, a hydroxy group, an alkoxy group, an aryloxy group, a heterocyclic oxy group, an acyloxy group, a nitro group, an amino group, an alkyl-, aryl-, or heterocyclic-amino group, an acylamino group, a sulfonamido group, a ureido group, a thioureido group, an alkylthio group, an arylthio group, a heterocyclic thio group, an alkyl- or aryl-sulfonyl group, an alkyl- or aryl-sulfinyl group, a sulfo group (including a salt thereof), and a sulfamoyl group. More preferred examples thereof include a halogen atom, an alkyl group, an aryl group, a heterocyclic group, an alkoxycarbonyl group, a carboxy group (including a salt thereof), a hydroxy group, an alkoxy group, an aryloxy group, a heterocyclic oxy group, an acyloxy group, an amino group, an alkyl-, aryl-, or heterocyclic-amino group, an acylamino group, a ureido group, a thioureido group, an alkylthio group, an arylthio group, a heterocyclic thio group, and a sulfo group (including a salt thereof). Further more preferred examples thereof include a halogen atom, an alkyl group, an aryl group, an alkoxycarbonyl group, a carboxy group (including a salt thereof), a hydroxy group, an alkoxy group, an aryloxy group, an alkyl-, aryl-, or heterocyclic-amino group, a ureido group, an alkylthio group, an arylthio group, and a sulfo group (including a salt thereof).

In formula (4), n represents an integer of from 0 to 4. In the present invention, n is preferably an integer of from 0 to 2, and more preferably an integer of 0 or 1.

In formula (4), $A^2$ represents an oxygen atom, a sulfur atom, or $NR^{17}$. In the present invention, $A^2$ is preferably an oxygen atom or a sulfur atom, and more preferably an oxygen atom.

In the present invention, among the groups represented by formula (4), preferred is a case where $A^2$ represents an oxygen atom or a sulfur atom; $R^{14}$ represents a hydrogen atom, an alkyl group, an aryl group, or an acyl group; $R^{15}$ and $R^{16}$ each independently represent a hydrogen atom, an alkyl group, or an aryl group; n denotes 0 to 2; and W represents a halogen atom, an alkyl group, an aryl group, an alkoxycarbonyl group, a carboxy group (including its salt), a hydroxy group, an alkoxy group, an aryloxy group, an alkyl-, aryl-, or heterocyclic-amino group, an ureido group, an alkylthio group, an arylthio group, or a sulfo group (including its salt). More preferred is a case where $A^2$ represents an oxygen atom or a sulfur atom; $R^{14}$ represents an alkyl group, an aryl group, or an acyl group; $R^{15}$ and $R^{16}$ each independently represent a hydrogen atom, an alkyl group, or an aryl group; n denotes 0 to 1; and W represents a halogen atom, an alkyl group, an aryl group, an alkoxycarbonyl group, a carboxy group (including its salt), a hydroxy group, an alkoxy group, an aryloxy group, an alkyl-, aryl-, or heterocyclic-amino group, a ureido group, an alkylthio group, an arylthio group, or a sulfo group (including its salt). Still more preferred is a case where $A^2$ represents an oxygen atom, $R^{14}$ represents an alkyl group, an aryl group, or an acyl group, $R^{15}$ and $R^{16}$ each independently represent a hydrogen atom, an alkyl group, or an aryl group, and n denotes 0.

In formula (5), the divalent linking group designated by L preferably represents an alkylene group having 2 to 20 carbon atoms, an alkenylene group, or an alkynylene group; more preferably a straight-chain, branched or cyclic alkylene group having 2 to 10 carbon atoms (e.g., ethylene, propylene, cyclopentylene, and cyclohexylene), an alkenylene group (e.g., vinylene), or an alkynylene group (e.g., propynylene); and is further preferably a group of the formula (L1) or (L2).

Formula (L1)

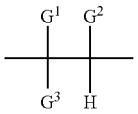

Formula (L2)

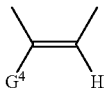

In formulae (L1) and (L2), $G^1$, $G^2$, $G^3$, and $G^4$ each independently represent a hydrogen atom, an alkyl group having 1 to 10 carbon atoms, an aryl group having 6 to 20 carbon atoms, or a heterocyclic group having 1 to 10 carbon atoms. $G^1$, $G^2$, and $G^3$ may bond together, to form a ring. $G^1$, $G^2$, $G^3$, and $G^4$ each are preferably a hydrogen atom, an alkyl group, or an aryl group, and more preferably a hydrogen atom or an alkyl group.

In formula (5), EWG represents an electron-withdrawing group. The term "electron-withdrawing group" so-called herein means a group having a positive value of Hammett's substituent constant $\sigma_p$ value, and preferably a $\sigma_p$ value of 0.2 or more, with its preferable upper limit being 1.0 or less. Specific examples of the electron-withdrawing group having a $\sigma_p$ value of 0.2 or more, include an acyl group, a formyl group, an acyloxy group, an acylthio group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an imino group, an imino group substituted with an N atom, a carboxy group (or its salt), an alkyl group substituted with at least two or more halogen atoms; an alkoxy group substituted with at least two or more halogen atoms; an aryloxy group substituted with at least two or more halogen atoms; an acylamino group, an alkylamino group substituted with at least two or more halogen atoms; an alkylthio group substituted with at least two or more halogen atoms; an aryl group substituted with other electron withdrawing group having a $\sigma_p$ value of 0.2 or more; a heterocyclic group, a halogen atom, an azo group, and a selenocyanate group. In the present invention, EWG is preferably an acyl group, a formyl group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted with an N atom; a phosphoryl group, a carboxy group (or its salt), an alkyl group substituted with at least two or more halogen atoms; an aryl group substituted with other electron withdrawing group having a $\sigma_p$ value of 0.2 or more; a heterocyclic group, or a halogen atom. More preferably, EWG is an acyl group, a formyl group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms; and further preferably an acyl group, a formyl group, a cyano group, a nitro group, an alkylsulfonyl group, an arylsulfonyl group, a carboxy group, or an alkyl group substituted with at least two or more halogen atoms.

In the present invention, among the groups represented by formula (5), preferred is a case where L is a group represented by formulae (L1) or (L2); and EWG is an acyl group, a formyl group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms. More preferred is a case where L is a group represented by formula (L1) or (L2); and EWG is an acyl group, a formyl group, a cyano group, a nitro group, an alkylsulfonyl group, an arylsulfonyl group, a carboxy group, or an alkyl group substituted with at least two or more halogen atoms. Still more preferred is a case where L is a group represented by formula (L1); and EWG is an acyl group, a formyl group, a cyano group, a nitro group, an alkylsulfonyl group, an arylsulfonyl group, a carboxy group, or an alkyl group substituted with at least two or more halogen atoms.

In formula (1), when Ch is a sulfur atom, E is preferably a group selected from the groups represented by formulae (3) to (5), and more preferably a group selected from the groups represented by formula (3) or (4). In formula (1), when Ch is a selenium atom, E is preferably a group selected from the groups represented by formulae (2) to (4), more preferably a group selected from the groups represented by formula (3) or (4), and still more preferably a group selected from the groups represented by formula (3). In formula (1), when Ch is a tellurium atom, E is preferably a group selected from the groups represented by formula (3) or (4), and more preferably a group selected from the groups represented by formula (4).

In the present invention, the compounds represented by formula (1) may be used in the form of a salt formed in combination with other organic or inorganic compounds. Specific examples of such a salt include a hydrochloride, a hydrobromide, a hydroiodide, a methane sulfonate, a trifluoromethane sulfonate, and a p-toluene sulfonate.

Among the compounds represented by formula (1), preferred is a compound where Ch is a sulfur atom or a selenium atom; $X^1$ represents $NR^1$ or $N^+(R^2)R^3$; $X^2$ represents an alkyl group, an alkenyl group, an alkynyl group, an aryl group, a heterocyclic group, $OR^4$, or $N(R^5)R^6$; and E is selected from the groups represented by formula (3) or (4). More preferred is a case where Ch is a selenium atom, $X^1$ represents $NR^1$ or $N^+(R^2)R^3$, $X^2$ represents an alkyl group, an aryl group, a heterocyclic group, or $N(R^5)R^6$, and E is selected from the groups represented by formula (3) or (4). Still more preferred is a case where Ch is a selenium atom, $X^1$ represents $NR^1$ or $N^+(R^2)R^3$, $X^2$ represents $N(R^5)R^6$, and E is selected from the groups represented by formula (3) or (4). Most preferred is a case where Ch is a selenium atom, $X^1$ represents $NR^1$, $X^2$ represents $N(R^5)R^6$, and E is selected from the groups represented by formula (3) or (4).

The compound represented by formula (1) for use in the present invention can achieve high sensitization while keeping fogging particularly low, when it is used in combination with a gold sensitizer. Also, at this time, the compound has such an effect of giving hard gradation.

Next, specific examples of the compound represented by formula (1) will be shown below, but the present invention is not limited to these. Further, with respect to the compounds that may have a plurality of stereoisomers, their stereostructure is not limited to these.

In the following exemplified examples, Me denotes a methyl group, Et denotes an ethyl group, Ph denotes a phenyl group, and Ac denotes an acetyl group, respectively.

1

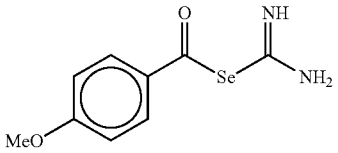

2

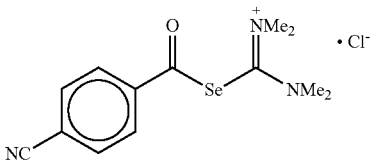

3

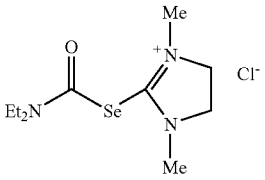

4

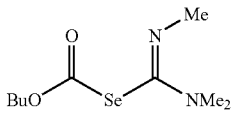

5

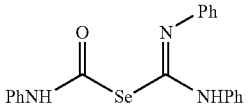

-continued

6

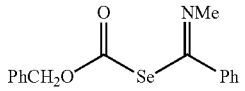

7

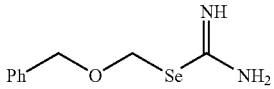

8

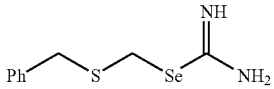

9

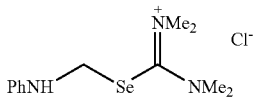

10

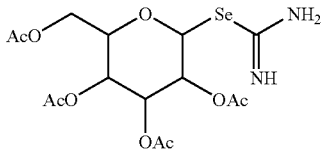

11

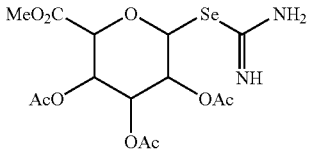

12

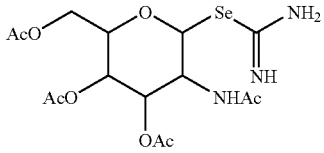

13

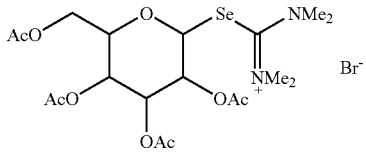

14

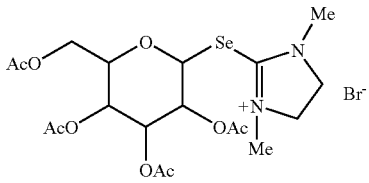

15

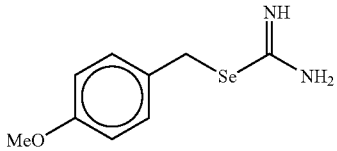

16

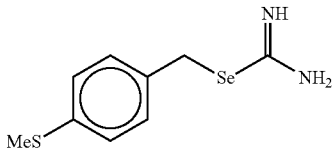

-continued
17
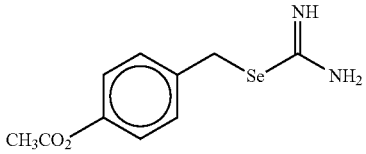
18
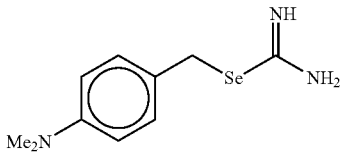
19
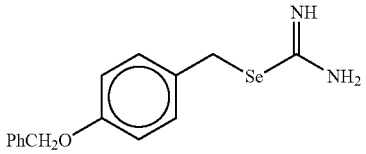
20
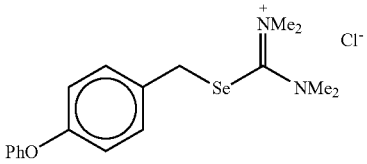
21
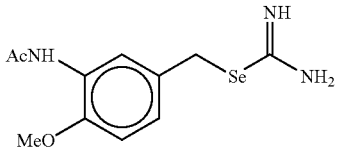
22
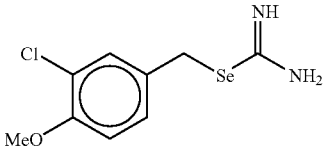
23
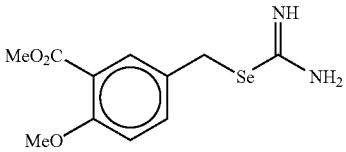
24
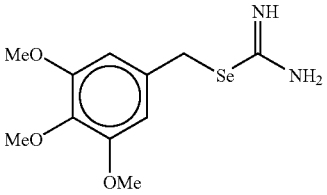
25
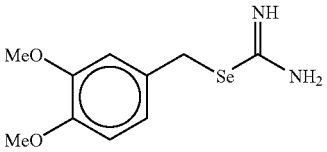
-continued
26
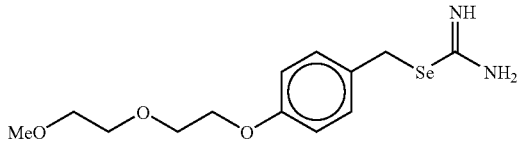
27
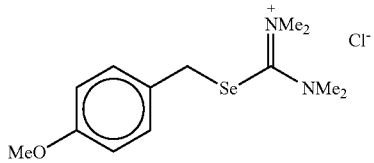
28
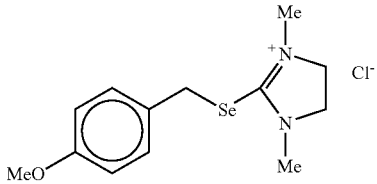
29
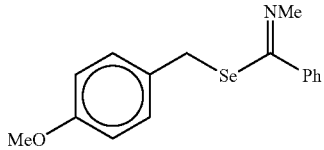
30
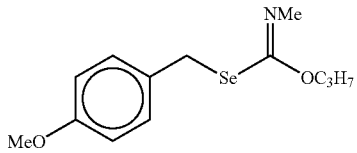
31
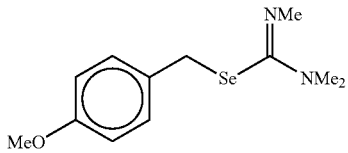
32
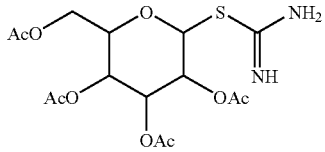
33
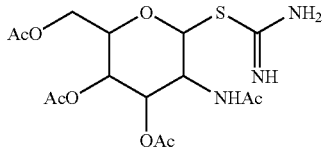
34
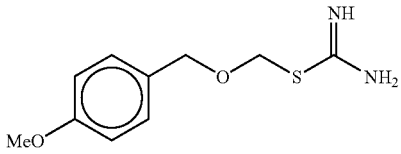

-continued

35

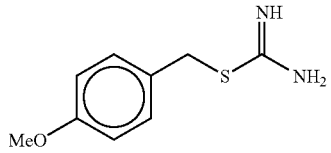

36

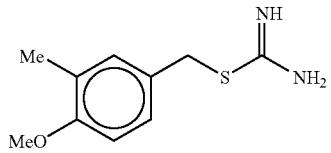

37

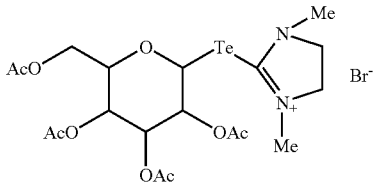

38

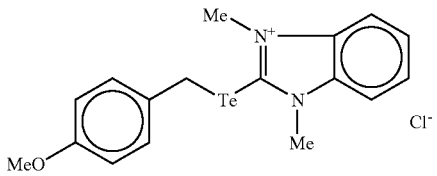

39

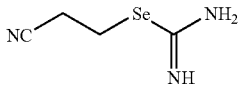

40

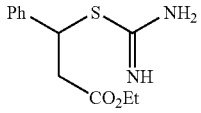

41

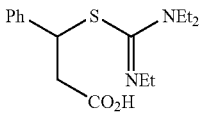

42

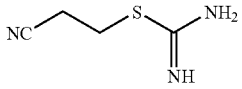

43

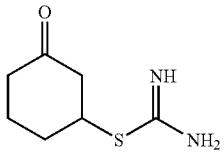

44

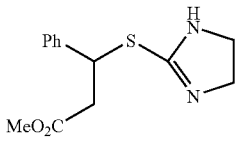

45

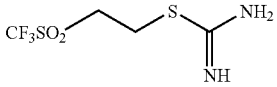

The compound represented by formula (1) according to the present invention can be synthesized by various known methods. Although no example of a synthetic method to be generalized can be given, because an optimum synthetic method is to be selected according to any individual compound, useful synthesis routes among these methods will be explained.

(Synthesis of the Exemplified Compound 8)

1.7 g of chloromethylbenzyl sulfide was dissolved in 20 mL of acetone, to which was then added 1.1 g of selenourea. After the mixture was stirred at 45° C. for 2 hours, it was ice-cooled, and the precipitated crystals were collected by filtration, to obtain 2.3 g of the exemplified compound 8 as a hydrochloride.

$^1$H NMR (DMSO-d$^6$) δ: 3.92 (s, 2H), 4.46 (s, 2H), 7.24-7.40 (m, 5H), 9.45 (brd, 4H)

(Synthesis of the Exemplified Compound 15)

7.8 g of 4-methoxybenzyl chloride was dissolved in 120 mL of acetone, to which was then added 5.1 g of selenourea. After the mixture was refluxed under heating for 1 hour, the reaction solution was ice-cooled, and the precipitated crystals were collected by filtration, to obtain 10 g of the exemplified compound 15 as a hydrochloride.

$^1$H NMR (DMSO-d$^6$) δ: 3.73 (s, 3H), 4.55 (s, 2H), 6.90 (d, 2H), 7.36 (d, 2H), 9.47 (brd, 4H)

In the present invention, the addition amount of the compound represented by formula (1) can vary in a wide range depending on the occasions, and it is generally in the range of $1\times10^{-7}$ to $5\times10^{-3}$ mol, preferably in the range of $5\times10^{-7}$ to $5\times10^{4}$ mol, per mol of silver halide.

In the present invention, the compound represented by formula (1) may be added by dissolving in a solvent, for example, of water, an alcohol (e.g., methanol and ethanol), a ketone (e.g., acetone), an amide (e.g., dimethylformamide), a glycol (e.g., methylpropylene glycol), or an ester (e.g., ethyl acetate).

In the present invention, the compound represented by formula (1) may be added in any stage of the production of emulsion. It is preferable to add the compound at an appropriate time after the formation of silver halide grains but before the completion of chemical sensitization step.

The silver halide grain for use in the silver halide color photographic light-sensitive material of the present invention is described in detail below.

The silver halide emulsion according to the present invention is not particularly limited from the viewpoint of grain shape. In the present invention, use can be preferably made of a silver halide emulsion comprising silver halide grains composed of cubic, tetradecahedral, or octahedral crystal grains, substantially having (100) planes, which grains may be rounded at the apexes thereof and may have planes of higher order, in which emulsion the proportion of such the grains accounts for 50% or more in terms of the total projected area of all the silver halide grains. Alternatively, use can also be preferably made of a silver halide emulsion, in which the proportion of silver halide grains composed of tabular grains having an aspect ratio of 2 or more (preferably 5 to 200) and being composed of (100) or (111) planes as the main face, accounts for 50% or more in terms of the total projected area of all the silver halide grains. The term "aspect ratio" refers to the value obtained by dividing the diameter of a circle having an area equivalent to the projected area of an individual grain, by the thickness of the grain.

Next, tabular grains having an aspect ratio of 2 or more and whose main face is composed of a (111) plane, which can be preferably used in the present invention, is described below.

Tabular grains for use in the present invention each have one twin plane or two or more parallel twin planes. The term "twin plane" means a (111) plane that ions at all lattice points on the both sides of the (111) plane have a mirror image relationship. When this tabular grain is viewed in a direction perpendicular to the main planes of the grain, it has any of triangular, hexagonal, and intermediate truncated triangular shapes, each having outer surfaces parallel to each other.

The silver halide grains not comprehended in the tabular grains include regular crystal grains, and grains having two or more nonparallel twin planes. The grains having two nonparallel twin planes include those having the configuration of a triangular pyramid or a rod. These are collectively referred to as "nontabular grains".

In the measurement of the equivalent circle diameter and thickness of the tabular grains, a transmission electron micrograph according to the replica method is taken, from which the diameter of a circle having an area equal to the projected area of the parallel external surfaces of an individual grain (this diameter is referred to an equivalent circle diameter) and the thickness thereof are determined. In this case, the grain thickness is calculated from the length of the shadow of the replica. With respect to the nontabular grains, the equivalent circle diameter is defined as the diameter of a circle having an area equal to the maximized projected area of an individual grain. When there is no plane parallel to a base as encountered in, for example, grains having the shape of a triangular pyramid among the nontabular grains, the thickness of the nontabular grains is defined as the distance between the base and the vortex thereof.

The silver halide tabular grain for use in the present invention is preferably comprised of: a core portion of silver iodobromide which is free of growth ring structure and has a thickness of 0.1 μm or less; and 10 or more dislocation lines.

The silver iodide content of the core portion of the tabular grains for use in the present invention is preferably from 1 to 40 mol %, more preferably from 1 to 20 mol %, and most preferably from 1 to 10 mol %.

It is preferred that, in the tabular grains for use in the present invention, no growth ring structure be observed in the core portion. The growth ring structure refers to a growth ring pattern observed when tabular grains are subjected to growth of silver iodobromide according to a usual DJ (double jet) method. The growth ring structure is presumed to be dislocation of twinned crystal introduced by the presence of iodide ions, and also presumed to provide unnecessary electron traps on grain surfaces. The growth ring structure is observed as lines parallel to grain sides. The growth ring structure can be observed in the same manner as employed in the observation of dislocation lines described later.

The tabular grains free of the above growth ring structure can be obtained by carrying out the grain growth according to the fine-grain-addition growth method in place of the usual DJ method. With respect to this fine-grain-addition growth method, reference can be made to, for example, JP-A-10-43570.

In the present invention, the dislocation line(s) can be introduced, for example, into the fringe portion of an individual tabular grain. In this case, the dislocations are almost perpendicular to the outer surface (outer circumference), and dislocation lines are generated in a direction from a position away from the center of the tabular grain by a distance that is x % of a length between the center and an edge (outer surface), to the outer surface. A value of x is preferably 10 or more but less than 100, more preferably 30 or more but less than 99, and most preferably 50 or more but less than 98. In this case, a shape that is obtained by connecting positions at which dislocation lines start is close to a similar figure of the grain, but is not always a completely similar figure, i.e., sometimes the shape is distorted. A dislocation line of this type is not viewed in a center region of the grain. The direction of dislocation lines is crystallographically about the direction of (211), but sometimes the dislocation lines extend in a zigzag manner, or cross each other.

When an extremely thin section of tabular grains having dislocation lines introduced in the fringe portions is observed through a transmission electron microscope, generally four contrast straight lines parallel to the main planes are observed. These are classified into two lines close to the grain surface and two inner lines.

The two inner lines are attributed to twin planes. Most of the tabular grains contain two twin planes, so that the two lines corresponding thereto are observed. In such rare cases that there are three twin planes, three lines corresponding thereto are observed. In these cases, five dislocation lines are observed on the extremely thin section of tabular grains.

The two lines close to the main planes are attributed to the step of epitaxial growth of silver halide on fringe portions at the time of dislocation introduction. The silver halides used in the epitaxial growth have a silver iodide content higher than that of the core grains and are grown under such conditions that deposition occurs mainly on the fringe portions. Under such conditions as well, however, a small amount of phase with high silver iodide content is also formed on the main plane portions. This phase with high silver iodide content, because of the halogen composition difference from that of the surrounding portions, is observed as straight lines. That is, on the basis of these two lines as a border, the grain inner portions and the grain surface-side portions can be identified as the core portions and the shell portions, respectively.

Dislocation lines of tabular grains can be observed by a direct method using a transmission-type electron microscope at low temperatures, as described, for example, by J. F. Hamilton in Phot. Sci. Eng., 11, 57 (1967), or by T. Shiozawa in J. Soc. Phot. Sci. Japan, 35, 213 (1972). That is, silver halide grains, carefully taken out from the emulsion in such a way that pressure is not applied to generate dislocation lines in the grains, are placed on a mesh for electron microscope observation and are observed by the transmission method, with the sample cooled to prevent it from suffering damage (e.g. print-out) by the electron beam. In this case, the greater the thickness of the grains is, the more difficult it is for the electron beam to be transmitted. Therefore, clearer observation can be effected using an electron microscope of a high-pressure type (200 kV or over acceleration voltage for grains having a thickness of 0.25 μm). From the photograph of the grains obtained in this way, the locations and the number of dislocation lines of the individual grains, seen in the direction vertical to the main (principal) planes, can be found.

The silver halide tabular grains for use in the present invention have preferably 10 or more dislocation lines. When the dislocation lines exist in a crowded condition, or are viewed as being crossed with each other, it is sometimes difficult to exactly count the number of dislocation lines per grain. However, it is possible to count them with such accuracy as identifying about 10, 20, or 30 lines, even in these cases, which can be clearly distinguished from there being only several dislocation lines present. The average number of dislocation lines per grain is determined by counting the number of dislocation lines with respect to 100 grains or more, and then averaging them in number. In some cases, it is observed that several hundreds of dislocation lines exist.

Further, the tabular grain may have the dislocation lines almost uniformly at all through the outer surface or at a localized region on the outer surface. That is, taking a hexagonal tabular silver halide grain as an example, the dislocation lines may be limited to only a vicinity of 6 apices, or to only a vicinity of 1 apex among the 6 apices. On the contrary, the dislocation lines can be limited to only the sides excluding a vicinity of the 6 apices.

Further, the dislocation lines may be formed over the region including a center of two parallel main planes of the tabular grain. When the dislocation lines are formed all over the region of the main planes, a direction of the dislocation lines, when viewed from the direction perpendicular to the main plane, is usually crystallographically almost the direction of (211), but sometimes the direction is of (110) or at random. Furthermore, each length of the dislocation lines is also random. Therefore, some dislocation lines may be observed as short lines on the main plane, while some dislocation lines may be observed as long lines extending to the side (outer surface). Some dislocation lines are straight, but many others extend in a zigzag manner. Further, in many cases, they are crossed each other.

The position of dislocation lines may be limited to on the outer surface, the main plane, or a localized region, as mentioned above, or the dislocation lines may be formed at a combination thereof. That is to say, the dislocation lines may exist simultaneously on both the outer surface and the main plane.

The introduction of dislocation lines in the tabular grains can be accomplished by disposing a specified phase of high silver iodide content within the grains. In this case, the high-silver-iodide phase may be provided with discontinuous regions of high silver iodide content. Specifically, the high-silver-iodide phase in the grains can be obtained by first preparing base grains (core portions), then providing them with a high-silver-iodide phase, and thereafter covering the outside thereof with a phase having a silver iodide content lower than that of the high-silver-iodide phase. The silver iodide content in the core portion of tabular grain is generally lower than that of the phase of high silver iodide content, and is preferably 0 to 20 mol %, more preferably 0 to 15 mol %.

The "high-silver-iodide phase in the grain (in an internal portion of the grain)" referred to means a silver halide solid solution containing silver iodide. In this case, preferred examples of the silver halide include silver iodide, silver iodobromide, and silver chloroiodobromide, and more preferred examples include silver iodide or silver iodobromide (silver iodide content is 10 to 40 mol % to the silver halide contained in the high-silver-iodide phase). In order to form a high-silver-iodide phase in an internal selective position of the grain (hereinafter referred to as an internal high-silver-iodide phase), i.e., on an edge, a corner, or a plane of the substrate grains, it is preferable to control conditions for forming the substrate grains, conditions for forming the internal high-silver-iodide phase and/or conditions for forming a phase covering the outer side thereof. Of the conditions for forming the substrate grains, there can be recited pAg (the cologarithm of silver ion concentration); a presence or absence, a kind, and an amount of a silver halide solvent; and temperature, as important factors. By adjusting pAg to 8.5 or less, more preferably 8 or less, at the time of forming the substrate grains, it is possible to selectively form the internal high-silver-iodide phase on the plane or at the vicinity of corners of the substrate grains, at the later time of forming the internal high-silver-iodide phases.

On the other hand, by adjusting pAg at the time of growing the substrate grains to 8.5 or more, more preferably 9 or more, it is possible to form internal high-silver-iodide phases on the edges of the substrate grains, at the later time of growing the internal high-silver iodide phases. The threshold value of the pAg varies up and down depending on temperature and on the presence or absence, the kind, and the amount of the silver halide solvent. For example, when thiocyanate is used as the silver halide solvent, the threshold of the pAg inclines upward. The pAg at the final stage of the growth is particularly important among pAg's at the time of growing of the substrate grains. On the other hand, even when the pAg at the step of the growth is outside of the above given value, the selective location of the internal high-silver-iodide phase can be controlled by adjusting the pAg to the above given value after the substrate grains have grown, followed by ripening. In this case, ammonia, amine compounds, thiourea derivatives, and thiocyanate salts are useful as the silver halide solvent. The internal high-silver-iodide phase can be formed by a so-called conversion method. In this method, in the course of a grain formation process, halide ions having a lower solubility of salt forming silver ion than that of silver halide that forms a grain or a portion close to the surface of grain at this time, are added. In the present invention, an amount of the halide ions having a lower solubility to be added is preferably larger than a value (associated with a halide composition) with respect to a surface area of the grain at this time. For example, in the course of the grain formation, KI is preferably added in an amount larger than a certain value with respect to a surface area of a silver halide grain at this time. Specifically, iodide salt is preferably added in an amount of $8.2\times10^{-5}$ mol/m$^2$ or more.

A more preferable method of producing an internal high-silver-iodide phase is a method in which fine grains of silver iodobromide are added. The grain size of these fine grains is generally 0.01 μm or more but 0.1 μm or less. However, it is possible to use fine grains having a grain size of 0.01 μm or less, or 0.1 μm or more. These fine-grain silver halide grains can be prepared with reference to methods described in JP-A-1-183417, JP-A-2-44335, JP-A-1-183644, JP-A-1-183645, JP-A-2-43534, and JP-A-2-43535. An internal high-silver-iodide phase can be formed by adding these fine-grain silver halides, and then ripening. The above-mentioned silver halide solvent may be used, to solve the fine grains by ripening. All of these fine grains added are not necessary to be instantly solved and vanished; rather it is adequate that they are completely solved and vanished when the final grains have been formed.

The location of the internal high-silver-iodide phases, when measured from a center of a hexagonal, etc., formed by a projection of the grain, preferably exists in a range of 5 mol % or more, but less than 100 mol %; more preferably 20 mol % or more, but less than 95 mol %; and particularly preferably 50 mol % or more, but less than 90 mol %, with respect to the silver amount of the entire grain. The amount of the silver halide that constitutes the internal high-silver-iodide phase is preferably 50 mol % or less, and more preferably 20 mol % or less, of the entire grain in terms of the silver amount. The above-mentioned amounts with respect to the high-silver-iodide phase are based on a formulation for the production of silver halide emulsions, but are not based on the values observed by a measurement according to various analytical methods of a halide composition of the final grains. This is because the internal high-silver-iodide phase in the final grains often vanishes during a recrystallization step or the like in shelling process. The above-mentioned silver amounts each refer to those in the production method.

Accordingly, the internal silver iodide phase formed to introduce dislocation lines into the final grains is often difficult to observe as a definite phase, even though the dislocation lines in the final grains can be easily observed according to the above-mentioned methods, since the silver iodide composition at the boundary successively varies. The halogen composition in a specific portion of the grain can be identified by a combination of an X-ray diffraction, an EPMA (also called as an XMA) method (in which silver halide grains are scanned by an electron beam, to detect a silver halide composition), an ESCA (also called as an XPS) method (in which X rays are radiated to perform spectroscopy for photoelectrons emitted from the grain surface), and the like.

The silver iodide content of an outer phase with which an internal high-silver-iodide phase is covered, is preferably lower than that of the internal high-silver-iodide phase, and such a silver iodide content in the external phase covering the internal phase is preferably 0 to 30 mol %, more preferably 0 to 20 mol %, and most preferably 0 to 10 mol %, to the silver halide content contained in the external phrase covering the internal iodide phase.

The temperature and the pAg to be set at the formation of the external phases covering the internal high-silver-iodide phases are arbitrary, but a preferable temperature is 30° C. or more, but 80° C. or less; and most preferably 35° C. or more, but 70° C. or less. A preferable pAg is 6.5 or more, but 11.5 or less. Use of the above-mentioned silver halide solvent is sometimes preferred, and the most preferred silver halide solvent is a thiocyanate salt.

Further, as another method of introducing the dislocation lines into the tabular grains, there is a method by use of an iodide ion-releasing agent, as described in JP-A-6-11782. This method can also be preferably used.

It is also possible to introduce the dislocation lines by properly using this method and the aforementioned method of introducing the dislocation lines in combination.

In the chemical sensitization of the silver halide grains, non-uniformity among grains in, for example, the size thereof, would cause attaining the optimum sensitization of the individual grains to be difficult, which may result in deterioration of photographic sensitivity. From this viewpoint, it is preferred that the equivalent circle diameter and thickness of the tabular grains be monodisperse. With respect to all the silver halide grains for use in the present invention, the variation coefficient of equivalent circle diameter is preferably 40% or less, more preferably 30% or less, and even more preferably 20% or less. With respect to all the silver halide grains, the variation coefficient of thickness is preferably 20% or less. The terminology "variation coefficient of equivalent circle diameter" used herein means the value obtained by dividing a standard deviation of equivalent circle diameters of individual silver halide grains by an average equivalent circle diameter and by multiplying the quotient by 100. On the other hand, the terminology "variation coefficient of thickness" used herein means the value obtained by dividing a standard deviation of thickness of individual silver halide grains by an average thickness and by multiplying the quotient by 100.

The twin plane spacing (interval) of the tabular grains is preferably 0.014 μm or less, more preferably 0.012 μm or less. In the formation of fringe dislocation type grains, uniformity of the side faces of the tabular grains is important because it influences the uniformity of fringe dislocation among grains. From this viewpoint, with respect to the twin plane spacing, it is preferred that the variation coefficient of the twin plane spacing of the tabular grains is 40% or less, more preferably 30% or less. The terminology "fringe dislocation type grains" used herein means grains having dislocation lines at fringe portions thereof upon viewing the tabular grains from the main plane side thereof.

The tabular grains having (111) faces as main planes generally have the shape of a hexagon, a triangle, or an intermediate shape, a triangle with angle portions cut off, and have three-fold symmetry. With respect to the six sides, the ratio of the length of three relatively long sides to that of three relatively short sides is referred to as the ratio of long side/short side. The triangle with angle portions cut off refers to the shape resulting from cutting off of angle portions of a triangle. In the formation of fringe dislocation type grains, it has been observed that the density of dislocation lines at the fringe portions is lower in the grains having a shape close to a triangle than in the grains having a shape close to a hexagon. It is preferred that the ratio of long side/short side of the tabular grains be close to 1. The average of the ratio of long side/short side of the tabular grains is preferably 1.6 or less, more preferably 1.3 or less.

The tabular grains for use in the present invention are generally formed via nucleation, Ostwald ripening, and growth process. Each of these processes is important for restraining a spread of grain size distribution. Because it is difficult, in the later process, to reduce the spread of size distribution having already occurred in the preceding process, attention must be given so that the size distribution does not spread in the first nucleation step. In the nucleation step, a relation of a nucleus-forming time and a temperature of reaction solutions, for addition of silver ions and bromide ions to the reaction solution by a double jet process thereby to generate precipitates, is important. As described by Saitoh in JP-A-63-92942, the temperature of the reaction solutions at the time of nucleation is preferably in the range of from 20° C. to 45° C. for improvement of mono-dispersion property. In addition, as described by Zola et al in JP-A-2-222940, a preferable temperature at the time of nucleation is 60° C. or less.

For the purpose of obtaining monodispersed tabular grains whose grain thickness is thin, a gelatin is further added during grain formation in some case. As gelatin to be used at this time, it is preferable to use a chemically modified gelatin, as described in JP-A-10-148897 and JP-A-11-143002. The chemically modified gelatin is a gelatin having at least two carboxyl groups newly introduced by chemical modification of amino groups in the gelatin. As the chemically modified gelatin, a trimellitated gelatin is preferably used, and a succinated gelatin is also preferably used. The gelatin is preferably added before growth process. More preferably, it is added just after nucleation. The addition amount of the gelatin is preferably 60% or more, more preferably 80% or more, and especially preferably at 90% or more, based on the mass of entire dispersion media during grain formation.

The composition of the tabular grain for use in the present invention is not limited, and it is preferably silver iodobromide or silver chloroiodobromide.

The silver chloride content of the tabular grain for use in the present invention is preferably 8 mol % or less, more preferably 3 mol % or less, and most preferably 0 mol %. A coefficient of variation of grain size distribution of the tabular grain emulsion is preferably 30 mol % or less. Therefore, the content of silver iodide is preferably 20 mol % or less. Reduction in the content of silver iodide makes it easy to reduce the variation coefficient of distribution of circle-equivalent diameter of the tabular grains.

Particularly, the coefficient of variation of grain size (e.g. equivalent-sphere diameter) distribution of the tabular grain is preferably 20% or less, and the content of the silver iodide is preferably 10 mol % or less.

The variation coefficient of intergrain silver iodide content distribution of the silver halide tabular grains for use in the present invention is preferably 20% or less, more preferably 15% or less, and especially preferably 10% or less. When the variation coefficient of intergrain silver iodide content distribution of the silver halide grains is too large, the light-sensitive material using the same cannot attain hard gradation, and reduction of sensitivity induced by pressure becomes larger, which are not preferable.

As the method of producing silver halide grains having a narrow silver iodide content distribution among tabular grains for use in the present invention, any known methods, such as a method in which fine grains are added, as described in JP-A-1-183417, and a method in which an iodide ion-releasing agent is used, as described in JP-A-2-68538, may be used singly or in combination thereof.

The silver iodide content of individual silver halide grains can be measured by a composition analysis of the individual silver halide grains by using X-ray micro analyzer. The coefficient of variation of intergrain silver iodide content distribution is a value determined by the steps of: the silver iodide contents of at least 100, more preferably 200 or more, and especially preferably 300 or more of emulsion grains are measured, to obtain the standard deviation of the silver iodide content and the average silver iodide content; and the coefficient of variation is calculated by using the following relation:

(Standard deviation/Average silver iodide content)× 100=Coefficient of variation.

The measurement of the silver iodide content of the individual grains is described, for example, in European Patent No. 147,868. Even though there is sometimes a relation between the silver iodide content Yi (mol %) of individual grain and an equivalent-sphere diameter Xi (μm) of individual grain, and there is sometimes no relation between them, but it is preferable that there is no relation between them. The structure relating to the silver halide composition of the tabular grains can be confirmed, for example, by a combination of X-ray diffraction, EPMA (or XMA) method (a method of detecting a silver halide composition by scanning of silver halide grains with electron beams), and ESCA (or XPS) method (a method of spectroscopic analyzing photoelectrons discharged from the grain surface upon X-ray radiation). In the present invention, when the silver iodide content is measured, the term "surface of grain" means a region in the depth of about 5 nm from the grain surface, while the term "inside of grain" means the region other than the surface of the grain, which should be the deeper region. The halogen composition of the grain surface can be measured usually according to the ESCA method.

Next, the tetradecahedral or cubic crystal grains substantially having (100) planes, which grains can be preferably used in the present invention, are described below.

The silver chloride content of the silver halide emulsion that contains the tetradecahedral or cubic crystal grains substantially having (100) planes for use in the present invention, is preferably 95 mol % or more; and from the viewpoint of rapid processing property, it is more preferably 97 mol % or more, and further preferably 98 mol % or more. The silver halide emulsion in the silver halide emulsion layer containing a yellow dye-forming coupler contains silver iodide in a content of preferably 0.1 mol % or more, more preferably 0.1 to 1 mol %, and further preferably 0.1 to 0.4 mol %. The silver halide emulsion in the silver halide emulsion layer containing a yellow dye-forming coupler may contain silver bromide, and the silver bromide content is preferably 0 to 4 mol %, more preferably 0.1 to 2 mol %. The silver halide emulsion in the silver halide emulsion layer containing a magenta dye-forming coupler and the silver halide emulsion in the silver halide emulsion layer containing a cyan dye-forming coupler each may contain silver bromide in a content of preferably 0 to 4 mol %, more preferably 0.5 to 3 mol %. The silver halide emulsion in the silver halide emulsion layer containing a magenta dye-forming coupler and the silver halide emulsion in the silver halide emulsion layer containing a cyan dye-forming coupler each may contain silver iodide in a content of preferably 0 to 1 mol %, more preferably 0.05 to 0.50 mol %, and most preferably 0.07 to 0.40 mol %.

The specific silver halide grains in the silver halide emulsion containing tetradecahedral or cubic crystal grains substantially having (100) planes for use in the present invention, each preferably have a silver bromide-containing phase and/or a silver iodide-containing phase. Herein, a silver bromide- or silver iodide-containing phase means a region where the content of silver bromide or silver iodide is higher than that in the surrounding regions. The halogen compositions of the silver bromide-containing phase or silver iodide-containing phase and of the surrounding region may vary either continuously or drastically. Such a silver bromide-containing phase or silver iodide-containing phase may form a layer which has an approximately constant concentration in a certain width at a portion in the grain, or it may form a maximum point having no spread. The local silver bromide content in the silver bromide-containing phase is preferably 5 mol % or more, more preferably from 10 to 80 mol %, and most preferably from 15 to 50 mol %. The local silver iodide content in the silver iodide-containing phase is preferably 0.3 mol % or more, more preferably from 0.5 to 8 mol %, and most preferably from 1 to 5 mol %. Such a silver bromide- or silver iodide-containing phase may be present in plural numbers in layer form, within the grain. In this case, the phases may have different silver bromide or silver iodide contents from each other. The silver halide grain for use in the present invention preferably contains at least one silver bromide-containing phase or at least one silver iodide-containing phase.

It is preferable that the silver bromide-containing phase or silver iodide-containing phase that the silver halide emulsion grains of tetradecahedral or cubic crystal grains substantially having (100) planes for use in the present invention have, are each formed in the layer form so as to cover the grain. One preferred embodiment is that the silver bromide-containing phase or silver iodide-containing phase formed in the layer form so as to surround the grain, has a uniform concentration distribution in the circumferential direction of the grain in each phase. However, in the silver bromide-containing phase or silver iodide-containing phase, formed in the layer form so as to surround the grain, there may be the maximum point or the minimum point of the silver bromide or silver iodide concentration in the circumferential direction of the grain, to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or an edge of the grain can be different from that of a main plane of the grain. Further, aside from the silver bromide-containing phase and/or silver iodide-containing phase formed in the layer form so as to surround the grain, another silver bromide-containing phase and/or silver iodide-containing phase not surrounding the grain may exist in isolation at a specific portion of the surface of the grain.

In a case where the silver halide emulsion containing tetradecahedral or cubic crystal grains substantially having (100) planes for use in the present invention contains a silver bromide-containing phase, it is preferable that said silver bromide-containing phase is formed in a layer form so as to have a concentration maximum of silver bromide inside of the grain. Likewise, in a case where the silver halide emulsion of the present invention contains a silver iodide-containing phase, it is preferable that said silver iodide-containing phase is formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide grain of the silver halide emulsion containing tetradecahedral or cubic crystal grains substantially having (100) planes for use in the present invention preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide content and/or a silver iodide content necessary for exhibiting the effects of the present invention such as achievement of high sensitivity and realization of hard gradation, each increase with the silver bromide-containing phase and/or the silver iodide-containing phase being formed in more inside of the grain. This causes the silver chloride content to decrease to more than necessary, resulting in the possibility of impairing rapid processing suitability. Accordingly, for putting together these phases or functions for controlling photographic actions, in the vicinity of the surface of the grain, it is preferred that the silver bromide-containing phase and the silver iodide-containing phase be placed adjacent to each other. From these points, it is preferred that the silver bromide-containing phase be formed at any of the position ranging from 50% to 100% of the grain volume measured from the inside, and that the silver iodide-containing phase be formed at any of the position ranging from 85% to 100% of the grain volume measured from the inside. Further, it is more preferred that the silver bromide-containing phase be formed at any of the position ranging from 70% to 95% of the grain volume measured from the inside, and that the silver iodide-containing phase be formed at any of the position ranging from 90% to 100% of the grain volume measured from the inside.

To the silver halide emulsion containing tetradecahedral or cubic crystal grains substantially having (100) planes for use in the present invention, bromide ions or iodide ions are introduced to make the emulsion grain contain silver bromide or silver iodide. In order to introduce bromide ions or iodide ions, a bromide salt or iodide salt solution may be added alone, or it may be added in combination with both a silver salt solution and a high chloride salt solution. In the latter case, the bromide or iodide salt solution and the high chloride salt solution may be added separately, or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high chloride emulsion may be limited. The deeper in the emulsion grain the iodide ion is introduced, the smaller is the increment of sensitivity. Accordingly, the addition of an iodide salt solution is preferably started at 50% or outer side of the volume of the grain, more preferably 70% or outer side, and most preferably 85% or outer side. Moreover, the addition of an iodide salt solution is preferably finished at 98% or inner side of the volume of the grain, more preferably 96% or inner side. When the addition of an iodide salt solution is finished at a little inner side of the grain surface, an emulsion having higher sensitivity and lower fog can be obtained.

On the other hand, the addition of a bromide salt solution is preferably started at 50% or outer side, more preferably 70% or outer side of the volume of the grain.

The distribution of a bromide ion concentration or iodide ion concentration in the depth direction of the grain can be measured, according to an etching/TOF-SIMS (Time of Flight—Secondary Ion Mass Spectrometry) method by means of, for example, TRIFT II Model TOF-SIMS apparatus (trade name, manufactured by Phi Evans Co.). A TOF-SIMS method is specifically described in, Nippon Hyomen Kagakukai edited, *Hyomen Bunseki Gijutsu Sensho Niii Ion Shitsurvo Bunsekiho* (*Surface Analysis Technique Selection—Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. In the analysis with the etching/TOF-SIMS method, it is preferred that the emulsion of the present invention has the maximum concentration of iodide ions at the surface of the grain, that the iodide ion concentration decreases inwardly in the grain, and that the bromide ions preferably have the maximum concentration in the inside of the grain. The local concentration of silver bromide can also be measured with X-ray diffractometry, as long as the silver bromide content is high to some extent.

In the present specification, the equivalent-sphere diameter is indicated by a diameter of a sphere having the same volume as that of individual grain. Preferably, the emulsion for use in the present invention comprises grains having a monodisperse grain size distribution. The variation coefficient of equivalent-sphere diameter is preferably 20% or less, more preferably 15% or less, and still more preferably 10% or less. The variation coefficient of equivalent-sphere diameter is expressed as a percentage of standard deviation of equivalent-sphere diameter of each grain, to an average of equivalent-sphere diameter. In this connection, for the purpose of obtaining broad latitude, it is preferred that the above-mentioned monodisperse emulsions be used as blended in the same layer, or coated by a multilayer coating method.

The silver halide for use in the present invention may be silver chloride, silver bromide, or silver iodide, or mixed crystals of two or three of these silver salts. However, silver chloride, mixed crystals of silver chloride and silver bromide, mixed crystals of silver chloride and silver iodide, mixed crystals of silver bromide and silver iodide, or mixed crystals of all three silver salts are preferable; and silver bromochloride or silver iodobromochloride is particularly preferable.

The silver halide emulsion of the present invention may contain silver halide grains chemically sensitized by a selenium sensitizer using an unstable-type (labile) selenium compound and/or a non-unstable-type selenium compound, as disclosed in known patent publications, besides the silver halide grains chemically sensitized by the compound represented by formula (1) for use in the present invention. Alternatively, the silver halide emulsion of the present invention may be chemically sensitized by a combination of the sensitizer represented by formula (1) for use in the present invention, and any of the above-mentioned selenium sensitizers. The selenium compound is generally utilized in such a manner that it is added to an emulsion, and the emulsion is stirred at a high temperature, preferably at a temperature of 40° C. or more, for a given time. As the labile selenium compounds, use can be made of the compounds described in JP-B-44-15748 ("JP-B" means examined Japanese patent publication), JP-B-43-13489, JP-A-4-25832, JP-A-4-109240, and the like. The non-labile selenium sensitizer refers to a compound which causes silver selenide, without use of any nucleophilic agent, upon the addition of the non-labile selenium sensitizer, only in an amount of 30% or less to the amount of the added non-labile selenium sensitizer. As the non-labile selenium sensitizer, there can be mentioned compounds described in, for example, JP-B-46-4553, JP-B-52-34492 and JP-B-52-34491. When the non-labile selenium sensitizer is used, it is preferred to use a nucleophilic agent in combination with the non-labile selenium sensitizer. As the nucleophilic agent, there can be mentioned compounds described in, for example, JP-A-9-15776.

The silver halide emulsion of the present invention may be additionally subjected to gold sensitization known in the field of arts concerned, in combination with the chemical sensitization by use of the compound represented by formula (1) according to the present invention. As a gold sensitizer for the gold sensitization, the oxidation number of gold may be either +1 valence or +3 valences, and various inorganic gold compounds, gold (I) complexes having inorganic ligands or gold (I) compounds having organic ligands may be utilized. Typical examples of the gold sensitizer include compounds such as a chloroaurate, potassium chloroaurate, auric trichloride, potassium auric thiocyanate, potassium iodoaurate, tetracyano auric acid, ammonium aurothiocyanate, pyridyl trichlorogold, gold sulfide, gold selenide; gold dithiocyanate compounds, e.g., potassium gold (I) dithiocyanate; and gold dithiosulfate compounds, e.g., trisodium gold (I) dithiosulfate. The amount of the gold sensitizing agent to be added varies depending on various conditions, but, as a standard, the amount thereof is generally $1\times10^{-7}$ to $5\times10^{-3}$ mol, preferably $5\times10^{-6}$ to $5\times10^{-4}$ mol, per mol of the silver halide.

As the gold (I) compounds each having an organic ligand (an organic compound), use can be made of bis-gold (I) mesoionic heterocycles described in JP-A4-267249, e.g. bis(1,4,5-trimethyl-1,2,4-triazolium-3-thiolato) aurate (I) tetrafluoroborate; organic mercapto gold (I) complexes described in JP-A-11-218870, e.g. potassium bis(1-[3-(2-sulfonatobenzamido)phenyl]-5-mercaptotetrazole potassium salt) aurate (I) pentahydrate; and gold (I) compound with a nitrogen compound anion coordinated therewith, as described in JP-A4-268550, e.g. bis (1-methylhydantoinato) gold (I) sodium salt tetrahydrate. As these gold (I) compounds having organic ligands, use can be made of those which are synthesized and isolated, in advance. Further, such gold (I) compounds can be generated by mixing an organic ligand and an Au compound (e.g., chlroauric acid or its salt), and added to an emulsion without being isolated. Moreover, an organic ligand and an Au compound (e.g., chlroauric acid or its salt) may be separately added to the emulsion, to generate the gold (I) compound having the organic ligand, in the emulsion.

Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used.

The amount of the above compound to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

Further, in the present invention, colloidal gold sulfide can also be used, for example, to subject the silver halide emulsion of the present invention to gold sensitization. A method of producing the colloidal gold sulfide is described in, for example, Research Disclosure, No. 37154; Solid State Ionics, Vol. 79, pp. 60 to 66 (1995); and Compt. Rend. Hebt. Seances Acad. Sci. Sect. B, Vol. 263, p. 1328 (1966). In the above Research Disclosure, a method is described in which a thiocyanate ion is used in the production of colloidal gold sulfide. It is, however, possible to use a thioether compound, such as methionine or thiodiethanol, instead.

Colloidal gold sulfide having various grain sizes are applicable, and it is preferable to use those having an average grain diameter of 50 nm or less, more preferably 10 nm or less, and further preferably 3 nm or less. The grain diameter can be measured from a TEM photograph. Also, the composition of the colloidal gold sulfide may be $Au_2S_1$ or may be a sulfur-excess composition, such as $Au_2S_1$ to $Au_2S_2$, and a sulfur-excess composition is preferable. $Au_2S_{1.1}$, to $Au_2S_{1.8}$ are more preferable.

The composition of the colloidal gold sulfide can be analyzed in the following manner: for example, gold sulfide grains are taken out, to find the content of gold and the content of sulfur, by utilizing analysis methods such as ICP and iodometry, respectively. If gold ions and sulfur ions (including hydrogen sulfide and its salt) dissolved in the liquid phase exist in the gold sulfide colloid, this affects the analysis of the composition of the gold sulfide colloidal grains. Therefore, the analysis is made after the gold sulfide grains have been separated by ultrafiltration or the like. The amount of the colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

The emulsion for use in the present invention may be additionally subjected to sulfur sensitization in the chemical sensitization.

The sulfur sensitization is generally carried out by adding a sulfur sensitizer, and stirring the resulting emulsion for a certain period at a high temperature, preferably at 40° C. or higher.

In the above sulfur sensitization, known sulfur sensitizers can be used. Examples thereof include thiosulfates, allyl thiocarbamidothiourea, allyl isothiocyanate, cystine, p-toluenethiosulfonates, and rhodanine. In addition, sulfur sensitizers described, for example, in U.S. Pat. Nos. 1,574,944, 2,410,689, 2,278,947, 2,728,668, 3,501,313 and 3,656,955, German Patent No. 1,422,869, JP-B-56-24937, and JP-A-55-45016, can also be used. The amount of the sulfur sensitizer to be added is suitably an amount sufficient to effectively increase the sensitivity of the emulsion. That amount varies in a substantially wide range depending on various conditions, such as the pH, the temperature, and the size and type of the silver halide grains, and preferably the amount is $1\times10^{-7}$ mol or more but $5\times10^{-5}$ mol or less, per mol of the silver halide.

Chalcogen sensitization and gold sensitization can be conducted by using the same molecule such as a molecule capable of releasing $AuCh^-$, in which Au represents Au (I), and Ch represents a sulfur atom, a selenium atom, or a tellurium atom. Examples of the molecule capable of releasing $AuCh^-$ include gold compounds represented by AuCh-$L_1$, in which $L_1$ represents a group of atoms bonding to AuCh to form the molecule. Further, one or more ligands may coordinate to Au together with Ch-$L_1$. The gold compounds represented by AuCh-$L_1$ have a tendency to form AgAuS when Ch is S, AgAuSe when Ch is Se, or AgAuTe when Ch is Te, when the gold compounds are reacted in a solvent in the presence of silver ions. Examples of these compounds include those in which $L_1$ is an acyl group. In addition, gold compounds represented by formula (AuCh1), formula (AuCh2), or formula (AuCh3) are exemplified.

$$R_1—X_1—M_1—ChAu \qquad \text{Formula (AuCh1)}$$

In formula (AuCh1), Au represents Au (I); Ch represents a sulfur atom, a selenium atom, or a tellurium atom; $M_1$ represents a substituted or unsubstituted methylene group; $X_1$ represents an oxygen atom, a sulfur atom, a selenium atom, or $NR_2$; $R_1$ represents a group of atoms that bonds to $X_1$ to form the molecule (e.g., an organic group, such as an alkyl group, an aryl group, or a heterocyclic group); $R_2$ represents a hydrogen atom or a substituent (e.g., an organic group, such as an alkyl group, an aryl group, or a heterocyclic group); and $R_1$ and $M_1$ may combine together to form a ring.

Regarding the compound represented by formula (AuCh1), Ch is preferably a sulfur atom or a selenium atom; $X_1$ is preferably an oxygen atom or a sulfur atom; and $R_1$ is preferably an alkyl group or an aryl group. Examples of more specific compounds include Au(I) salts of thiosugar (for example, gold thioglucose (such as α-gold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar. Herein, the terms "thiosugar," "selenosugar" and "tellurosugar" each mean a compound in which a hydroxy group in the anomer position of a sugar is substituted with a SH group, a SeH group, or a TeH group.

$$W_1W_2C{=}CR_3ChAu \qquad \text{Formula (AuCh2)}$$

In formula (AuCh2), Au represents Au(I); Ch represents a sulfur atom, a selenium atom, or a tellurium atom; $R_3$ and $W_2$ each independently represent a hydrogen atom or a substituent (e.g., a halogen atom, and an organic group such as alkyl, aryl, or heterocyclic group); $W_1$ represents an electron-withdrawing group having a positive value of the Hammett's substituent constant $\sigma_p$ value; and $R_3$ and $W_1$, $R_3$ and $W_2$, or $W_1$ and $W_2$ may bond together to form a ring.

In the compound represented by formula (AuCh2), Ch is preferably a sulfur atom or a selenium atom; $R_3$ is preferably a hydrogen atom or an alkyl group; and $W_1$ and $W_2$ each are preferably an electron-withdrawing group having the Hammett's substituent constant $\sigma_p$ value of 0.2 or more. Examples of the specific compound include $(NC)_2C{=}CHSAu$, $(CH_3OCO)_2C{=}CHSAu$, and $CH_3CO(CH_3OCO)C{=}CHSAu$.

$$W_3—E_l—ChAu \qquad \text{Formula (AuCh3)}$$

In formula (AuCh3), Au represents Au(I); Ch represents a sulfur atom, a selenium atom, or a tellurium atom; $E_l$ represents a substituted or unsubstituted ethylene group; $W_3$ represents an electron-withdrawing group having a positive value of the Hammett's substituent constant σp value.

In the compound represented by formula (AuCh3), Ch is preferably a sulfur atom or a selenium atom; $E_l$ is preferably an ethylene group having thereon an electron-withdrawing group whose Hammett's substituent constant $\sigma_p$ value is a positive value; and $W_3$ is preferably an electron-withdrawing group having the Hammett's substituent constant $\sigma_p$ value of 0.2 or more.

An addition amount of these compounds can vary over a wide range according to the occasions, and the amount is generally in the range of $5\times10^{-7}$ to $5\times10^{-3}$ mol, preferably in the range of $3\times10^{6}$ to $3\times10^{4}$ mol, per mol of silver halide.

In the present invention, the above-mentioned gold sensitization may be combined with other sensitization, such as sulfur sensitization, selenium sensitization, tellurium sensitization, reduction sensitization, and noble metal sensitization using noble metals other than gold compounds. In particular, the gold sensitization is preferably combined with sulfur sensitization and/or selenium sensitization.

The selenium sensitization can be carried out in the presence of a silver halide solvent.

Examples of the silver halide solvent that can be used in the present invention include (a) organic thioethers described, for example, in U.S. Pat. Nos. 3,271,157, 3,531,289 and 3,574,628, JP-A-54-1019, and JP-A-54-158917; (b) thiourea derivatives described, for example, in JP-A-53-82408, JP-A-55-77737, and JP-A-55-2982; (c) silver halide solvents having a thiocarbonyl group between an oxygen or sulfur atom, and a nitrogen atom, as described in JP-A-53-144319; (d) imidazoles described in JP-A-54-100717; (e) sulfites; and (f) thiocyanates.

Preferable silver halide solvents are thiocyanates and tetramethylthiourea. The amount of the solvent to be used varies depending on the type of the solvent, and the amount to be used is preferably $1\times10^{-4}$ mol or more, but $1\times10^{-2}$ mol or less, per mol of the silver halide.

The silver halide emulsion for use in the present invention may be subjected to reduction sensitization, during grain formation; after grain formation, but before or in the course of chemical sensitization; or after chemical sensitization.

As the reduction sensitization, any one may be selected from the followings: a method in which a reduction sensitizing agent is added to a silver halide emulsion; a so-called silver ripening method in which a silver halide is grown or ripened in a low pAg atmosphere with pAg of 1 to 7; and a so-called high-pH ripening method in which growth or ripening is carried out in a high pH atmosphere with pH of 8 to 11. Further, two or more of these methods may be used in combination.

The above method in which a reduction-sensitizing agent is added to a silver halide emulsion is preferable from the point that the revel of reduction sensitization can be delicately controlled.

Examples of known reduction-sensitizing agents include stannous salts, ascorbic acid and its derivatives, amines, polyamines, hydrazine derivatives, formamidine sulfinic acids, silane compounds, and borane compounds. The reduction-sensitizing agent for use in the present invention may be selected from these compounds, and two or more kinds of compounds may be used in combination. Preferable reduction-sensitizing agents for use in the present invention are stannous chloride, thiourea dioxide, dimethylamine borane, and ascorbic acid and its derivatives. The addition amount of the reduction-sensitizing agent varies depending on the conditions of producing emulsions, and therefore it is necessary to determine an addition amount thereof. A proper addition amount is generally in the range of from $10^{-7}$ to $10^{-3}$ mol, per mol of the silver halide.

A reduction sensitizer may be added in the course of the growth of silver halide grains, in the form of a solution having the reduction sensitizer dissolved in water or such an organic solvent as alcohols, glycols, ketones, esters, and amides. The reduction sensitizer may be added to a reaction vessel in advance, but preferably the reduction sensitizer is added at any proper stage during the growth of grains. Alternatively, use can be made of a method in which the reduction sensitizer is added to an aqueous solution of a water-soluble silver salt or a water-soluble alkali halide in advance, and then silver halide grains are precipitated by using these aqueous solutions. Further, a method in which a solution of the reduction sensitizer is added in parts or successively for a long period of time during the growth of silver halide grains, is also preferred.

In the present invention, preferably an oxidizing agent for silver is added, in the course of the process of the production of the emulsion. The oxidizing agent for silver refers to a compound that acts on metal silver to convert it to silver ion. Particularly useful is a compound that converts quite fine silver grains, which are concomitantly produced during the formation of silver halide grains and during the chemical sensitization, to silver ions. The thus produced silver ions may form a silver salt that is hardly soluble in water, such as a silver halide, silver sulfide, and silver selenide, or they may form a silver salt that is readily soluble in water, such as silver nitrate. The oxidizing agent for silver may be inorganic or organic. Examples of inorganic oxidizing agents include ozone, hydrogen peroxide and its adducts (e.g. $NaBO_2.H_2O_2.3H_2O$, $2NaCO_3.3H_2O_2$, $Na_4P_2O_7.2H_2O_2$, and $2Na_2SO_4.H_2O_2.2H_2O$); oxygen acid salts, such as peroxyacid salts (e.g. $K_2S_2O_8$, $K_2C_2O_6$, and $K_2P_2O_8$), peroxycomplex compounds (e.g. $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganates (e.g. $KMnO_4$), and chromates (e.g. $K_2Cr_2O_7$); halogen elements, such as iodine and bromine; perhalates (e.g. potassium periodate), salts of metals having higher valences (e.g. potassium hexacyanoferrate (III)), and thiosulfonates.

Examples of the organic oxidizing agents include quinones, such as p-quinone; organic peroxides, such as peracetic acid and perbenzoic acid; and compounds that can release active halogen (e.g. N-bromosuccinimido, chloramine T, and chloramine B).

Further, preferable examples of the oxidizing agents for use in the present invention include inorganic oxidizing agents selected from ozone, hydrogen peroxide and its adducts, halogen elements, and thiosulfonates; and organic oxidizing agents selected from quinones.

In a preferable embodiment, the above-described reduction sensitization is effected in combination with the oxidizing agent for silver: Use can be made of a method in which reduction sensitization is effected after use of the oxidizing agent, a method in which the oxidizing agent is used after completion of the reduction sensitization, or alternatively a method in which reduction sensitization is effected in the presence of the oxidizing agent. These methods can be used in either the step of grain formation or the step of chemical sensitization.

In the silver halide emulsion for use in the present invention, a metal complex may be added and incorporated during grain formation; after grain formation, but before chemical sensitization; or during chemical sensitization. The metal complex may be separately added and incorporated in several times. However, 50% or more of the total metal complex incorporated in the silver halide grain is preferably located in the layer within a half in terms bf silver amount, from the outermost surface of the silver halide grain. On the outer side of the above-mentioned metal complex-containing layer, a layer containing no metal complex may be provided.

In the present invention, it is preferable that the above-mentioned metal complexes be dissolved in water or a proper solvent and added directly to the reaction solution at the time of silver halide grain formation. Also, it is preferable that grain formation be carried out by adding those metal complexes to an aqueous halide solution, an aqueous silver salt solution, or other solution, for forming silver halide grains, so that they are doped to the inside of the silver halide grains. Furthermore, it is also preferable to employ a method, in which a metal complex is incorporated into silver halide grains, by adding and dissolving silver halide fine grains doped with metal complex in advance, and depositing them on another silver halide grains.

The hydrogen ion concentration in a reaction solution to which the metal complex is added, is preferably 1 or more, but 10 or less; more preferably 3 or more, but 7 or less, in terms of pH.

The metal complex that can be preferably used in the present invention, is represented by formula (I) or formula (II):

$$[IrX^1_kL^1_{(6-k)}]^{l-} \qquad \text{Formula (I)}$$

wherein $X^1$ represents a halogen ion or a pseudohalogen ion other than a cyanate ion; $L^1$ represents a ligand different from $X^2$; k represents an integer of 3, 4, or 5; and l represents an integer of −4 to +1.

Herein, three to five $X^1$s may be the same or different from each other. When plural $L^1$s are present, these plural $L^1$s may be the same or different from each other.

In formula (I), the pseudohalogen (halogenoid) ion means an ion having a nature similar with that of halogen ion; and examples of the same include cyanide ion ($CN^-$), thiocyanate ion ($SCN^-$), selenocyanate ion ($SeCN^-$), tellurocyanate ion ($TeCN^-$), azide dithiocarbonate ion ($SCSN_3^-$), cyanate ion ($OCN^-$), fulminate ion ($ONC^-$), and azide ion ($N_3^-$).

$X^1$ is preferably a fluoride ion, a chloride ion, a bromide ion, an iodide ion, a cyanide ion, an isocyanate ion, a thiocyanate ion, a nitrate ion, a nitrite ion, or an azide ion. Among these, chloride ion and bromide ion are particularly preferable. $L^1$ is not particularly limited, so long as it is a ligand different from $X^1$, and it may be an organic or inorganic compound that may or may not have electric charge(s), with organic or inorganic compounds with no electric charge being preferable.

The metal complex represented by formula (II) that can also be preferably used in the present invention, is described below:

$$[MX^{II}_{k1}L^{II}_{(6-k1)}]^{II-} \qquad \text{Formula (II)}$$

wherein M represents Cr, Mo, Re, Fe, Ru, Os, Co, Rh, Pd, or Pt; $X^{11}$ represents a halogen ion; $L^{11}$ represents a ligand different from $X^{11}$; k1 represents an integer of 3 to 6; and 11 represents an integer of −4 to +1.

$X^{11}$ is preferably a fluoride ion, a chloride ion, a bromide ion, or an iodide ion, and particularly preferably a chloride ion or a bromide ion. $L^{11}$ may be an organic or inorganic compound that may or may not have electric charges, with inorganic compounds having no electric charge being preferable. $L^{11}$ is preferably $H_2O$, NO, or NS.

Herein, three to six $X^{11}$s may be same as or different from each other. When plural $L^{11}$s exist, the plural $L^{11}$s may be the same as or different from each other.

The foregoing metal complexes are anions. When these are formed into salts with cations, counter cations are preferably those easily soluble in water. Specifically, alkali metal ions, such as sodium ion, potassium ion, rubidium ion, cesium ion, and lithium ion; an ammonium ion, and an alkylammonium ion are preferable. These metal complexes can be used by being dissolved in water or a mixed solvent of water and an appropriate water-miscible organic solvent (such as alcohols, ethers, glycols, ketones, esters, and amides).

In the present invention, it is preferable that the above-mentioned metal complex is incorporated into the silver halide grains, by directly adding the same to a reaction solution for the formation of the silver halide grains, or to an aqueous solution of the halide for the formation of the silver halide grains, or to another solution and then to the reaction solution for the grain formation. It is also preferable that a metal complex is incorporated into the silver halide grains by physical ripening with fine grains having metal complex incorporated therein in advance. Further, the metal complex can be also contained into the silver halide grains by a combination of these methods.

In the case where the metal complex is doped (incorporated) into the silver halide grains, the metal complex is preferably uniformly distributed in the inside of the grains. On the other hand, as disclosed in JP-A-4-208936, JP-A-2-125245 and JP-A-3-188437, the metal complex is also preferably distributed only in the grain surface layer. Alternatively, the metal complex is also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having the metal complex incorporated therein, to modify the grain surface phase. Further, these methods may be used in combination. Two or more kinds of complexes may be incorporated in the inside of an individual silver halide grain.

The silver halide grains in the silver halide emulsion for use in the present invention may further contain, in addition to the iridium complex represented by formula (I), another iridium complex in which all of 6 ligands are of Cl, Br, or I. In this case, Cl, Br, or I may be mixed and present in the six-coordination complex. The iridium complex having Cl, Br, or I as ligands is particularly preferably incorporated in a silver bromide-containing phase, for obtaining hard gradation upon high illuminance exposure.

Specific examples of the iridium complex in which all of 6 ligands are Cl, Br, or I are shown below, but the present invention is not limited to these.

$[IrCl_6]^{2-}$ $[IrCl_6]^{3-}$ $[IrBr_6]^{2-}$ $[IrBr_6]^{3-}$ $[IrI_6]^{3-}$

In the present invention, metal ion other than the above-mentioned metal complexes can be doped in the inside and/or on the surface of the silver halide grains. As the metal ion to be used, a transition metal ion is preferable, and an ion of iron, ruthenium, osmium, lead, cadmium, or zinc is more preferable. It is further preferable that these metal ions are used in the form of six-coordination complexes of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least one nitrogen, phosphorus, oxygen, or sulfur atom in the molecule as an atom which is capable of coordinating to the metal. Particularly preferred organic compounds are furan, thiophene, oxazole, isooxazole, thiazole, isothiazole, imidazole, pyrazole, triazole, furazane, pyran, pyridine, pyridazine, pyrimidine, and pyrazine. Further, organic compounds which have a substituent introduced into a basic skeleton of the above-mentioned compounds are also preferred.

Preferable combinations of a metal ion and a ligand are those of iron or ruthenium ion, and cyanide ion. In the present invention, one of these compounds is preferably used in combination with the metal complex mentioned in the above. Preferred of these compounds are those in which the number of cyanide ions accounts for the majority of the coordination number intrinsic to the iron or ruthenium that is the central metal. The remaining coordination sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver.

Also, the silver halide emulsion of the present invention may contain a spectral sensitizing dye, for the purpose of imparting a so-called spectral sensitivity thereto so that the emulsion exhibits light-sensitivity in a desired wavelength region. Examples of the dye that can be used include a cyanine dye, a merocyanine dye, a complex cyanine dye, a complex merocyanine dye, a holopolar cyanine dye, a hemicyanine dye, a styryl dye, and a hemioxonol dye. Examples of particularly usable dyes are those belonging to the cyanine dye, merocyanine dye, or complex merocyanine dye. For these dyes, any nucleus commonly used for cyanine dyes as a basic heterocyclic nucleus can be used. Examples of the nucleus include pyrroline nucleus, oxazoline nucleus, thiazoline nucleus, pyrrol nucleus, oxazole nucleus, thiazole nucleus, selenazole nucleus, imidazole nucleus, tetrazole nucleus, and pyridine nucleus; nuclei resulting from fusion of an alicyclic hydrocarbon ring to the aforementioned nuclei; and nuclei resulting from fusion of an aromatic hydrocarbon ring to the aforementioned nuclei, e.g., indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus, quinoline nucleus and so forth. These nuclei may have a substituent on a carbon atom.

For the merocyanine dye or complex merocyanine dye, a 5- or 6-membered heterocyclic nucleus such as pyrazolin-5-one nucleus, thiohydantoin nucleus, 2-thiooxazolidine-2,4-dione nucleus, thiazolidine-2,4-dione nucleus, rhodanine nucleus, and thiobarbituric acid nucleus may be used as a nucleus having a ketomethylene structure.

These sensitizing dyes can be used singly or in combination, and a combination of these sensitizing dyes is often used, particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B43-4936, JP-B-53-12375, JP-A-52-110618 and JP-A-52-109925.

In the present invention, together with the sensitizing dye, a dye having no spectral sensitizing function itself, or a substance that does not substantially absorb visible light and that exhibits supersensitization, may be included in the emulsion.

As to a timing when the sensitizing dye is added to a silver halide emulsion, it may be any time of the processes for preparation of the emulsion that has been recognized to be useful. In the present invention, addition of the sensitizing dye is, most commonly, carried out after completion of chemical sensitization, but before coating. However, the sensitizing dye may be simultaneously added together with a chemical sensitizer, to carry out spectral sensitization and chemical sensitization at the same time, as described in U.S. Pat. Nos. 3,628,969 and 4,225,666. Besides, as described in JP-A-58-113928, the sensitizing dye may be added prior to chemical sensitization, or alternatively the sensitizing dye may be added before completion of formation of precipitation of silver halide grains, to start spectral sensitization. Further, as taught in U.S. Pat. No. 4,225,666, it is possible that the sensitizing dye may be separately added, namely a part of sensitizing dye is added prior to chemical sensitization and the remaining of the sensitizing dye is added after chemical sensitization. The sensitizing dye may be added in any stage during grain formation of silver halide, as exemplified by the method disclosed in U.S. Pat. No. 4,183,756.

The amount of the sensitizing dye to be added is preferably in the range of from $0.5\times10^{-6}$ to $1.0\times10^{-2}$ mol, more preferably in the range of from $1.0\times10^{-6}$ to $5.0\times10^{-3}$ mol, per mol of silver halide.

At the time of chemical sensitization of the silver halide emulsion of the present invention, a silver iodobromide emulsion prepared in advance may be added and dissolved, to improve fog formation during aging. The addition timing is not limited as long as it is during chemical sensitization. It is preferable that, first, a silver iodobromide emulsion is added and dissolved, and subsequently a sensitizing dye and a chemical sensitizing agent are added, in this order. The silver iodide content of the silver iodobromide emulsion to be used is generally lower than the surface silver iodine content of the host grains. The silver iodobromide emulsion to be added is preferably a pure silver bromide emulsion. The grain size of the silver iodobromide emulsion is not particularly limited, so long as the silver iodobromide grains can be completely dissolved, and it is preferably 0.1 μm or less, more preferably 0.05 μm or less, in terms of equivalent-sphere diameter. The addition amount of the silver iodobromide grains varies depending on the host grains to be used, but, basically it is preferably 0.005 to 5 mol %, more preferably 0.1 to 1 mol %, per mol of silver.

The light-sensitive material utilizing the silver halide emulsion of the present invention may use an epi-emulsion in at least one light-sensitive emulsion layer.

The epi-emulsion referred to in the present invention means an emulsion that contains silver chloroiodobromide tabular grains, which have two parallel (111) primary planes facing each other, and which have epitaxial protrusions. The silver chloroiodobromide tabular grain having an epitaxial protrusion for use in the present invention has one twin plane or two or more parallel twin planes. The twin plane means a (111) plane when ions on all lattice points have a mirror image relation on both sides of the (111) plane.

The epi-emulsion that can be used in the present invention is preferably one in which tabular grains each having a hexagonal primary plane with the ratio of the length of the longest side to the shortest side being 2 to 1, and each having an epitaxial protrusion deposited thereon, account for preferably 70% or more, more preferably 90% or more, of the projected area of all the grains contained in the emulsion. The epi-emulsion is further preferably one in which tabular grains each having a hexagonal primary plane with the ratio of the length of the longest side to the shortest side being 1.5 to 1 and each having an epitaxial protrusion deposited thereon, account for 90% or more of the projected area of all the grains.

The epi-emulsion that can be used in the present invention is preferably monodispersion in the size distribution of grains contained therein. In the present invention, the coefficient of variation of the circle-equivalent diameter of the projected area of all silver halide grains to be used is preferably 30% or less, more preferably 25% or less, and particularly preferably 20% or less. Herein, the coefficient of variation of the circle-equivalent diameter is a value obtained by dividing the standard deviation of distribution of the circle-equivalent diameter of individual silver halide grains by the average circle-equivalent diameter.

The circle-equivalent diameter of the tabular grains contained in the epi-emulsion is measured, as mentioned in the above, by taking a photograph by using a transmission electron microscope, according to, for example, a replica method, to find the diameter (circle-equivalent diameter) of a circle having the area equal to the projected area of an individual grain. The thickness of each grain cannot be simply calculated from the length of the shadow of a replica because of epitaxial deposition. It is, however, possible to calculate the thickness, by measuring the length of the shadow of a replica before the epitaxial deposition. Alternatively, even after the epitaxial deposition, the thickness can be easily found, by cutting a sample to which epitaxial tabular grains are applied, and by taking an electron microphotograph of the section of the sample.

The composition of the silver halide grains contained in the epi-emulsion that can be used in the present invention is generally silver iodochlorobromide. The composition is preferably the following combination: the composition of the host tabular grains is silver iodobromide or silver iodochlorobromide, and the composition of the epitaxial protrusions is silver iodochlorobromide. The content of silver chloride is preferably 0.5 mol % or more and 6 mol % or less. The content of silver iodide is preferably 0.5 mol % or more and 10 mol % or less, more preferably 1 mol % or more and 6 mol % or less.

In the present invention, when the average silver chloride content of the epitaxial protrusions is designated to as CL mol %, the epi-emulsion preferably has the silver chloride content of the epitaxial protrusions in a range from 0.7CL to 1.3CL, particularly preferably in a range from 0.8CL to 1.2CL, in 70% or more of all the projected area. Further, when the average silver iodide content of the epitaxial protrusions is designated to as I mol %, the epi-emulsion preferably contains the epitaxial tabular grains whose silver iodide content of the epitaxial protrusions is in a range from 0.7I to 1.3I, particularly preferably in a range from 0.8I to 1.2I, in 70% or more of all the projected area. Herein, the average silver chloride content and average silver iodide content of the epitaxial protrusions are, respectively, averages of silver chloride content and silver iodide content of the epitaxial protrusions inside of each grain and among grains. The distributions of Cl and I of the epitaxial protrusions inside of each grain and among grains may be analyzed by using the following method. The tabular grains in a silver halide photographic light-sensitive material are taken out after treating the light-sensitive material with a protease, followed by centrifugation. These grains are re-dispersed and placed on a copper mesh on which a support film is spread. The amount of the protease to be used is preferably as small as possible, to prevent the grains from being denatured. Although depending on the case, a method may be used in which a light-sensitive material is cut layer-wise by a microtome to take out the grains together with the binder. The grains taken out in this manner are observed from the direction of the principal plane, to scan a beam with a spot diameter narrowed to 2 nm or less by using an analytical electron microscope, in the epitaxial region protruded outwardly from the extended sides of the hexagon, thereby measuring each content of silver chloride and silver iodide in the epitaxial region of one location. In order to find the distribution inside of individual grain and among grains, generally 50 locations or more, preferably 100 locations or more of the epitaxial regions are measured. Each content of silver chloride and silver iodide can be calculated by finding the ratio of Ag intensity to halogen intensity in advance as a calibration curve by treating, in the same manner, silver halide grains whose composition and contents are known.

As the electron gun of the analytical electron microscope, a field emission-type electron gun having a high-electron density is more suitable than a thermionic-type electron gun, and the former can easily analyze each content of silver chloride and silver iodide in the epitaxial part. At this time, the measurement is preferably conducted by cooling the sample to a low temperature, for preventing causing any damage to the sample due to electron beam. As the epi-emulsion usable in the present invention, a preferable one has epitaxial protrusion on at least one apex part among the six apex parts of the primary plane of the hexagon, in 70% or more of the entire projected area. It is more preferable that the epi-emulsion contains tabular grains each having epitaxial protrusion on at least one apex part among the six apex parts of the primary plane of the hexagon, in 90% or more of the total projected area. Herein, the apex part means an area within a circle having a radius that is ⅓ of the length of the shorter side in the two sides adjacent to each other at one apex when the tabular grain is viewed from a direction perpendicular to the primary plane. In the case of a rounded hexagon, specifically in the case where the hexagonal tabular grains have rounded apexes, a judgment may be made as to whether an imaginary hexagon formed by extending each side of the rounded hexagon fulfills the above requirements or not. An emulsion containing grains each having at least one epitaxial protrusion on this apex part is the epi-emulsion for use in the present invention. The number of epitaxial protrusions is preferably one, on each six apex parts, namely six in all. Generally, epitaxial protrusions are formed on the primary plane of the tabular grain or on the sides of the tabular grains, except for the apex parts of tabular grains.

The epi-emulsion that can be used in the present invention may be prepared with reference to, for example, the descriptions in JP-A-2002-278007.

The silver halide photographic light-sensitive material of the present invention has at least one silver halide emulsion layer, and contains a silver halide emulsion chemically sensitized by the compound represented by formula (1). It is preferable that the light-sensitive material of the present invention is provided with, on a support, at least one blue-sensitive silver halide emulsion layer containing a yellow coupler, at least one green-sensitive silver halide emulsion layer containing a magenta coupler, at least one red-sensitive silver halide emulsion layer containing a cyan coupler, and at least one light-insensitive layer. Further, the light-sensitive material may contain a colloidal-silver-containing layer, if necessary. On the support, use can be made of a light-sensitive layer composed of a plurality of silver halide emulsion layers each having substantially the same color-sensitivity but different from each other in light-sensitivity. This light-sensitive layer is a unit color-sensitive layer having color-sensitivity to any one of blue light, green light, and red light. The unit color-sensitive layers may be arranged in any order according to the purpose, and the red-sensitive layer, the green-sensitive layer, and the blue-sensitive layer may be arranged in this order from the support side. This order may be reversed, or an arrangement in which a unit color-sensitive layer is inserted into another unit color-sensitive layer may be adopted. The non-light-sensitive layer may be formed as an interlayer between the silver halide light-sensitive layers described above, or as the uppermost layer or as the lowermost layer. The non-light-sensitive colloidal-silver-containing layer may contain a coupler, a color-mixing inhibitor, or the like, as described below. The silver halide emulsion layers constituting each unit color-sensitive layer can take a two-layer constitution composed of a high-sensitive emulsion layer and a low-sensitive emulsion layer, as described in DE Patent No. 1,121,470 or GB Patent No. 923,045. Generally, these layers may be arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support. Specific examples of the order include an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH, stated from the side most away from the support.

As described in JP-B-55-34932, an order of a blue-sensitive layer/GH/RH/GL/RL stated from the side most away from the support is also possible. Further, as described in JP-A-56-25738 and JP-A-62-63936, an order of a blue-sensitive layer/GL/RL/GH/RH stated from the side most away from the support is also possible.

Further, as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer, stated from the side away from support, can be taken. In the case of four layers or more layers, the arrangement can be varied as above.

In order to improve color reproduction, as described in U.S. Pat. Nos. 4,663,271, 4,705,744, and 4,707,436, JP-A-62-160448, and JP-A-63-89850, it is preferable to form a donor layer (CL), which has a spectral sensitivity distribution different from that of a principal (main) light-sensitive layer, such as BL, GL, and RL, and which has an inter-layer effect, in a position adjacent or in close proximity to the principal light-sensitive layer.

The light-sensitive material of the present invention may be provided with a hydrophilic colloid layer, an anti-halation layer, an intermediate layer, and a colored layer, if necessary, in addition to the aforementioned yellow color-forming layer, magenta color-forming layer, and cyan color-forming layer.

Various compounds or precursors thereof can be included in the silver halide emulsion of the present invention, to prevent fogging from occurring or to stabilize photographic performance, during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 can also be preferably used.

Further, in the present invention, to enhance storage stability of the silver halide emulsion, it is also preferred to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

In the present invention, it is possible to use non-light-sensitive fine grain silver halide. The non-light-sensitive fine grain silver halide is a silver halide fine grain which is not sensitive to light upon imagewise exposure for obtaining a dye image. In the non-light-sensitive fine grain silver halide, the content of silver bromide is 0 to 100 mol %. The fine grain silver halide may contain silver chloride and/or silver iodide, if necessary. The fine grain silver halide preferably contains silver iodide in a content of 0.5 to 10 mol %. The average grain diameter (the average value of circle equivalent diameter of projected area) of the non-light-sensitive fine grain silver halide is preferably 0.01 to 0.5 μm, more preferably 0.02 to 0.2 μm.

The non-light-sensitive fine grain silver halide may be prepared by the same procedure as that for a usual light-sensitive silver halide. The grain surface of the non-light-sensitive fine-grain silver halide needs not be optically sensitized nor spectrally sensitized. However, before the non-light-sensitive fine-grain silver halide grains are added to a coating solution, it is preferable to add any known stabilizer, such as triazole-series compounds, azaindene-series compounds, benzothiazolium-series compounds, mercapto-series compounds, and zinc compounds. Colloidal silver may be added to the layer containing those fine-grain silver halide grains.

In the light-sensitive material of the present invention, any of conventionally-known photographic materials or additives may be used.

For example, as a photographic support (base), a transmissive type support or a reflective type support may be used. As the transmissive type support, it is preferred to use a transparent support, such as a cellulose nitrate film, and a transparent film of polyethylene terephthalate, or a polyester of 2,6-naphthalenedicarboxylic acid (NDCA) and ethylene glycol (EG), or a polyester of NDCA, terephthalic acid, and EG, provided thereon with an information-recording layer such as a magnetic layer.

As the reflective type support, it is especially preferable to use a reflective support having a substrate laminated thereon with a plurality of polyethylene layers or polyester layers, at least one of the water-proof resin layers (laminate layers) contains a white pigment such as titanium oxide. A more preferable reflective support is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0:40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface is polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferable embodiments of the polyolefin layer to be provided on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contains a fluorescent whitening agent. Further, the fluorescent whitening agent may be dispersed and contained in a hydrophilic colloid layer, which is formed separately from the above layers, in the light-sensitive material. Preferred fluorescent whitening agents which can be used, include benzoxazole-series, coumarin-series, and pyrazoline-series compounds. Further, fluorescent whitening agents of benzoxazolylnaphthalene-series and benzoxazolylstilbene-series are more preferably used, The amount of the fluorescent whitening agent to be used is not particularly limited, and preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer is provided on the silver halide emulsion layer side or the reverse side of the support. In particular, it is preferable that the transmission density of support is adjusted to the range of 0.35 to 0.8 so that a display may be enjoyed by means of both transmitted and reflected rays of light.

In the light-sensitive material of the present invention, in order to improve, e.g., sharpness of an image, a dye (particularly an oxonole-series dye) that can be discolored by processing, as described in European Patent Application Publication No. 0,337,490A2, pages 27 to 76, may be added to the hydrophilic colloid layer. It is also preferable to add 12% by mass or more (more preferably 14% by mass or more) of titanium oxide that is surface-treated with dihydric to tetrahydric alcohols (e.g., trimethylolethane) and the like, to a water-proof resin layer of the support.

The light-sensitive material of the present invention preferably contains, in the hydrophilic colloid layer, a dye (particularly oxonole dyes and cyanine dyes) that can be discolored by processing, as described in European Patent Application Publication No. 0337490A2, pages 27 to 76, in order to prevent irradiation or halation or to enhance safelight safety, and the like. Further, a dye described in European Patent Publication No. 0819977 may also be preferably used in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as hydroquinone or gelatin. The colored layer is preferably provided as a lower layer (closer to a support) with respect to the emulsion layer which develops the same primary color as the color of the colored layer. It is possible to provide such colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density, in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, lower left column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13, describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the methods of incorporating fine particles of dye and of using colloidal silver.

Preferred examples of silver halide emulsions that can be additionally used in combination with the silver halide emulsion of the present invention, and other materials (additives or the like) applicable to the present invention, photographic constitutional layers (arrangement of the layers or the like), and processing methods for processing the photographic materials and additives for processing, include those disclosed in JP-A-62-215272, JP-A-2-33144, and European Patent Application Publication No. 0,355,660A2. In particular, those disclosed in European Patent Application Publication No. 0,355,660A2 can be preferably used. Further, it is also preferred to use silver halide color photographic light-sensitive materials and processing methods thereof described, for example, in JP-A-5-34889, JP-A4-359249, JP-A4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Application Publication No. 0520457A2.

In the present invention, known color mixing-inhibitors may be used. Among these compounds, those described in the following patent publications are preferred.

For example, high-molecular weight redox compounds described in JP-A-5-333501; phenidone- or hydrazine-series compounds as described in WO 98/33760 pamphlet and U.S. Pat. No. 4,923,787 and the like; and white couplers as described in JP-A-5-249637, JP-A-10-282615, German Patent Application Publication No. 19629142 A1 and the like, may be used. In particular, in order to accelerate developing speed by increasing the pH of a developing solution, redox compounds described in German Patent Application Publication No. 19618786A1, European Patent Application Publication Nos. 839623A1 and 842975A1, German Patent Application Publication No. 19806846A1, French Patent Application Publication No. 2760460A1, and the like, are also preferably used.

In the present invention, as an ultraviolet ray absorbent, it is preferred to use a compound having a triazine skeleton high in a molar extinction coefficient. For example, those described in the following patent publications can be used. This compound can be preferably used in the light-sensitive layer or/and the light-insensitive layer. For example, use can be made of the compound described, in JP-A46-3335, JP-A-55-15277.6, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, European Patent No. 711804A, JP-T-8-501291 ("JP-T" means published searched patent publication), and the like.

As a binding agent or a protective colloid which can be used in the photosensitive material of the present invention, a gelatin is used advantageously. Hydrophilic colloid other than gelatin may be used singly or in combination with the gelatin. It is preferable for the gelatin that the content of heavy metals, such as Fe, Cu, Zn, and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the pH of the coating film of the light-sensitive material is preferably in the range of 4.0 to 7.0, more preferably in the range of 4.0 to 6.5.

In the present invention, the total amount of gelatin to be applied in the photographic structural layer is preferably 3 g/m$^2$ or more and 6 g/m$^2$ or less, more preferably 3 g/m$^2$ or more and 5 g/m$^2$ or less. The film thickness of the entire photographic structural layers is preferably 3 μm to 7.5 μm, more preferably 3 μm to 6.5 μm, to satisfy development progress characteristics, fixing-bleaching property, and residual color, even in ultra-rapid processing. As to a method of measuring a dried film thickness, the film thickness can be measured based on a change in film thickness before and after the dried film is peeled off, or by observing the section with an optical microscope or an electron microscope. In the present invention, the swelled film thickness is preferably 8 μm to 19 μm, more preferably 9 μm to 18 μm, to achieve both the improvement in development progress characteristics and the increase in a drying speed. The swelled film thickness may be measured by immersing a dried light-sensitive material in a 35° C. aqueous solution to allow the material to be swelled into a sufficiently equilibrated condition, under which condition the thickness is measured by a known dotting method.

In the present invention, a surface-active agent may be added to the light-sensitive material, in view of improvement in coating-stability, prevention of static electricity from occurring, and adjustment of the charge amount. As the surface-active agent, there are anionic, cationic, betaine, or nonionic surfactants. Examples thereof include those described in JP-A-5-333492. As the surface-active agent for use in the present invention, a fluorine-containing surface-active agent is preferred. In particular, a fluorine-containing surface-active agent is preferably used. The fluorine-containing surface-active agent may be used singly or in combination with known another surface-active agent. The fluorine-containing surfactant is preferably used in combination with known another surface-active agent. The amount of surface-active agent to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The light-sensitive material of the present invention may be subjected to an exposure step of irradiating the light-sensitive material with light corresponding to image information, and to a development step of processing the exposed light-sensitive material, to thereby form an image.

The light-sensitive material of the present invention can be subjected to exposure by a scan exposure system using a cathode ray tube (CRT). The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in a spectral region, are used if necessary. For example, any one of red-light-emitting materials, green-light-emitting materials, and blue-light-emitting materials, or a mixture of two or more of these light-emitting materials may be used. The spectral regions are not limited to the above red, green, and blue, and fluorophoroes or phosphors which can emit a light in a region of yellow, orange, purple or infrared can also be used. In particular, a cathode ray tube which emits a white light by means of a mixture of these light-emitting materials, is often used.

In the case where the light-sensitive material has a plurality of light-sensitive layers each having a different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred, from the viewpoint of high-image quality enhancement, because a cathode ray tube having a high resolving power can be used.

The light-sensitive material of the present invention can be preferably used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of nonlinear optical crystal with a semiconductor laser or a solid state laser using a semiconductor as an excitation light source, blue light and green light can be obtained. Accordingly, it is possible to have the spectral sensitivity maximum of a light-sensitive material in normal three wavelength regions of blue, green and red. The exposure time in such a scanning exposure is defined as the time necessary to expose the size of the picture element with the density of the picture element being 400 dpi, and preferred exposure time is $1\times10^{-4}$ sec or less, more preferably $1\times10^{-4}$ sec or less.

Specific examples of the laser light source that can be preferably used, include a blue-light semiconductor laser having a wavelength of 430 to 460 nm (Presentation by Nichia Corporation at the 48th Applied Physics Related Joint Meeting, in March of 2001); a green-light laser at about 530 mm obtained by wavelength modulation of a semiconductor laser (oscillation wavelength about 1,060 nm) with SHG crystal of $LiNbO_3$ having a reversed domain structure in the form of a wave guide; a red-light semiconductor laser of the wavelength at about 685 nm (Type No. HL6738MG (trade name) manufactured by Hitachi, Ltd.); and a red-light semiconductor laser of the wavelength at about 650 nm (Type No. HL650 IMG (trade name) manufactured by Hitachi, Ltd.).

The silver halide color photographic photosensitive material of the present invention can be used in combination with the exposure and/or development system(s) described in the following publications. Example of the development system include automatic print and development system described in JP-A-10-333253; photosensitive material-conveying apparatus described in JP-A-2000-10206; recording system including image-reading apparatus, as described in JP-A-11-215312; exposure system with color-image-recording method, as described in JP-A-11-88619 and JP-A-10-202950; digital photo print system including remote diagnosis method, as described in JP-A-10-210206; and photo print system including image-recording apparatus, as described in Japanese Patent Application No. 10-159187.

In the present invention, a yellow microdot pattern may be previously pre-exposed before giving an image information, to thereby perform a copy restraint, as described in European Patent Application Publication Nos. 0789270A1 and 0789480A1.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be applied. Further, as the preservative for use in the developing solution, compounds described in the patent publications listed in the following table can be used.

Examples of a known development method applicable to the light-sensitive material after exposure, include a wet system, such as a development method using a developing solution containing an alkali agent and a developing agent, and a development method in which a developing agent is incorporated in the light-sensitive material and an activator solution, e.g., a developing agent-free alkaline solution, is employed for the development, as well as a heat development system using no processing solutions. However, a conventional development method using a developing solution containing an alkali agent and a developing agent, can be applied to the present invention.

The present invention may be applied to various color light-sensitive materials. Typical examples of the color light-sensitive material include color negative films for general use or movie use, color reversal films for slide use or television use, color papers, color positive films, and color reversal papers.

Photographic additives that can be used in the present invention are described in Research Disclosures (RD), and the particular parts are given below in a table.

| Kind of Additive | RD 17643 | RD 18716 | RD 307105 |
|---|---|---|---|
| 1. Chemical sensitizers | p. 23 | p. 648 (right column) | p. 866 |
| 2. Sensitivity-enhancing agents | — | p. 648 (right column) | — |
| 3. Spectral sensitizers and Supersensitizers | pp. 23-24 | pp. 648 (right column)-649 (right column) | pp. 866-868 |
| 4. Brightening agents | p. 24 | p. 647 (right column) | p. 868 |

-continued

| Kind of Additive | RD 17643 | RD 18716 | RD 307105 |
|---|---|---|---|
| 5. Light absorbers, Filter dyes, and UV Absorbers | pp. 25-26 | pp. 649 (right column)-650 (left column) | p. 873 |
| 6. Binders | p. 26 | p. 651 (left column) | pp. 873-874 |
| 7. Plasticizers and Lubricants | p. 27 | p. 650 (right column) | p. 876 |
| 8. Coating aids and Surfactants | pp. 26-27 | p. 650 (right column) | pp. 875-876 |
| 9. Antistatic agents | p. 27 | p. 650 (right column) | pp. 876-877 |
| 10. Matting agents | — | — | pp. 878-879 |

Photographic processing and techniques such as arrangement of layers, silver halide emulsions that can be additionally used in combination with the silver halide emulsion of the present invention, dye-forming couplers, functional couplers such as DIR couplers, various kinds of additives, and the like, each of which can be used in the silver halide photographic photosensitive material of the present invention, are also described in European Patent Application Publication No. 0565096A1 (published on Oct. 13, 1993) and publications referred to therein. Each item and its corresponding portion of the description are listed below.

1. Layer structure: page 61, lines 23 to 35, and page 61, line 41 to page 62, line 14
2. Intermediate layer: page 61, lines 36 to 40
3. Interlayer effect-imparting layer: page 62, lines 15 to 18
4. Halogen composition of silver halide: page 62, lines 21 to 25
5. Crystal habit of silver halide grains: page 62, lines 26 to 30
6. Size of silver halide grains: page 62, lines 31 to 34
7. Production method of emulsion: page 62, lines 35 to 40
8. Grain size distribution of silver halide: page 62, lines 41 to 42
9. Tabular grains: page 62, lines 43 to 46
10. Inner structure of grains: page 62, lines 47 to 53
11. Latent image formation type of emulsion: page 62, line 54 to page 63, line 5
12. Physical ripening and chemical ripening of emulsion: page 63, lines 6 to 9
13. Use of mixed emulsion: page 63, lines 10 to 13
14. Fogged emulsion: page 63, lines 14 to 31
15. Non-light-sensitive emulsion: page 63, lines 32 to 43
16. Coating amount of silver: page 63, lines 49 to 50
17. Formaldehyde scavenger: page 64, lines 54 to 57
18. Mercapto-series antifogging agent: page 65, lines 1 to 2
19. Releasing agent of fogged agent and the like: page 65, lines 3 to 7
20. Dye: page 65, lines 7 to 10
21. Color couplers in general: page 65, lines 11 to 13
22. Yellow, magenta, and cyan couplers: page 65, lines 14 to 25
23. Polymer coupler: page 65, lines 26 to 28
24. Diffusible dye-forming coupler: page 65, lines 29 to 31
25. Colored coupler: page 65, lines 32 to 38
26. Functional couplers in general: page 65, lines 39 to 44
27. Coupler releasing a bleaching accelerator: page 65, lines 45 to 48
28. Coupler releasing a development accelerator: page 65, lines 49 to 53
29. Other DIR coupler: page 65, line 54 to page 66, line 4
30. Method of dispersing a coupler: page 66, lines 5 to 28
31. Antiseptics and anti-molding agent: page 66, lines 29 to 33
32. Kind of photosensitive material: page 66, lines 34 to 36
33. Film thickness and swelling speed of light-sensitive layer: page 66, lines 40 to page 67, line 1
34. Backing layer: page 67, lines 3 to 8
35. Development processing in general: page 67, lines 9 to 11
36. Developing solution and developing agent: page 67, lines 12 to 30
37. Additives of developing solution: page 67, lines 31 to 44
38. Reversal processing: page 67, lines 45 to 56
39. Aperture ratio of processing solution: page 67, line 57 to page 68, line 12
40. Developing time: page 68, lines 13 to 15
41. Blix, bleaching, and fixing: page 68, line 16 to page 69, line 31
42. Automatic processing apparatus: page 69, lines 32 to 40
43. Washing, rinse, and stabilization: page 69, line 41 to page 70, line 18
44. Replenishment and reuse of processing solution: page 70, lines 19 to 23
45. Developing agent-incorporated photosensitive material: page 70, lines 24 to 33
46. Processing temperature for development: page 70, lines 34 to 38
47. Application to films with lens: page 70, lines 39 to 41

With respect to techniques, such as those regarding a bleaching solution, a magnetic recording layer, a polyester support, and an antistatic agent, that are applicable to the silver halide photographic light-sensitive material of the present invention, and with respect to the utilization of the present invention in Advanced Photo System, etc., reference can be made to the descriptions in U.S. Patent Application Publication No. 2002/0042030 A1 (published on Apr. 11, 2002) and patent publications cited therein. The items and the locations where they are described will be listed below.

1. Bleaching solution: page 15, [0206];
2. Magnetic recording layer and magnetic particles: page 16, [0207] to [0213];
3. Polyester support: page 16, [0214] to page 17, [0218];
4. Antistatic agent: page 17, [0219] to [0221];
5. Sliding agent: page 17, [0222];
6. Matting agent: page 17, [0224];
7. Film cartridge: page 17, [0225] to page 18, [0227];
8. Use in Advanced Photo System: page 18, [0228], and [0238] to [0240];
9. Use in film with lens: page 18, [0229]; and
10. Processing by MiniLab system: page 18, [0230] to [0237].

According to the present invention, it is possible to provide a silver halide emulsion that is highly sensitive and that forms a contrasty image and that is reduced in the variation of fogging during storage, and also possible to provide a silver halide color photographic light-sensitive material using the silver halide emulsion.

The present invention will be described in more detail based on the following examples, but the present invention is not limited thereto.

EXAMPLES

Hereinafter, in the following examples and comparative examples, "%" to show a composition means mass %, unless otherwise specified.

Example 1

(Preparation of Blue-Sensitive Layer Emulsion BH-1)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, potassium bromide (1.5 mol % per mol of the finished silver halide) and $K_4[Fe(CN)_6]$ were added. Over the step of from 83% to 88% addition of the entire silver nitrate amount, $K_2[IrCl_6]$ was added. Over the step of from 92% to 98% addition of the entire silver nitrate amount, $K_2[IrCl_5(H_2O)]$ and $K[IrCl_4(H_2O)_2]$ were added. At the completion of 94% addition of the entire silver nitrate amount, potassium iodide (0.27 mol % per mol of the finished silver halide) was added under vigorous stirring. The thus-obtained emulsion grains were monodisperse cubic silver iodobromochloride grains having a side length of 0.54 μm and a variation coefficient of 8.5%. After flocculation desalting treatment, gelatin, Compounds Ab-1, Ab-2, and Ab-3, and calcium nitrate were added to the resulting emulsion for re-dispersion.

(Ab-1) Antiseptic

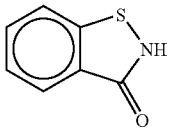

(Ab-2) Antiseptic

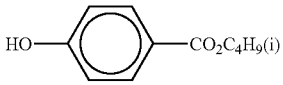

(Ab-3) Antiseptic

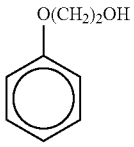

A mixture in 1:1:1:1 (molar ratio) of a, b, c, d

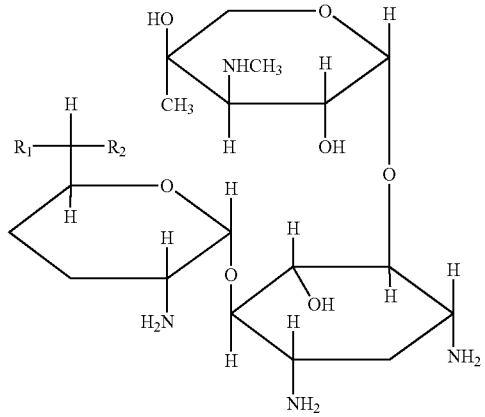

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

The thus re-dispersed emulsion was dissolved at 40° C., and Sensitizing dye S-1, Sensitizing dye S-2, and Sensitizing dye S-3 were added thereto, for optimal spectral sensitization. Then, to the resulting emulsion, were added sodium benzenethiosulfonate, Compound A (N,N-dimethylselenourea, $5.8\times10^{-6}$ mol per mol of the finished silver halide) and (bis(1,4,5-trimethyl-1,2,4-triazolium-3-thiolate) aurate (I) tertafluoroborate), followed by ripening for optimal chemical sensitization. Then, 1-(5-methylureidophenyl)-5-mercaptotetrazole, Compound-2, a mixture whose major components were compounds represented by Compound-3 in which the number of the recurring unit (n) was 2 or 3 (both ends $X_1$ and $X_2$ each were a hydroxy group); Compound-4, and potassium bromide were added, to complete chemical sensitization. The thus-obtained emulsion was referred to as Emulsion BH-1.

Sensitizing dye S-1

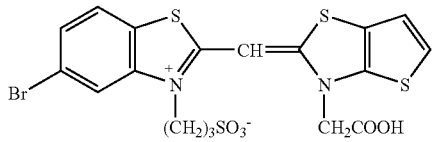

Sensitizing dye S-2

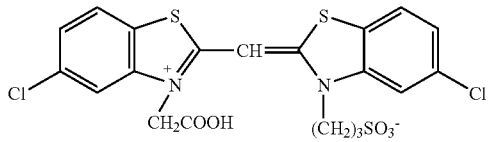

Sensitizing dye S-3

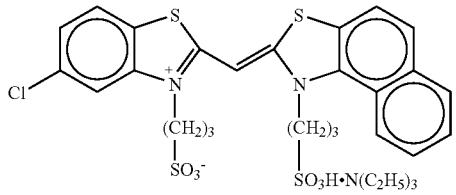

-continued

Compound-1

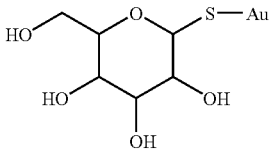

Compound-2

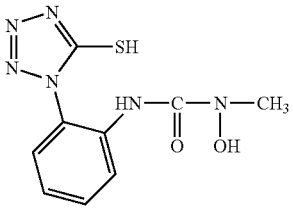

Compound-3

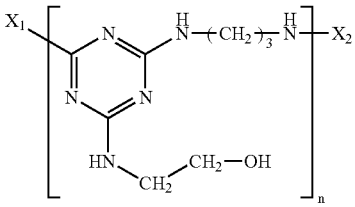

Compound-4

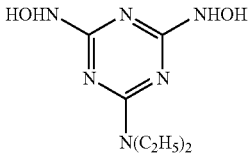

(Preparation of Blue-Sensitive Layer Emulsion BL-1)

Emulsion grains were prepared in the same manner as in the preparation of Emulsion BH-1, except that the temperature and the addition speed at the step of mixing silver nitrate and sodium chloride by simultaneous addition were changed, and that the amounts of respective metal complexes added in the course of the addition of silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion BL-1 was prepared in the same manner as Emulsion BH-1, except that the amounts of various compounds added in the preparation of Emulsion BH1 were changed.

(Preparation of Green-Sensitive Layer Emulsion GH-1)

Using a method of adding silver nitrate and sodium chloride simultaneously to a deionized distilled water containing a deionized gelatin to mix these, under stirring, cubic high silver chloride grains were prepared. In the course of this preparation, $K_4[Ru(CN)_6]$ was added over the step of from 80% to 90% addition of the entire silver nitrate amount. Over the step of from 80% to 100% addition of the entire silver nitrate amount, potassium bromide (2 mol % per mol of the finished silver halide) was added. Over the step of from 83% to 88% addition of the entire silver nitrate amount, $K_2[IrCl_6]$ and $K_2[RhBr_5s(H_2O)]$ were added. At the completion of 90% addition of the entire silver nitrate amount, potassium iodide (0.1 mol % per mol of the finished silver halide) was added under vigorous stirring. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a side length of 0.42 μm and a variation coefficient of 8.0%. The resulting emulsion was subjected to flocculation desalting treatment and re-dispersing treatment in the same manner as described in the above.

This emulsion was dissolved at 40° C., and sodium benzenethiosulfate, p-glutaramidophenyldisulfide, sodium thiosulfate pentahydrate, and (bis(1,4,5-trimethyl-1,2,4-triazolium-3-thiorato) aurate (I) tetrafluoroborate) were added, and the emulsion was subjected to ripening for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. Further, in a midway of the emulsion preparation process, Sensitizing dyes S-4, S-5, S-6, and S-7 were added as sensitizing dyes, to conduct spectral sensitization. The thus-obtained emulsion was referred to as Emulsion GH-1.

Sensitizing dye S-4

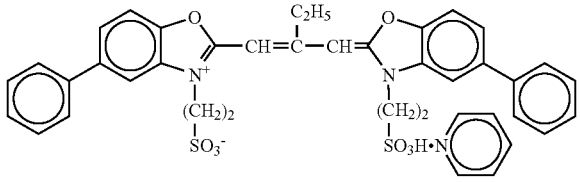

Sensitizing dye S-5

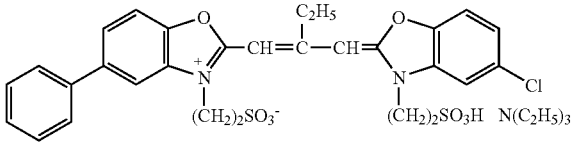

Sensitizing dye S-6

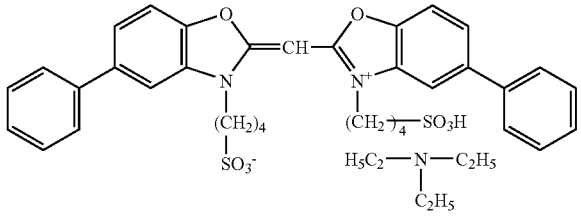

Sensitizing dye S-7

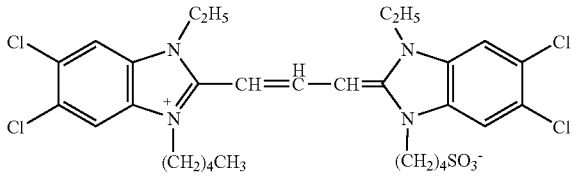

(Preparation of Green-Sensitive Layer Emulsion GL-1)

Emulsion grains were prepared in the same manner as in the preparation of Emulsion GH-1, except that the temperature and the addition speed at the step of mixing silver nitrate and sodium chloride by simultaneous addition were changed, and that the amounts of respective metal complexes that were added in the course of the addition of silver nitrate and sodium chloride were changed. The thus-obtained emulsion grains were monodisperse cubic silver iodobromochloride grains having a side length of 0.35 μm and a variation coefficient of 9.8%. After re-dispersion of this emulsion, Emulsion GL-1 was prepared in the same manner as Emulsion GH-1, except that the amounts of various compounds added in the preparation of Emulsion GH1 were changed.

(Preparation of Red-Sensitive Layer Emulsion RH-1)

Using a method of adding silver nitrate and sodium chloride simultaneously to a deionized distilled water containing a deionized gelatin to mix these, under stirring, cubic high silver chloride grains were prepared. In the course of this preparation, $Cs_2[OsCl_5(NO)]$ was added over the step of from 60% to 80% addition of the entire silver nitrate amount. Over the step of from 80% to 90% addition of the entire silver nitrate amount, $K_4[Ru(CN)_6]$ was added. Over the step of from 80% to 100% addition of the entire silver nitrate amount, potassium bromide (1.3 mol % per mol of the finished silver halide) was added. Over the step of from 83% to 88% addition of the entire silver nitrate amount, $K_2[IrCl_5(5\text{-methylthiazole})]$ was added. At the completion of 88% addition of the entire silver nitrate amount, potassium iodide (in an amount that the silver iodide amount would be 0.05 mol % per mol of the finished silver halide) was added, under vigorous stirring. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a side length of the cubic of 0.39 μm and a variation coefficient of 10%. The resulting emulsion was subjected to flocculation desalting treatment and re-dispersing treatment in the same manner as described in the above.

This emulsion was dissolved at 40° C., and Sensitizing dye S-8, Compound-5, triethylthiourea, and the above-described Compound-1 were added, and the resulting emulsion was ripened for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-1.

Sensitizing dye S-8

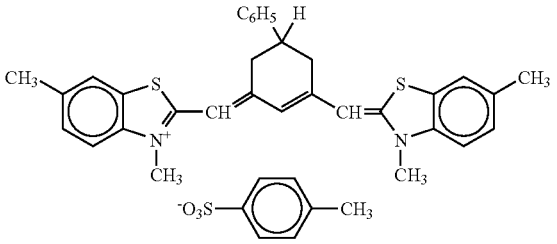

-continued

Compound-5

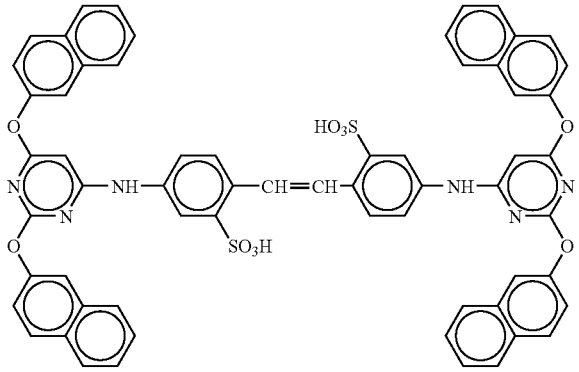

(Preparation of Red-Sensitive Layer Emulsion RL-1)

Emulsion grains were prepared in the same manner as in the preparation of Emulsion RH-1, except that the temperature and the addition speed at the step of mixing silver nitrate and sodium chloride by simultaneous addition were changed, and that the amounts of respective metal complexes that were added in the course of the addition of silver nitrate and sodium chloride were changed. The thus-obtained emulsion grains were monodisperse cubic silver iodobromochloride grains having a side length of 0.29 μm and a variation coefficient of 9.9%. After this emulsion was subjected to flocculation desalting treatment and re-dispersion, Emulsion RL-1 was prepared in the same manner as Emulsion RH-1, except that the amounts of various compounds added in the preparation of Emulsion RH-1 were changed.

(Preparation of a Coating Solution for the First Layer)

Into 23 g of a solvent (Solv-4), 4 g of a solvent (Solv-6), 23 g of a solvent (Solv-9), and 60 ml of ethyl acetate, were dissolved 34 g of a yellow coupler (EX-Y), 1 g of a color-image stabilizer (Cpd-1), 1 g of a color-image stabilizer (Cpd-2), 8 g of a color-image stabilizer (Cpd-8), 1 g of a color-image stabilizer (Cpd-18), 2 g of a color-image stabilizer (Cpd-19), 15 g of a color-image stabilizer (Cpd-20), 1 g of a color-image stabilizer (Cpd-21), 15 g of a color-image stabilizer (Cpd-23), 0.1 g of an additive (ExC-1), and 1 g of a color-image stabilizer (UV-2). This solution was emulsified and dispersed in 270 g of a 20 mass % aqueous gelatin solution containing 4 g of sodium dodecylbenzenesulfonate, with a high-speed stirring emulsifier (dissolver). Then, water was added thereto, to prepare 900 g of Emulsified dispersion A.

Separately, the above-described Emulsified dispersion A, and the above-described Emulsions BH-1 and BL-1 were mixed and dissolved, to prepare a coating solution for the first layer having the composition shown below. The coating amounts of the emulsions are in terms of silver.

The coating solutions for the second to seventh layers were prepared in the similar manner as the coating solution for the first layer. As a gelatin hardener for each layer, 1-oxy-3,5-dichloro-s-triazine sodium salt (H-1), (H-2), and (H-3) were used. Further, Ab-1, Ab-2, Ab-3, and Ab-4 were added to each layer, so that their total amounts would be 7.0 $mg/m^2$, 43.0 $mg/m^2$, 3.5 $mg/m^2$, and 10.0 $mg/m^2$, respectively.

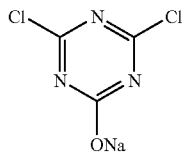

(H-1) Hardener

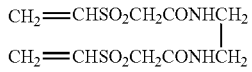

(H-2) Hardener

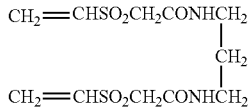

(H-3) Hardener

Further, 1-(3-methylureidophenyl)-5-mercaptotetrazole was added to the second layer, the fourth layer, and the sixth layer, in amounts of 0.2 mg/m$^2$, 0.2 mg/m$^2$, and 0.6 mg/m$^2$, respectively. Further, 4-hydroxy-6-methyl-1,3,3a,7-tetrazaindene was added to the blue-sensitive emulsion layer and the green-sensitive emulsion layer, in amounts of $1\times10^{-4}$ mol and $2\times10^{-4}$ mol, respectively, per mol of silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Further, disodium catecol-3,5-disulfonate was added to the second layer, the fourth layer, and the sixth layer, so that respective amounts would be 6 mg/m$^2$, 6 mg/m$^2$, and 18 mg/m$^2$. Further, to each layer, sodium polystyrenesulfonate was optionally added to adjust viscosity of the coating solutions. Further, in order to prevent irradiation, the following dyes (coating amounts are shown in parentheses) were added.

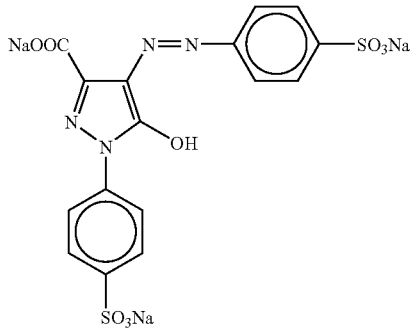

(2 mg/m$^2$)

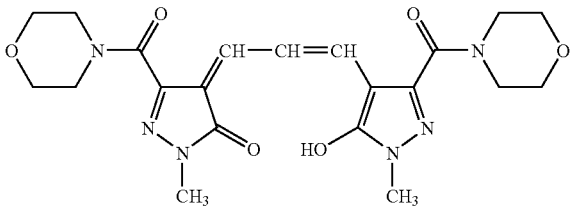

(2 mg/m$^2$)

-continued

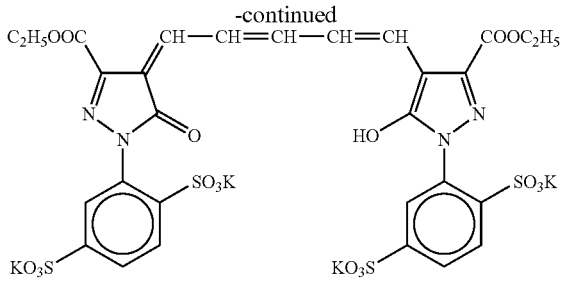

(24 mg/m$^2$)

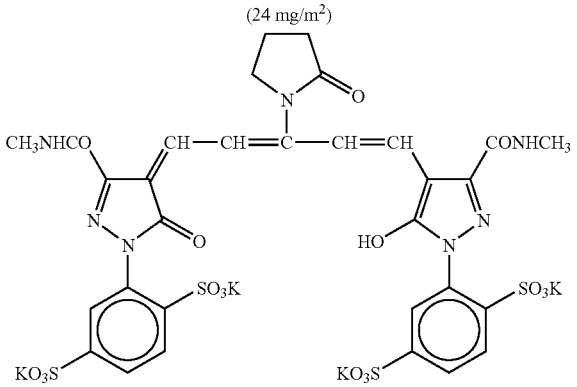

(3 mg/m$^2$)

(Layer Constitution)

The composition of each layer is shown below. The numbers show coating amounts (g/m$^2$). With respect to silver halide emulsions, the coating amount is in terms of silver.

Support

Polyethylene-Resin-Laminated Paper

[The polyethylene resin on the first layer side contained a white pigment ($TiO_2$, content of 16 mass %;

ZnO, content of 4 mass %), a fluorescent whitening agent (4,4'-bis(5-methylbenzoxazolyl)stilbene, content of 0.03 mass %) and a bluish dye (ultramarine, content of 0.33 mass %). The amount of the polyethylene resin was 29.2 g/m$^2$]

| | |
|---|---|
| First Layer (Blue-sensitive emulsion layer) | |
| Emulsion (a 5:5 mixture of BH-1 and BL-1 (in terms of mol of silver)) | 0.16 |
| Gelatin | 1.32 |
| Yellow coupler (EX-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.02 |
| Color-image stabilizer (Cpd-20) | 0.15 |
| Color-image stabilizer (Cpd-21) | 0.01 |
| Color-image stabilizer (Cpd-23) | 0.15 |
| Additive (ExC-1) | 0.001 |
| Color-image stabilizer (UV-4) | 0.01 |
| Solvent (Solv-4) | 0.23 |
| Solvent (Solv-6) | 0.04 |
| Solvent (Solv-9) | 0.23 |
| Second Layer (Color-mixing inhibiting layer) | |
| Gelatin | 0.78 |
| Color-mixing inhibitor (Cpd-4) | 0.05 |
| Color-mixing inhibitor (Cpd-13) | 0.01 |

-continued

| | |
|---|---|
| Color-image stabilizer (Cpd-5) | 0.006 |
| Color-image stabilizer (Cpd-6) | 0.05 |
| Color-image stabilizer (Cpd-7) | 0.006 |
| Color-image stabilizer (UV-A) | 0.06 |
| Solvent (Solv-1) | 0.06 |
| Solvent (Solv-2) | 0.06 |
| Solvent (Solv-5) | 0.07 |
| Solvent (Solv-8) | 0.07 |
| Third Layer (Green-sensitive emulsion layer) | |
| Emulsion (a 1:3 mixture of GH-1 and GL-1 (in terms of mol of silver)) | 0.12 |
| Gelatin | 0.95 |
| Magenta coupler (ExM) | 0.12 |
| Ultraviolet absorbing agent (UV-A) | 0.03 |
| Color-image stabilizer (Cpd-2) | 0.01 |
| Color-image stabilizer (Cpd-6) | 0.08 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth Layer (Color-mixing inhibiting layer) | |
| Gelatin | 0.65 |
| Color-mixing inhibitor (Cpd-4) | 0.04 |
| Color-mixing inhibitor (Cpd-13) | 0.01 |
| Color-image stabilizer (Cpd-5) | 0.005 |
| Color-image stabilizer (Cpd-6) | 0.04 |
| Color-image stabilizer (Cpd-7) | 0.005 |
| Color-image stabilizer (UV-A) | 0.05 |
| Solvent (Solv-1) | 0.05 |
| Solvent (Solv-2) | 0.05 |
| Solvent (Solv-5) | 0.06 |
| Solvent (Solv-8) | 0.06 |
| Fifth Layer (Red-sensitive emulsion layer) | |
| Emulsion (a 4:6 mixture of RH-1 and RL-1 (in terms of mol of silver)) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.18 |
| Color-image stabilizer (Cpd-16) | 0.002 |
| Color-image stabilizer (Cpd-17) | 0.001 |
| Color-image stabilizer (Cpd-18) | 0.05 |
| Color-image stabilizer (Cpd-19) | 0.04 |
| Color-image stabilizer (UV-5) | 0.10 |
| Solvent (Solv-5) | 0.19 |
| Sixth Layer (Ultraviolet absorbing layer) | |
| Gelatin | 0.34 |
| Ultraviolet absorbing agent (UV-B) | 0.24 |
| Compound (S1-4) | 0.0015 |
| Solvent (Solv-7) | 0.11 |
| Seventh Layer (Protective Layer) | |
| Gelatin | 0.82 |
| Additive (Cpd-22) | 0.03 |
| Liquid paraffin | 0.02 |
| Surface-active agent (Cpd-13) | 0.02 |

-continued (EX-Y) Yellow coupler

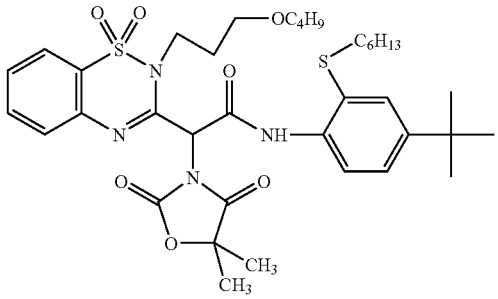

(ExM) Magenta coupler

A mixture in 40:40:20 (molar ratio) of

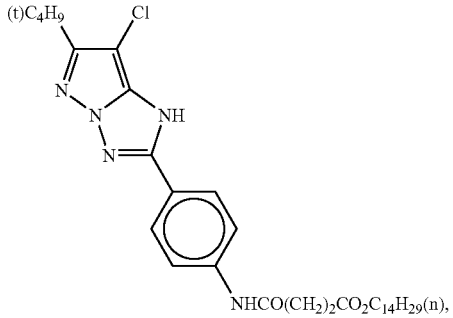

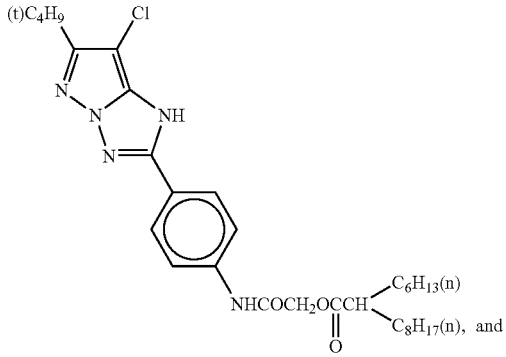

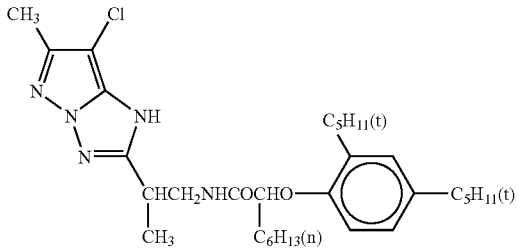

-continued (ExC-1) Cyan coupler

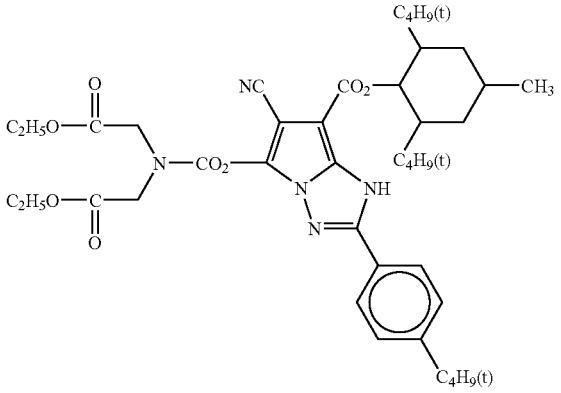

(ExC-2) Cyan coupler

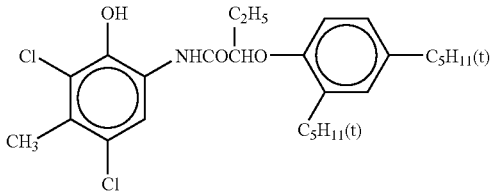

(ExC-3) Cyan coupler

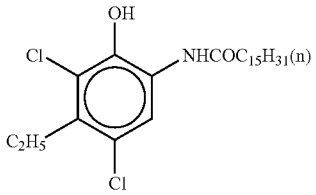

(Cpd-1) Color-image stabilizer

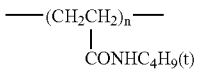

Number-average molecular weight 60,000

(Cpd-2) Color-image stabilizer

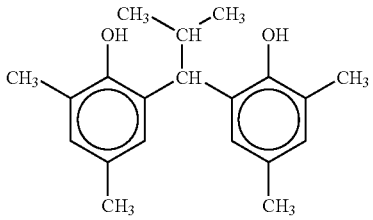

(Cpd-3) Color-image stabilizer

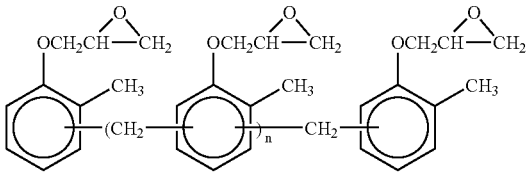

n = 7~8 (average value)

(Cpd-4) Color-mixing inhibitor

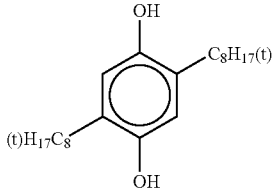

-continued (Cpd-5) Color-image stabilizer

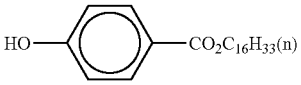

(Cpd-6) Color-image stabilizer

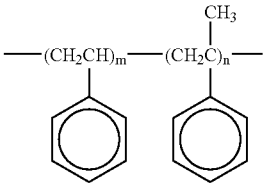

Number-average molecular weight 600 m/n = 10/90

(Cpd-7) Color-image stabilizer

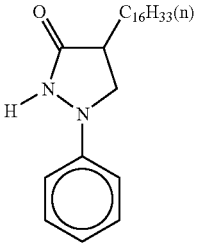

(Cpd-8) Color-image stabilizer

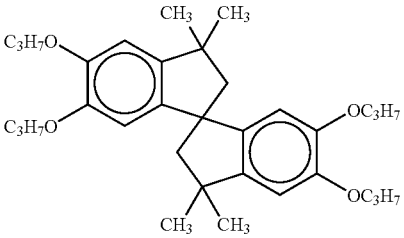

(Cpd-9) Color-image stabilizer

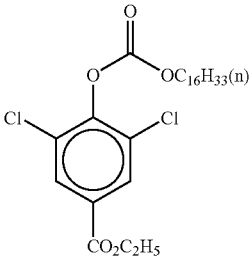

(Cpd-10) Color-image stabilizer

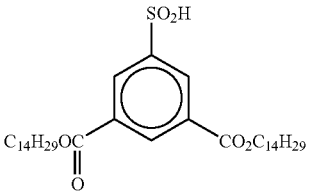

-continued
(Cpd-11)
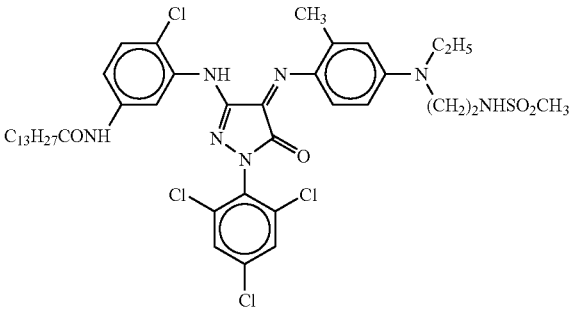
(Cpd-12)
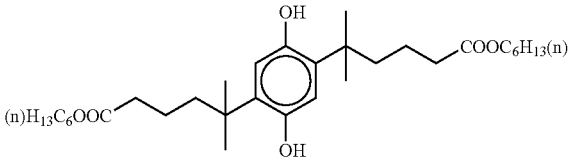
(Cpd-13) Surface-active agent
A mixture in 6:2:2 (molar ratio) of (a)/(b)/(c)
(a)
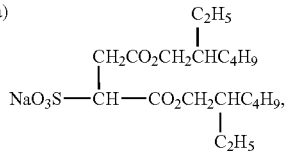
(b)
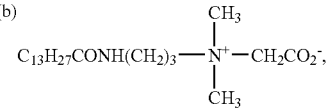
(c)
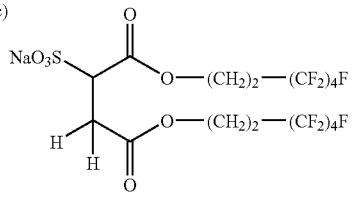
(Cpd-14)
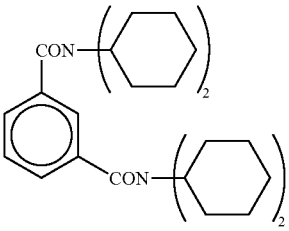
(Cpd-15)
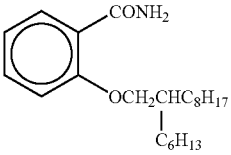
(Cpd-16)
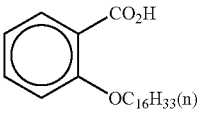
-continued
(Cpd-17)
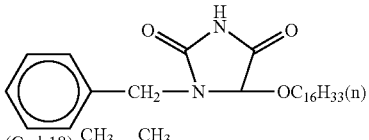
(Cpd-18)
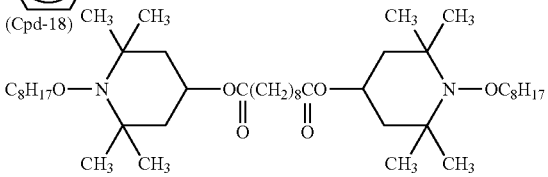
(Cpd-19)
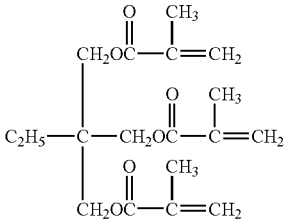
(Cpd-20)
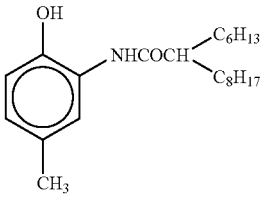
(Cpd-21)
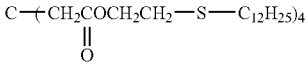
(Cpd-22)
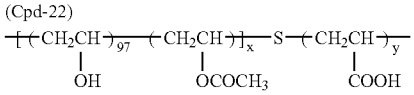
x:y = 5:1 (mass ratio)
(Cpd-23)
KAYARAD DPCA-30
manufactured by Nippon Kayaku Co., Ltd.
(Solv-1)
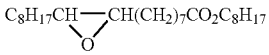
(Solv-2)
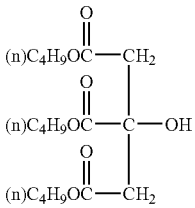
(Solv-3)
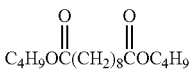
(Solv-4)
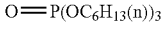
(Solv-5)
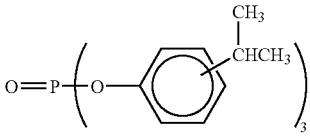

-continued (Solv-6)

$C_8H_{17}CH{=}CHC_8H_{16}OH$ (Solv-7)

$C_8H_{17}OC(=O)(CH_2)_8C(=O)OC_8H_{17}$ (Solv-8)

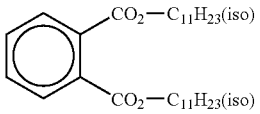

(Solv-9)

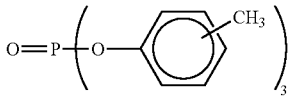

(S1-4)

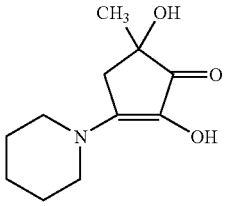

(UV-1) Ultraviolet absorbing agent

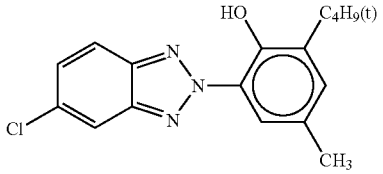

(UV-2) Ultraviolet absorbing agent

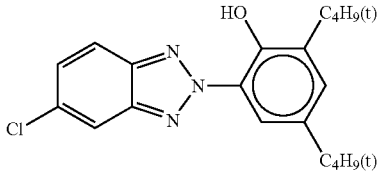

(UV-3) Ultraviolet absorbing agent

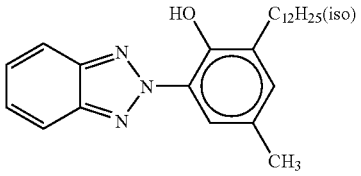

(UV-4) Ultraviolet absorbing agent

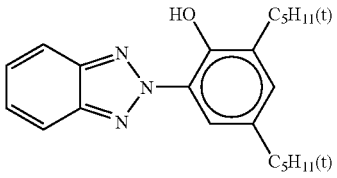

-continued (UV-5) Ultraviolet absorbing agent

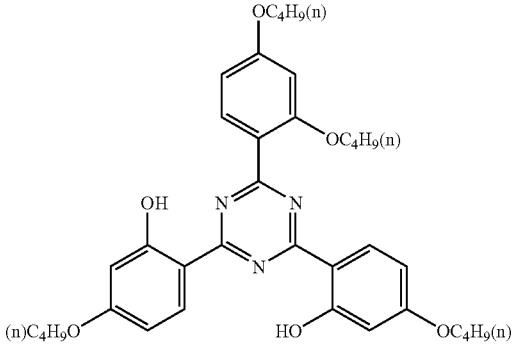

UV-A: A mixture of UV-1/UV-4/UV-5 = 1/7/2 (mass ratio)
UV-B: A mixture of UV-1/UV-3/UV-4/UV-5 = 1/3/5/1 (mass ratio)

The thus-obtained sample was designated to as Sample 101. Samples 102 to 108 were prepared in the same manner as Sample 101, except that Compound A was changed, as shown in Table 1 below.

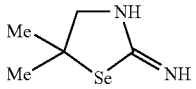

Compound B: Compound described in JP-A-10-186563

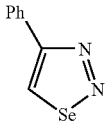

Compound C: Compound described in JP-A-6-317867

Processing Process

The above Sample 105 was processed into a form of a roll with a width of 127 mm, and the resultant sample was exposed with a standard photographic image, by using Digital Mini Lab FRONTIER 350 (trade name, manufactured by Fuji Photo Film Co., Ltd.). Thereafter, a continuous processing (running test) was performed until the volume of the color-developer replenisher used in the following processing step became twice the volume of the color-developer tank.

| Processing step | Temperature | Time | Replenishment rate* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | |
| Rinse (2) | 38.0° C. | 20 sec | — |
| Rinse (3)** | 38.0° C. | 20 sec | — |
| Rinse (4)** | 38.0° C. | 20 sec | 121 ml |
| Drying | 80° C. | | |

(Note)
*Replenishment rate per $m^2$ of the photosensitive material to be processed
**A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from (1) to (4).

The compositions of each processing solution were as follows.

| | (Tank solution) | (Replenisher) |
|---|---|---|
| (Color developer) | | |
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl) aniline · 3/2 sulfate · monohydrate | 4.8 g | 14.0 g |
| Potassium carbonate | 26.3 g | 26.3 g |
| Water to make | 1,000 ml | 1,000 ml |
| pH (25°C., adjusted using sulfuric acid and KOH) | 10.15 | 12.40 |
| (Bleach-fixing solution) | | |
| Water | 800 ml | 600 ml |
| Ammonium thiosulfate (750 g/l) | 107 ml | 214 ml |
| m-Carboxybenzenesulfmic acid | 8.3 g | 16.5 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25°C., adjusted using nitric acid and aqueous ammonia) | 6.5 | 6.5 |
| (Rinse solution) | | |
| Sodium chlorinated-isocyanurate | 0.02 g | 0.02 g |
| Deionized water (conductivity: 5 μS/cm or less) | 1,000 ml | 1,000 ml |
| pH (25°C.) | 6.5 | 6.5 |

FL-1

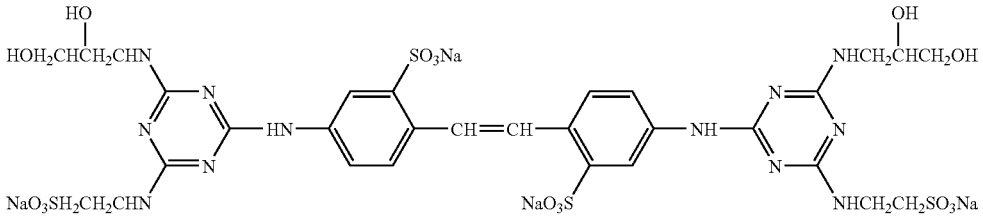

FL-2

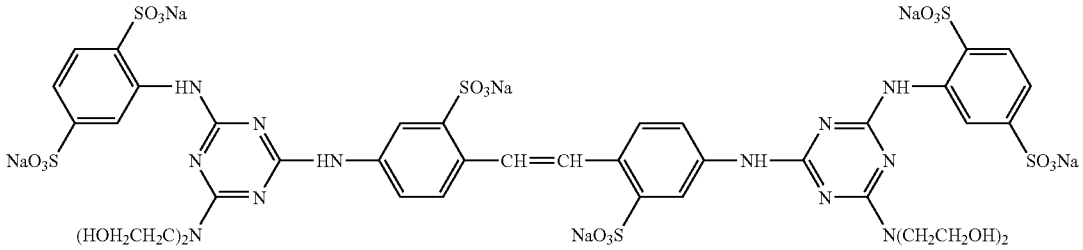

Each sample was subjected to gradation exposure to impart gray, with the exposure apparatus, which will be described later, and then, at five seconds after the exposure was finished, the sample was subject to color-development processing by the above processing. As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MG, manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers was maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds. The sensitivity was defined as the inverse number of the exposure amount required to give a density higher by 1.0 than the fog density of yellow, and expressed by a relative value when the sensitivity of Sample 101 was defined as 100.

To evaluate the rate of increase in the fog density of yellow when a light-sensitive material was stored for a long period of time, the above exposure and processing were carried out for the case of each sample being stored for two weeks in an atmosphere of 35° C./55% RH, and the case of each sample being stored in a refrigerator (10° C.) for the same period of time. The increase in the fog density of yellow was expressed by the difference (AD) in fog density between the sample stored in the refrigerator and the sample stored at 350C/55% RH. The larger the value (difference) is, the larger the increase in the fog density of yellow is, when the light-sensitive material is stored for a long period of time.

TABLE 1

| Sample | Added compound | Relative sensitivity | ΔD | Remarks |
|---|---|---|---|---|
| 101 | Compound A | 100 | 0.08 | Comparative example |
| 102 | Compound B | 97 | 0.06 | Comparative example |
| 103 | Compound C | 95 | 0.07 | Comparative example |
| 104 | Compound 8 according to this invention | 128 | 0.02 | This invention |
| 105 | Compound 10 according to this invention | 132 | 0.05 | This invention |
| 106 | Compound 11 according to this invention | 129 | 0.03 | This invention |
| 107 | Compound 15 according to this invention | 131 | 0.04 | This invention |
| 108 | Compound 24 according to this invention | 127 | 0.02 | This invention |

As is apparent from the results in Table 1, it is understood that the color papers containing the silver halide grains, which were chemically sensitized in the presence of the compound represented by formula (1), were remarkably high in sensitivity and quite low in the fog density after storage for a long period of time.

Also, when chemical sensitization was conducted in the presence of the compound represented by formula (1), the formed image was contrasty.

In addition, when the same treatment as above was performed, except that the temperature of the developer was changed appropriately, suppression of variation in fogging was observed with the samples in which compounds of the present invention were used.

Also, when compounds represented by formula (I), in which $X^1$ was a group other than NH, or $X^2$ was a group other than $NH_2$, or E was a group represented by formulae (2) or (5), similar results to those obtained by use of the above-mentioned compound according to the present invention, were obtained.

Example 2

(Preparation of Seed Emulsion 1)

One liter of a dispersion medium solution, containing 0.38 g of KBr and 0.5 g of a low-molecular weight gelatin (molecular weight, 15,000), was kept in a reactor at 40° C., and then thereto was added 20 ml of a 0.29 mol/l aqueous silver nitrate solution, and 20 ml of a 0.29 mol/l aqueous KBr solution, simultaneously, over 40 seconds, with stirring. After the addition was finished, 22 ml of a 10% KBr solution was added to the mixture, which was then heated to 75° C. After the temperature was raised, an aqueous gelatin solution (60° C.) of 35 g of trimellitated gelatin in 250 ml of water was added to the dispersion medium solution. At this time, the solution was adjusted to pH 6.0. Then, a 1.2 mol/l aqueous silver nitrate solution and a 1.2 mol/l aqueous KBr solution were added, simultaneously, to the above solution. At this time, silver iodide fine-grains were added at the same time, in an amount that would make the proportion of silver iodide to silver nitrate to be added be 10 mol %. At this time, the pBr of the dispersion medium was kept at 2.64. After the solution was washed with water, a gelatin was added thereto, to adjust the solution to make the pH and pAg of the solution 5.7 and 8.8, respectively; to make the mass of silver per 1 kg of the emulsion 131.8 g, and to make the mass of the gelatin 64.1 g, to thereby prepare Seed emulsion 1.

(Preparation of Emulsion Em-K)

1,211 ml of an aqueous solution containing 46 g of trimellitated gelatin, with a trimellitated degree of 97%, and 1.7 g of KBr, was kept at 75° C. and stirred vigorously. 48 g of the aforementioned Seed emulsion 1 was added to the solution, and then to thereto was added 0.3 g of a modified silicon oil (L7602, trade name, manufactured by Nippon Unicar Company Limited). The resulting solution was adjusted to pH 5.5 by adding $H_2SO_4$. Then, to the above solution, an aqueous KBr and KI mixture solution containing KI 10 mol % and 67.6 ml of an aqueous solution containing 7.0 g of $AgNO_3$, were added, over six minutes, by a double jet method in such a manner that the flow rates of the solutions were accelerated to make the final flow rates 5.1 times the initial flow rates. At this time, the potential of silver was kept at +0 mV to a saturated calomel electrode. After 2 mg of sodium benzenethiosulfonate and 2 mg of thiourea dioxide were added to the solution, an aqueous KBr and KI mixed solution containing KI 10 mol % and 600 ml of an aqueous solution containing 170 g of $AgNO_3$, were added to the above solution, over 120 minutes, by a double jet method, in such a manner that the flow rates of the solutions were accelerated to make the final flow rates 3.7 times the initial flow rates. At this time, the potential of silver was kept at +10 mV to a saturated calomel electrode. 150 ml of an aqueous solution containing 46.8 g of $AgNO_3$, and an aqueous KBr solution, were added, over 22 minutes, by a double jet method. At this time, the potential of silver was kept at +20 mV with respect to a saturated calomel electrode. After the resulting solution was washed with water, a gelatin was added, to adjust the solution to pH 5.8 and pAg 8.7, at 40° C. N-hydroxy-N-methylurea and F-11 were added to the solution, which was then heated to 60° C. Sensitizing dyes 13 and 14 were added, and then potassium thiocyanate, chloroauric acid, and sodium thiosulfate were added, in proper amounts, and further, Compound A ($4.0\times10^{6}$ mol per mol of the finished silver halide) was added to the solution, to carry out optimum chemical sensitization. F-2 and F-3 were added when the chemical sensitization was finished.

The support used in this example was prepared in the following manner.

1) First Layer and Undercoat Layer

A polyethylene naphthalate support, 90 μm in thickness, was subjected to glow discharge treatment, in which both surfaces of the support were treated in the following conditions: treating atmosphere pressure, 2.66×10 Pa; partial pressure of $H_2O$ in the atmosphere gas, 75%; discharge frequency, 30 kHz; power, 2,500 W; and process intensity, 0.5 kV*A*min/$m^2$. Onto this support, a coating solution having the following composition was applied as a first layer, in a coating amount of 5 mL/$m^2$, using a bar coating method described in JP-B-58-4589.

| | |
|---|---|
| Conductive fine-particle dispersion (aqueous dispersion having a $SnO_2/Sb_2O_5$ particle concentration of 10%, secondary aggregate of primary particles having a particle diameter of 0.005 μm, the secondary aggregate having an average particle diameter of 0.05 μm) | 50 mass parts |
| Gelatin | 0.5 mass part |
| Water | 49 mass parts |
| Polyglycerol polyglycidyl ether | 0.16 mass part |
| Poly oxyethylene sorbitan monolaurate (degree of polymerization: 20) | 0.1 mass part |

Further, after the first layer was formed by coating, the support was wound around a stainless core with a diameter of 20 cm, and heat-treated at 110° C. (Tg of the PEN support, 119° C.) for 48 hours, imparting heat history, followed by annealing. Then, a coating solution having the following composition was applied, as an undercoat layer for emulsion, to the side opposite to the first layer side of the support, in a coating amount of 10 mL/$m^2$, using a bar coating method.

| | |
|---|---|
| Gelatin | 1.01 mass parts |
| Salicylic acid | 0.30 mass part |
| Resorcin | 0.40 mass part |
| Polyoxyethylene nonylphenyl ether (degree of polymerization: 10) | 0.11 mass part |
| Water | 3.53 mass parts |
| Methanol | 84.57 mass parts |
| n-Propanol | 10.08 mass parts |

Further, a second layer and a third layer, which will be explained later, were formed, in this order, on the first layer by coating, and finally, a color negative light-sensitive material, having a composition that will be explained later, was multi-coated to the side opposite with respect to the support, to manufacture a transparent magnetic recording medium with silver halide emulsion layers.

2) Second Layer (Transparent Magnetic Recording Layer)

(1) Dispersion of a Magnetic Substance 1100 mass parts of γ-$Fe_2O_3$ magnetic substance coated with Co (average major axis length, 0.25 μm; $S_{BET}$, 39 $m^2$/g; Hc, 6.56×$10^4$ A/m; σS, 77.1 A/$m^2$/kg; and σr, 37.4 A$m^2$/kg), 220 mass parts of water, and 165 mass parts of a silane coupling agent (i.e. 3-(polyoxyethynyl)oxypropyl trimethoxysilane (degree of polymerization, 10)), were added and thoroughly kneaded for three hours in an open kneader. This coarsely dispersed and viscous solution was dried at 70° C. for one day and one night, to remove water, followed by heat treatment at 110° C. for one hour, to manufacture surface-treated magnetic particles.

Further, the following components were kneaded for 4 hours again in an open kneader.

| | |
|---|---|
| The above surface-treated magnetic particles | 855 g |
| Diacetyl cellulose | 25.3 g |
| Methyl ethyl ketone | 136.3 g |
| Cyclohexanone | 136.3 g |

Further, the following components were finely dispersed for 4 hours in a sand mill (¼ G sand mill) at 2,000 rpm. As the dispersing media, 1 mmϕ glass beads were used.

| | |
|---|---|
| The above kneaded solution | 45 g |
| Diacetyl cellulose | 23.7 g |
| Methyl ethyl ketone | 127.7 g |
| Cyclohexanone | 127.7 g |

Further, according to the following formulation, a magnetic-substance-containing intermediate solution was manufactured.

(2) Preparation of a Magnetic-Substance-Containing Intermediate Solution

| | |
|---|---|
| The above fine-dispersion of the magnetic substance | 674 g |
| Diacetyl cellulose solution (solid content, 4.34%; solvent, methylethylketone/cyclohexanone = 1/1) | 24,280 g |
| Cyclohexanone | 46 g |

These components were mixed and then stirred using a disper, to manufacture a "magnetic-substance-containing intermediate solution".

The following components were used, to manufacture an α-alumina abrasive dispersion.

(a) Preparation of a Particle Dispersion of Sumiko Random AA-1.5 (Average Primary Particle Diameter, 1.5 μm; Specific Surface Area, 1.3 $m^2$/g)

| | |
|---|---|
| Sumiko Random AA-1.5 | 152 g |
| Silane coupling agent KBM 903 (trade name, manufactured by Shin-Etsu Silicone Co., Ltd.) | 0.48 g |
| Diacetyl cellulose solution (solid content, 4.5%; solvent, methylethylketone/cyclohexanone = 1/1) | 227.52 g |

The above components were finely dispersed, using a sand mill (¼ G sand mill) coated with ceramics, at 800 rpm for 4 hours. As the media, 1 mmϕ zirconia beads were used.

(b) Colloidal Silica Particle Dispersion (Fine-Particles)

"MEK-ST", trade name, manufactured by Nissan Chemical Industries Ltd., was used.

This is a dispersion of colloidal silica having an average primary particle diameter of 0.015 μm, in methyl ethyl ketone as the dispersion medium, with the solid content of 30%.

(3) Preparation of a Second Layer Coating Solution

| | |
|---|---|
| The above magnetic-substance-containing intermediate solution | 19,053 g |
| Diacetyl cellulose solution (solid content, 4.5%; solvent, methylethylketone/cyclohexanone = 1/1) | 264 g |
| Colloidal silica dispersion "MEK-ST" "dispersion b" (solid content: 30%) | 128 g |
| AA-1.5 dispersion "dispersion a" | 12 g |
| Millionate MR-400 diluted solution (trade name, manufactured by Nippon Polyurethane Industry Co., Ltd.; solid content, 20%; dilute solvent, methylethylketone/cyclohexanone = 1/1) | 203 g |
| Methyl ethyl ketone | 170 g |
| Cyclohexanone | 170 g |

A coating solution obtained by mixing and stirring the above components was applied in a coating amount of 29.3 mL/m$^2$, by using a wire bar. The coated solution was dried at 110° C. The dried thickness of the magnetic layer was 1.0 μm.

3) Third Layer (Higher Fatty Acid Ester Lubricant-Containing Layer)

(1) Preparation of a Lubricant Dispersion Stock Solution

The following Solution (i) was heated to 100° C. to dissolve, and it was added to the following Solution (ii). The resultant mixed solution was dispersed with a high-pressure homogenizer, to prepare a lubricant dispersion stock solution.

| | |
|---|---|
| Solution (i) | |
| The following compound: $C_6H_{13}CH(OH)(CH_2)_{10}COOC_{50}H_{101}$ | 399 mass parts |
| The following compound: $n\text{-}C_{50}H_{101}O(CH_2CH_2O)_{16}H$ | 171 mass parts |
| Cyclohexanone | 830 mass parts |
| Solution (ii) | |
| Cyclohexanone | 8,600 mass parts |

(2) Preparation of a Spherical Inorganic Particle Dispersion

The following formulation was used, to prepare a spherical inorganic particle dispersion (c1).

| | |
|---|---|
| Isopropyl alcohol | 93.54 mass parts |
| Silane coupling agent KBM903 (trade name, manufactured by Shin Etsu Silicone Co., Ltd.) Compound 1-1: $(CH_3O)_3Si—(CH_2)_3—NH_2$ | 5.53 mass parts |
| Compound 1 | 2.93 mass parts |
| Compound 1 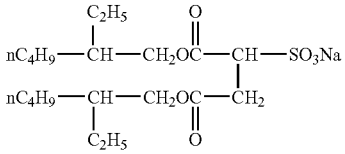 | |
| Seehosta KEP50 (trade name) (amorphous spherical silica; average particle diameter, 0.5 μm; manufactured by Nippon Shokubai Co., Ltd.) | 88.00 mass parts |

The above components were stirred for 10 minutes, and then the following component was added thereto.

| | |
|---|---|
| Diacetone alcohol | 252.93 mass parts |

The resulting solution was dispersed for 3 hours, under ice-cooling and stirring, with a ultrasonic homogenizer "SONIFIER450" (trade name, manufactured by BRANSON), to complete a spherical inorganic particle dispersion c1.

(3) Preparation of a Spherical Organic Polymer Particle Dispersion

A spherical organic polymer particle dispersion "c2" was prepared using the following formulation.

| | |
|---|---|
| XC99-A8808 (trade name, manufactured by GE Toshiba Silicones, spherical crosslinked polysiloxane particles, average particle diameter of 0.9 μm) | 60 mass parts |
| Methyl ethyl ketone | 120 mass parts |
| Cyclohexanone (solid content, 20%; solvent, methylethylketone/cyclohexanone = 1/1) | 120 mass parts |

The above components were dispersed for 2 hours, under ice-cooling and stirring, with a ultrasonic homogenizer "SONIFIER450" (trade name, manufactured by BRANSON), to complete a spherical organic polymer particle dispersion c2.

(4) Preparation of a Third Layer Coating Solution

To 542 g of the aforementioned lubricant dispersion stock solution, were added the following components, to prepare a third layer coating solution.

| | |
|---|---|
| Diacetone alcohol | 5,950 g |
| Cyclohexanone | 176 g |
| Ethyl acetate | 1,700 g |
| The above Seehosta KEP50 dispersion "c1" | 53.1 g |
| The above spherical organic polymer particle dispersion "c2" | 300 g |
| FC 431 (trade name, manufactured by 3M, solid content of 50%; solvent, ethyl acetate) | 2.65 g |
| BYK 310 (trade name, manufactured by BYK Chemi Japan Co., Ltd.; solid content, 25%) | 5.3 g |

The above third layer coating solution was applied onto the second layer, in a coating amount of 10.35 mL/m$^2$, and then dried at 110° C., further at 97° C., for 3 minutes.

4) Formation of Light-Sensitive Layers by Coating

Then, each layer having the following composition was multicoated, to the side opposite to the above-obtained back layer with respect to the support, to prepare a color negative film sample 201.

(Light-Sensitive Layer Constitution)

The number corresponding to each component indicates the coating amount in unit of g/m$^2$. In the case of the silver halide emulsion, the coating amount is in terms of silver.

(Sample 201)

| | | |
|---|---|---|
| First Layer (First halation-preventing layer) | | |
| Black colloidal silver | silver | 0.168 |
| Silver iodobromide emulsion (not spectrally sensitized) (average particle diameter | silver | 0.010 |

-continued (Sample 201)

| | | |
|---|---|---|
| in equivalent-sphere diameter, 0.07 μm) | | |
| Gelatin | | 0.740 |
| ExM-1 | | 0.068 |
| ExC-1 | | 0.002 |
| ExC-3 | | 0.002 |
| Cpd-2 | | 0.001 |
| F-8 | | 0.001 |
| HBS-1 | | 0.099 |
| HBS-2 | | 0.013 |
| Second Layer (Second halation-preventing layer) | | |
| Black colloidal silver | silver | 0.102 |
| Gelatin | | 0.667 |
| ExF-1 | | 0.002 |
| F-8 | | 0.001 |
| Solid dispersed dye ExF-7 | | 0.100 |
| HBS-1 | | 0.045 |
| Third Layer (Intermediate layer) | | |
| ExC-2 | | 0.050 |
| Cpd-1 | | 0.089 |
| Polyethyl acrylate latex | | 0.200 |
| HBS-1 | | 0.054 |
| Gelatin | | 0.458 |
| Fourth Layer (Low-sensitivity red-sensitive emulsion layer) | | |
| Em-C | silver | 0.320 |
| Em-D | silver | 0.414 |
| ExC-1 | | 0.354 |
| ExC-2 | | 0.014 |
| ExC-3 | | 0.093 |
| ExC-4 | | 0.193 |
| ExC-5 | | 0.034 |
| ExC-6 | | 0.015 |
| ExC-8 | | 0.053 |
| ExC-9 | | 0.020 |
| Cpd-2 | | 0.025 |
| Cpd-4 | | 0.025 |
| Cpd-7 | | 0.015 |
| UV-2 | | 0.022 |
| UV-3 | | 0.042 |
| UV-4 | | 0.009 |
| UV-5 | | 0.075 |
| HBS-1 | | 0.274 |
| HBS-5 | | 0.038 |
| Gelatin | | 2.757 |
| Fifth Layer (Medium-sensitivity red-sensitive emulsion layer) | | |
| Em-B | silver | 1.152 |
| ExM-5 | | 0.011 |
| ExC-1 | | 0.304 |
| ExC-2 | | 0.057 |
| ExC-3 | | 0.020 |
| ExC-4 | | 0.135 |
| ExC-5 | | 0.012 |
| ExC-6 | | 0.039 |
| ExC-8 | | 0.016 |
| ExC-9 | | 0.077 |
| Cpd-2 | | 0.056 |
| Cpd-4 | | 0.035 |
| Cpd-7 | | 0.020 |
| HBS-1 | | 0.190 |
| Gelatin | | 1.346 |
| Sixth Layer (High-sensitivity red-sensitive emulsion layer) | | |
| Em-A | silver | 0.932 |
| ExM-5 | | 0.156 |
| ExC-1 | | 0.066 |
| ExC-3 | | 0.015 |
| ExC-6 | | 0.027 |
| ExC-8 | | 0.114 |
| ExC-9 | | 0.089 |
| ExC-10 | | 0.107 |

-continued (Sample 201)

| | | |
|---|---|---|
| ExY-3 | | 0.010 |
| Cpd-2 | | 0.070 |
| Cpd-4 | | 0.079 |
| Cpd-7 | | 0.030 |
| HBS-1 | | 0.314 |
| HBS-2 | | 0.120 |
| Gelatin | | 1.206 |
| Seventh Layer (Intermediate layer) | | |
| Cpd-1 | | 0.078 |
| Cpd-6 | | 0.369 |
| Solid dispersed dye ExF-4 | | 0.030 |
| HBS-1 | | 0.048 |
| Polyethyl acrylate latex | | 0.088 |
| Gelatin | | 0.739 |
| Eighth Layer (Layer to give interlayer effect to red-sensitive layers) | | |
| Em-E | silver | 0.408 |
| Cpd-4 | | 0.034 |
| ExM-2 | | 0.121 |
| ExM-3 | | 0.002 |
| ExM-4 | | 0.035 |
| ExY-1 | | 0.018 |
| ExY-4 | | 0.038 |
| ExC-7 | | 0.036 |
| HBS-1 | | 0.343 |
| HBS-3 | | 0.006 |
| HBS-5 | | 0.030 |
| Gelatin | | 0.884 |
| Ninth Layer (Low-sensitivity green-sensitive emulsion layer) | | |
| Em-H | silver | 0.276 |
| Em-I | silver | 0.238 |
| Em-J | silver | 0.325 |
| ExM-2 | | 0.344 |
| ExM-3 | | 0.055 |
| ExY-1 | | 0.018 |
| ExY-3 | | 0.014 |
| ExC-7 | | 0.004 |
| HBS-1 | | 0.505 |
| HBS-3 | | 0.012 |
| HBS-4 | | 0.095 |
| HBS-5 | | 0.055 |
| Cpd-5 | | 0.010 |
| Cpd-7 | | 0.020 |
| Gelatin | | 1.382 |
| Tenth layer (Middle-sensitivity green-sensitive emulsion layer) | | |
| Em-G | silver | 0.439 |
| ExM-2 | | 0.046 |
| ExM-3 | | 0.033 |
| ExM-5 | | 0.019 |
| ExY-3 | | 0.006 |
| ExC-6 | | 0.010 |
| ExC-7 | | 0.011 |
| ExC-8 | | 0.010 |
| ExC-9 | | 0.009 |
| HBS-1 | | 0.046 |
| HBS-3 | | 0.002 |
| HBS-4 | | 0.035 |
| HBS-5 | | 0.020 |
| Cpd-5 | | 0.004 |
| Cpd-7 | | 0.010 |
| Gelatin | | 0.446 |
| Eleventh layer (High-sensitivity green-sensitive emulsion layer) | | |
| Em-F | silver | 0.497 |
| Em-H | silver | 0.286 |
| ExC-6 | | 0.007 |
| ExC-8 | | 0.012 |
| ExC-9 | | 0.014 |
| ExM-1 | | 0.019 |
| ExM-2 | | 0.056 |

-continued (Sample 201)

| | | |
|---|---|---|
| ExM-3 | | 0.013 |
| ExM-4 | | 0.034 |
| ExM-5 | | 0.039 |
| ExM-6 | | 0.021 |
| ExY-3 | | 0.005 |
| Cpd-3 | | 0.005 |
| Cpd-4 | | 0.007 |
| Cpd-5 | | 0.010 |
| Cpd-7 | | 0.020 |
| HBS-1 | | 0.248 |
| HBS-3 | | 0.003 |
| HBS-4 | | 0.094 |
| HBS-5 | | 0.037 |
| Poly(ethyl acrylate)latex | | 0.099 |
| Gelatin | | 0.950 |
| Twelfth layer (Yellow filter layer) | | |
| Cpd-1 | | 0.090 |
| Solid dispersed dye ExF-2 | | 0.070 |
| Solid dispersed dye ExF-5 | | 0.010 |
| Oil-soluble dye ExF-6 | | 0.010 |
| HBS-1 | | 0.055 |
| Gelatin | | 0.589 |
| Thirteenth Layer (Low-sensitivity blue-sensitive emulsion layer) | | |
| Em-M | silver | 0.300 |
| Em-N | silver | 0.260 |
| Em-O | silver | 0.112 |
| ExC-1 | | 0.027 |
| ExC-7 | | 0.013 |
| ExY-1 | | 0.002 |
| ExY-2 | | 0.890 |
| ExY-4 | | 0.058 |
| Cpd-2 | | 0.100 |
| Cpd-3 | | 0.004 |
| HBS-1 | | 0.222 |
| HBS-5 | | 0.074 |
| Gelatin | | 1.553 |
| Fourteenth Layer (High-sensitivity blue-sensitive emulsion layer) | | |
| Em-K | silver | 0.421 |
| Em-L | silver | 0.421 |
| ExY-2 | | 0.211 |
| ExY-4 | | 0.068 |
| Cpd-2 | | 0.075 |
| Cpd-3 | | 0.001 |
| Cpd-7 | | 0.030 |
| HBS-1 | | 0.124 |
| Gelatin | | 0.678 |
| Fifteenth Layer (First protective layer) | | |
| Silver iodobromide emulsion (not spectrally sensitized) (average particle diameter in equivalent sphere diameter of 0.07 μm) | silver | 0.278 |
| UV-1 | | 0.167 |
| UV-2 | | 0.066 |
| UV-3 | | 0.099 |

-continued (Sample 201)

| | |
|---|---|
| UV-4 | 0.013 |
| UV-5 | 0.160 |
| F-11 | 0.008 |
| ExF-3 | 0.003 |
| S-1 | 0.077 |
| HBS-1 | 0.175 |
| HBS-4 | 0.017 |
| Gelatin | 1.297 |
| Sixteenth Layer (Second protective layer) | |
| H-1 | 0.400 |
| B-1 (diameter: 1.7 μm) | 0.050 |
| B-2 (diameter: 1.7 μm) | 0.150 |
| B-3 | 0.029 |
| S-1 | 0.200 |
| Gelatin | 0.748 |

Further, to improve preservability, processability, pressure resistance, antimold and antibacterial properties, antistatic property, and coating property, compounds of W-1 to W-11, B-4 to B-6, and F-1 to F-19, and salts of lead, platinum, iridium, and rhodium, were suitably added in each layer. Preparation of an organic solid dispersion of a dye The solid dispersion of Dye ExF-2 in the twelfth layer was dispersed in the following manner.

| | |
|---|---|
| Wet cake of ExF-2 (containing water in 17.6 mass %) | 2.800 kg |
| Sodium octylphenyldiethoxymethanesulfonate (31 mass % aqueous solution) | 0.376 kg |
| F-15 (7% aqueous solution) | 0.011 kg |
| Water | 4.020 kg |
| Total | 7.210 kg |

(adjusted to pH 7.2 using NaOH)

A slurry of the above composition was stirred with a dissolver, to make a coarse dispersion. The coarse dispersion was then dispersed, using an agitator mill LMK-4 in the following conditions: peripheral speed of 10 m/s, and discharge amount of 0.6 kg/min, using 0.3-mm-diameter zirconia beads packed at a ratio of 80%, until the absorbance ratio of the dispersion would become 0.29, to obtain a solid dispersion of Dye ExF-2. The average particle diameter of the dye fine-particles was 0.29 μm. Solid dispersions of Dye ExF-4 or ExF-7 were obtained in the same manner. The average particle diameters of the dye fine-particles were 0.28 μm and 0.49 μm, respectively. The solid dispersion of Dye ExF-5 was dispersed by a microprecipitation dispersing method described in Example 1 of European Patent Publication No. 549,489A. The average particle diameter was 0.06 μm.

The characteristics of emulsions to be used in the above light-sensitive material are shown in Tables 2 and 3.

TABLE 2

| | Layer in which the emulsion was used | Grain shape | Average sphere equivalent diameter (μm) | Average circle equivalent diameter (μm)/ variation coefficient (%) | Average thickness (μm)/ variation coefficient (%) | Average aspect ratio | Proportion of tabular grains occupied in all grains (%) | Average thickness of core portion (μm) | Average number of dislocation lines per grain |
|---|---|---|---|---|---|---|---|---|---|
| Em-A | High-sensitivity red-sensitive layer | Tabular grain having (111) principal plane | 1.00 | 1.74/34 | 0.22/16 | 7.9 | 91 | 0.13 | 20 |

TABLE 2-continued

| | Layer in which the emulsion was used | Grain shape | Average sphere equivalent diameter (μm) | Average circle equivalent diameter (μm)/ variation coefficient (%) | Average thickness (μm)/ variation coefficient (%) | Average aspect ratio | Proportion of tabular grains occupied in all grains (%) | Average thickness of core portion (μm) | Average number of dislocation lines per grain |
|---|---|---|---|---|---|---|---|---|---|
| Em-B | Middle-sensitivity red-sensitive layer | Tabular grain having (111) principal plane | 0.69 | 1.14/35 | 0.17/15 | 6.7 | 90 | 0.12 | 15 |
| Em-C | Low-sensitivity red-sensitive layer | Tabular grain having (111) principal plane | 0.50 | 0.79/29 | 0.12/18 | 6.7 | 94 | 0.11 | 10 |
| Em-D | Low-sensitivity red-sensitive layer | Tabular grain having (111) principal plane | 0.37 | 0.45/23 | 0.15/12 | 2.6 | 95 | 0.11 | 10 |
| Em-E | Layer to give interlayer effect to red-sensitive layers | Tabular grain having (111) principal plane | 0.78 | 1.33/30 | 0.18/18 | 7.4 | 90 | 0.12 | 20 |
| Em-F | High-sensitivity green-sensitive layer | Tabular grain having (111) principal plane | 1.00 | 1.74/34 | 0.22/16 | 7.9 | 91 | 0.13 | 20 |
| Em-G | Middle-sensitivity green-sensitive layer | Tabular grain having (111) principal plane | 0.74 | 1.23/40 | 0.18/18 | 6.8 | 90 | 0.12 | 15 |
| Em-H | High-/Low-sensitivity green-sensitive layers | Tabular grain having (111) principal plane | 0.74 | 1.16/31 | 0.20/15 | 5.8 | 91 | 0.12 | 20 |
| Em-I | Low-sensitivity green-sensitive layer | Tabular grain having (111) principal plane | 0.55 | 0.79/30 | 0.14/13 | 5.5 | 97 | 0.13 | 30 |
| Em-J | Low-sensitivity green-sensitive layer | Tabular grain having (111) principal plane | 0.44 | 0.53/30 | 0.17/18 | 3.2 | 97 | 0.10 | 20 |
| Em-K | High-sensitivity blue-sensitive layer | Tabular grain having (111) principal plane | 1.60 | 3.00/25 | 0.31/21 | 10 | 99 | 0.16 | 15 |
| Em-L | High-sensitivity blue-sensitive layer | Tabular grain having (111) principal plane | 1.30 | 2.20/24 | 0.34/22 | 7 | 98 | 0.14 | 20 |
| Em-M | Low-sensitivity blue-sensitive layer | Tabular grain having (111) principal plane | 0.81 | 1.10/30 | 0.23/18 | 4.7 | 97 | 0.13 | 20 |
| Em-N | Low-sensitivity blue-sensitive layer | Tabular grain having (111) principal plane | 0.40 | 0.55/32 | 0.13/16 | 4.6 | 96 | 0.11 | 20 |
| Em-O | Low-sensitivity blue-sensitive layer | Cubic grain having (100) principal plane | 0.21 | 0.21/20 | 0.21/20 | 1 | — | — | — |

TABLE 3

| | Layer in which the emulsion was used | Sensitizing dye(s) |
|---|---|---|
| Em-A | High-sensitivity red-sensitive layer | 1, 3, 4 |
| Em-B | Middle-sensitivity red-sensitive layer | 2, 3, 4 |
| Em-C | Low-sensitivity red-sensitive layer | 1, 3, 4 |
| Em-D | Low-sensitivity red-sensitive layer | 1, 3, 4 |
| Em-E | Layer to give interlayer effect to red-sensitive layers | 5, 10 |
| Em-F | High-sensitivity green-sensitive layer | 5, 6, 9 |
| Em-G | Middle-sensitivity green-sensitive layer | 5, 6, 9 |
| Em-H | High-/Low-sensitivity green-sensitive layers | 5, 6, 7, 8, 9 |
| Em-I | Low-sensitivity green-sensitive layer | 6, 8, 9 |
| Em-J | Low-sensitivity green-sensitive layer | 5, 6, 7 |
| Em-K | High-sensitivity blue-sensitive layer | 13, 14 |
| Em-L | High-sensitivity blue-sensitive layer | 12 |
| Em-M | Low-sensitivity blue-sensitive layer | 14 |
| Em-N | Low-sensitivity blue-sensitive layer | 12, 13 |
| Em-O | Low-sensitivity blue-sensitive layer | 11, 13 |

To each of the emulsions, was added an optimum amount of the spectral sensitizing dye(s), as shown in Table 3, and each of the emulsions was chemically sensitized optimally.

The sensitizing dyes described in Table 3 are shown below.

Sensitizing dye 1

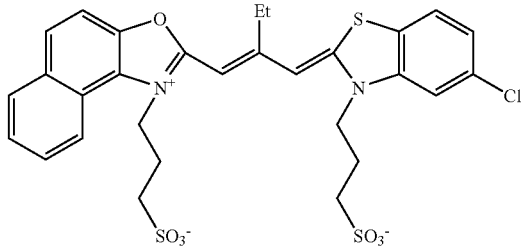

-continued
Sensitizing dye 2
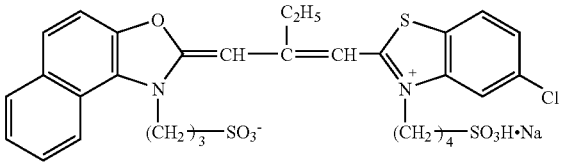
Sensitizing dye 3
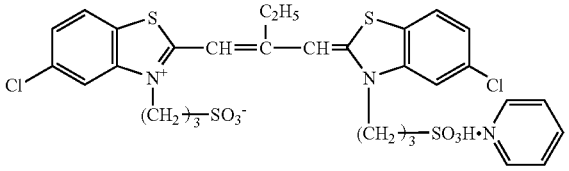
Sensitizing dye 4
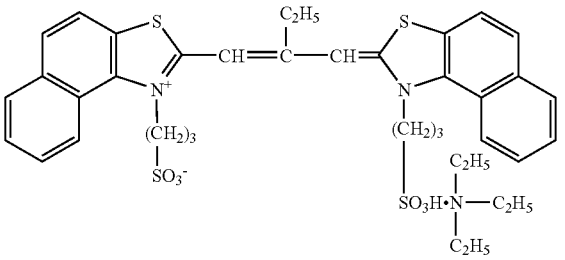
Sensitizing dye 5
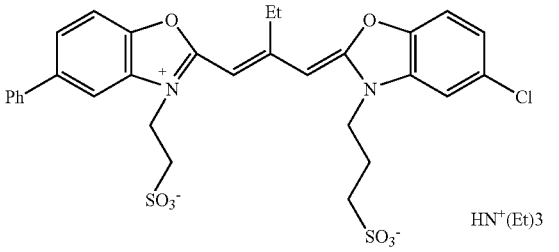
Sensitizing dye 6
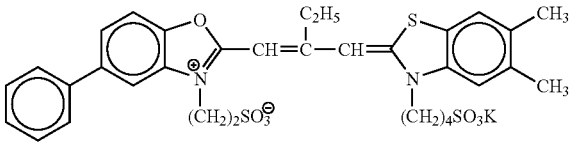
Sensitizing dye 7
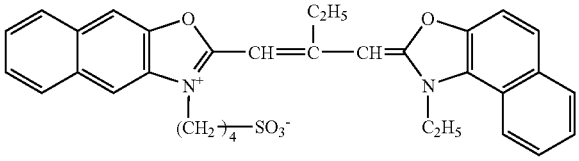
Sensitizing dye 8
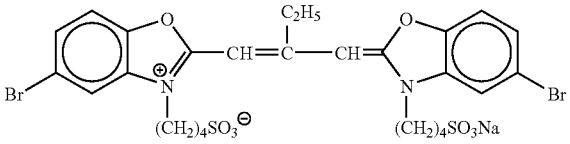
-continued
Sensitizing dye 9
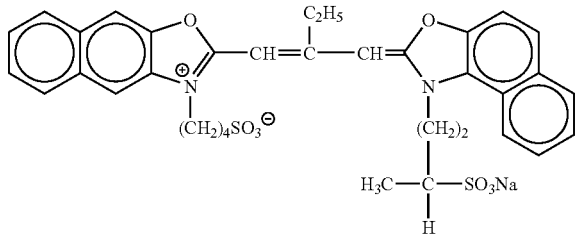
Sensitizing dye 10
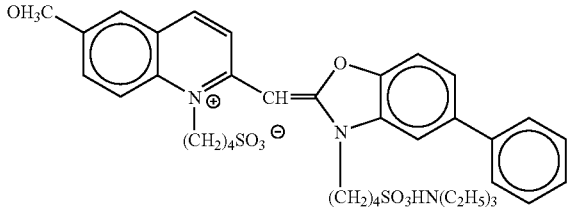
Sensitizing dye 11
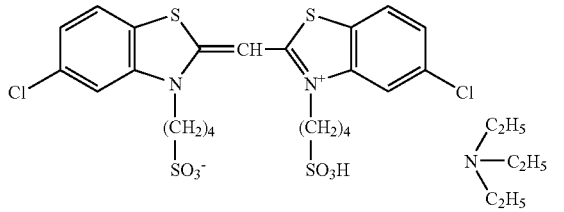
Sensitizing dye 12
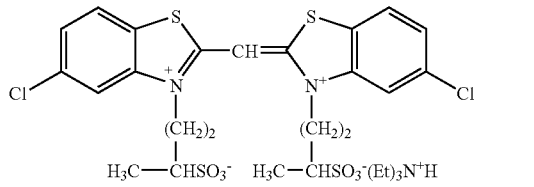
Sensitizing dye 13
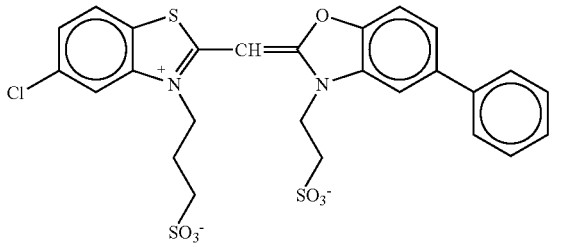
Sensitizing dye 14
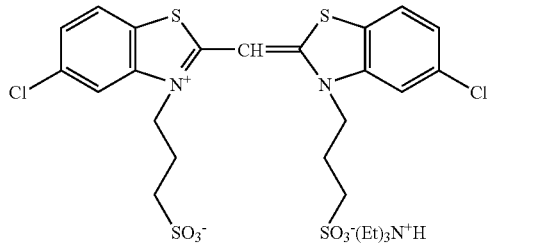

In the preparation of the tabular grains, a low-molecular weight gelatin was used, according to the working examples described in JP-A-1-158426.

The emulsions Em-L to Em-O each were subjected to reduction sensitization when preparing the grains.

The emulsions Em-A to Em-D and Em-J each were introduced dislocation, by using an iodide-ion-releasing agent, according to the working examples described in JP-A-6-11782.

The emulsions Em-E to Em-H each were introduced dislocation, by using silver iodide fine-grains, which had been prepared just before the addition thereof, in a separate chamber provided with a magnetic coupling induction-type stirrer, as described in JP-A-10-43570.

Compounds used in each of the layers described above are shown below.

ExF-1

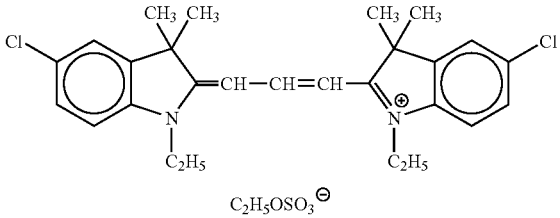

ExF-2

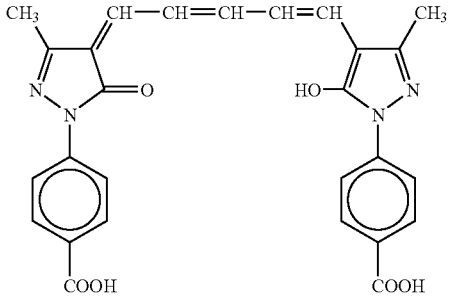

ExF-3

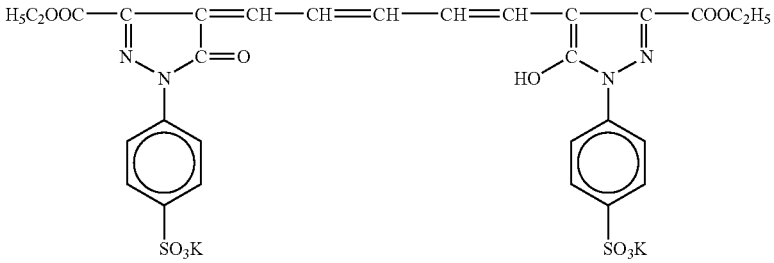

ExF-4

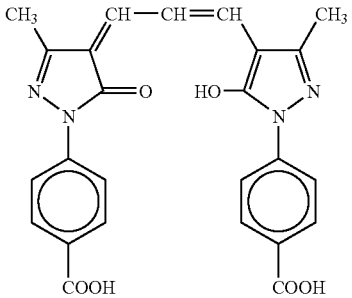

ExF-5

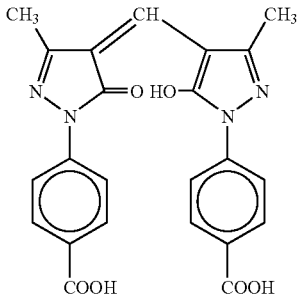

ExF-6

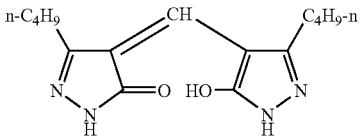

ExF-7

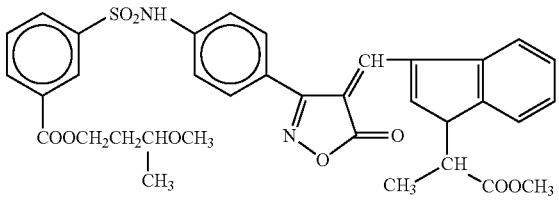

ExC-1

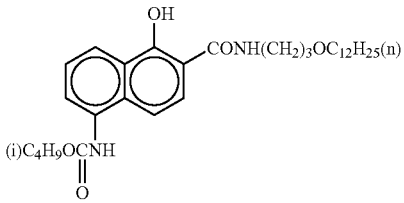

ExC-2

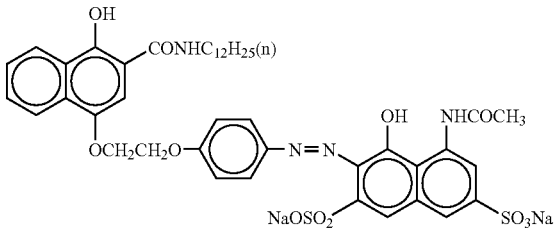

-continued
ExC-3
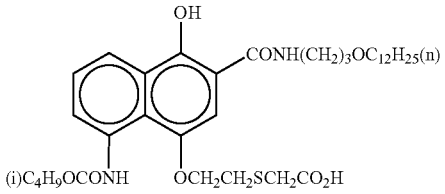
ExC-4
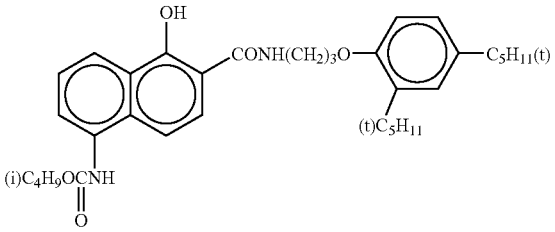
ExC-5
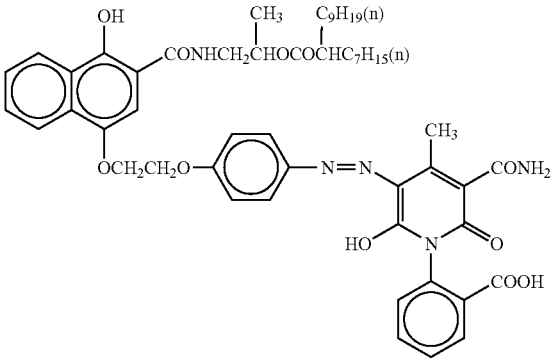
ExC-6
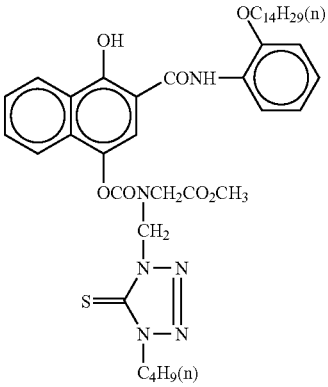
ExC-7
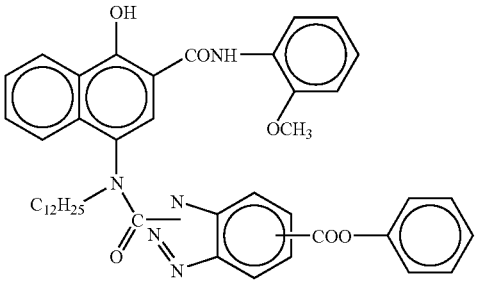
ExC-8
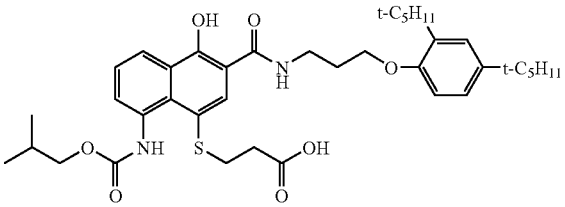
ExC-9
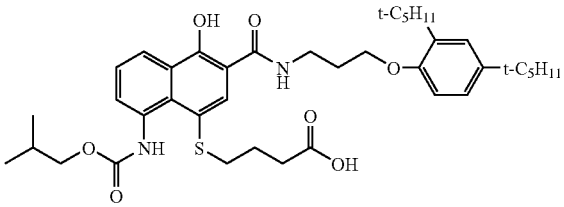
ExC-10
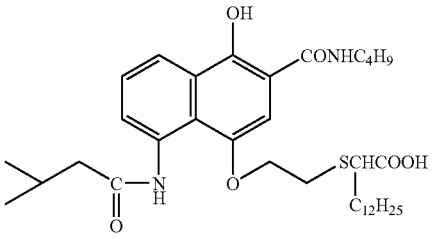

-continued
ExM-1
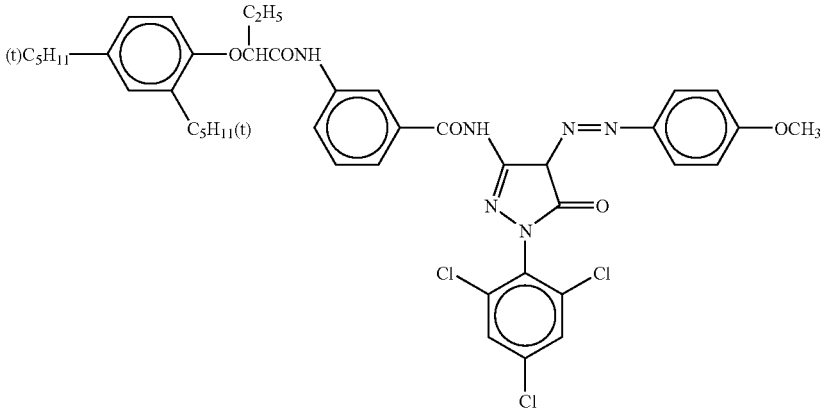
ExM-2
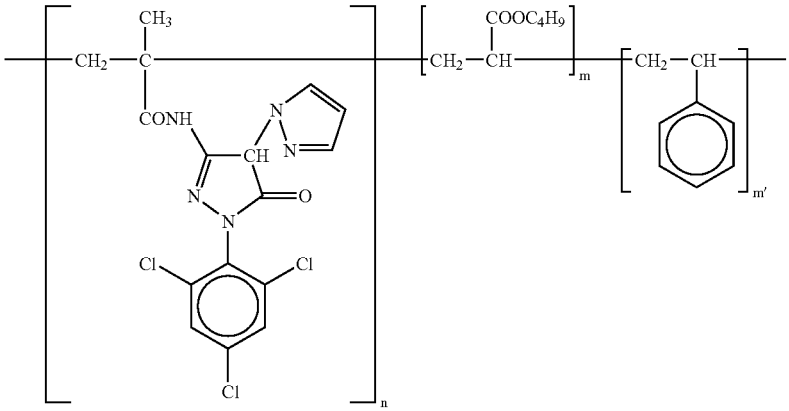
n = 50
m = 25
m′ = 25
mol. wt.: about 20,000
ExM-3
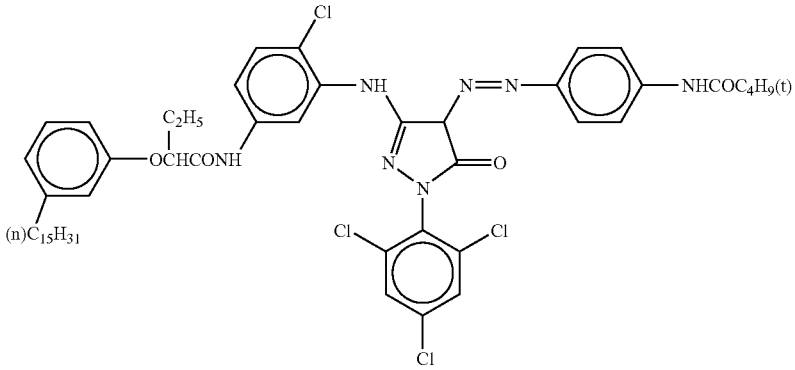
ExM-4
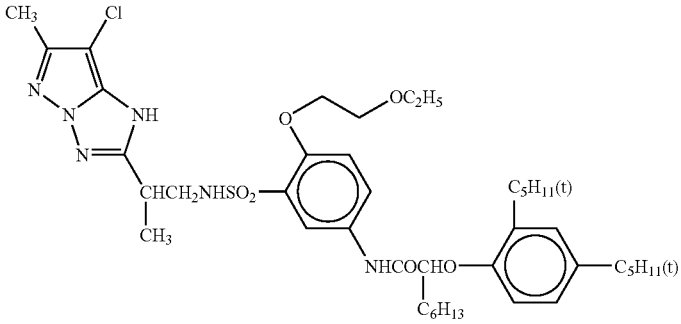

-continued
ExM-5
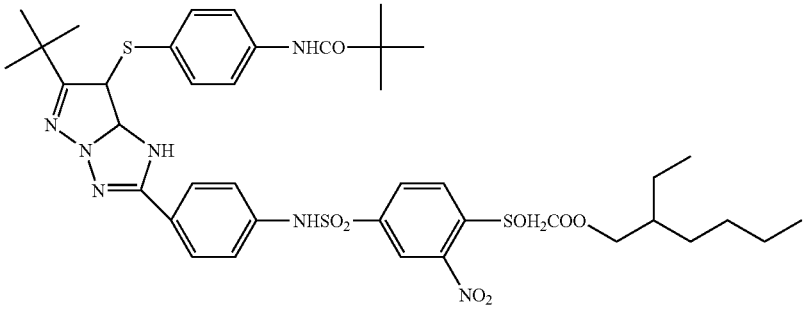
ExM-6
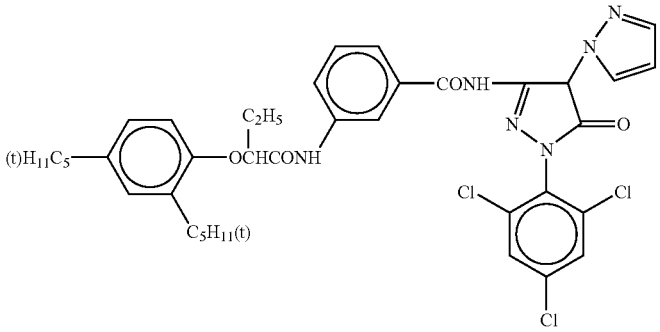
ExY-1
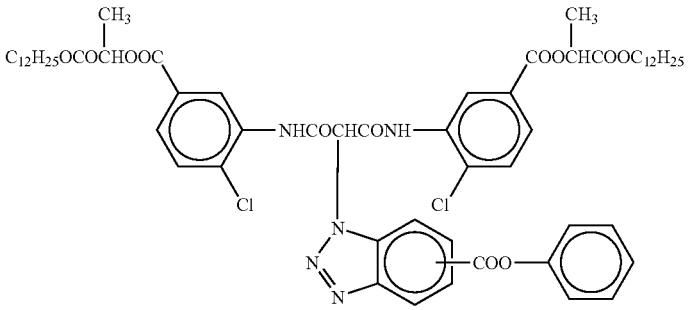
ExY-2
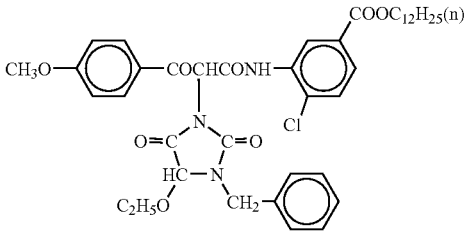
ExY-3
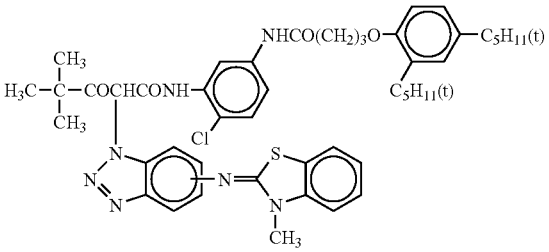
ExY-4
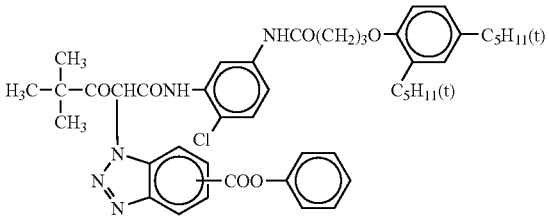
Cpd-1
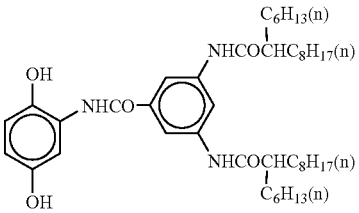

-continued
Cpd-2
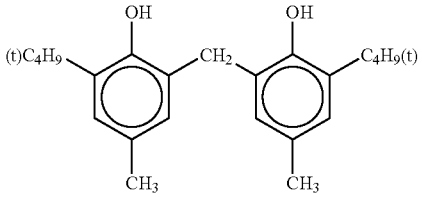
Cpd-3
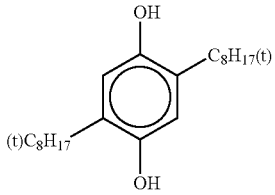
Cpd-4
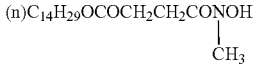
Cpd-5
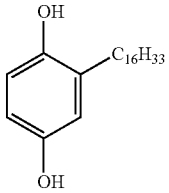
Cpd-6
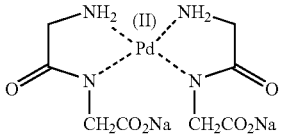
Cpd-7
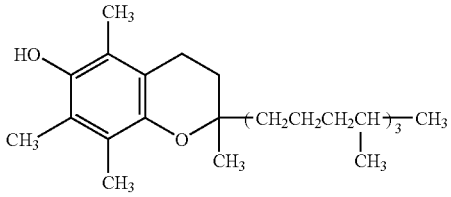
UV-1
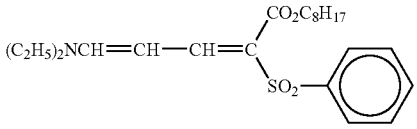
UV-2
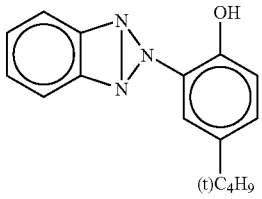
UV-3
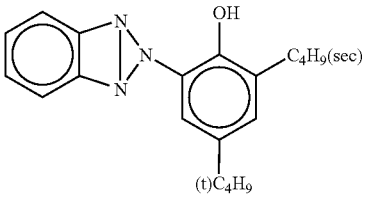
UV-4
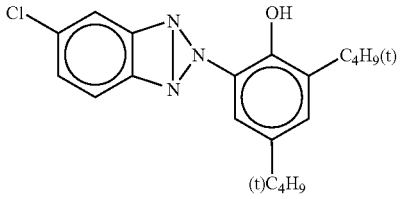
UV-5
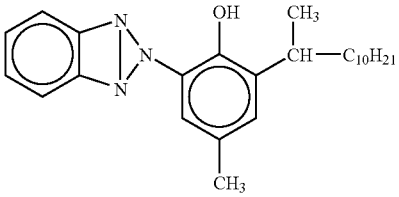
B-1
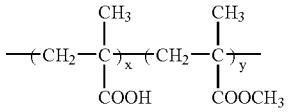
x/y = 10/90 (mass ratio)
Average molecular weight:
about 35,000
B-2
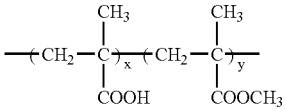
x/y = 40/60 (mass ratio)
Average molecular weight:
about 20,000
B-3
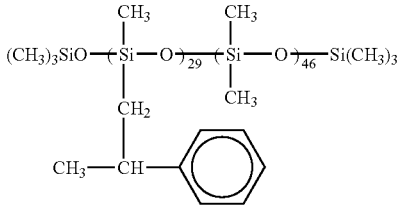
(molar ratio)
Average molecular weight:
about 8,000

-continued
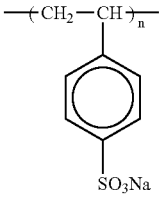
Average molecular weight: about 750,000
B-4
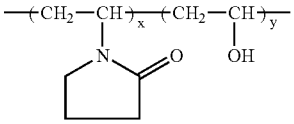
x/y = 70/30 (mass ratio)
Average molecular weight: about 17,000
B-5
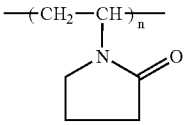
Average molecular weight: about 10,000
B-6
Tricresyl phosphate
HBS-1
Di-n-butyl phthalate
HBS-2
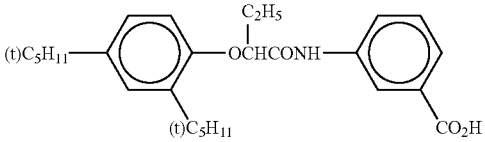
HBS-3
Tri(2-ethylhexyl) phosphate
HBS-4
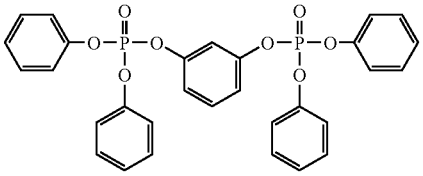
HBS-5
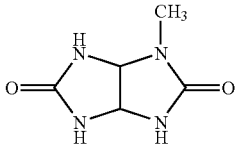
S-1
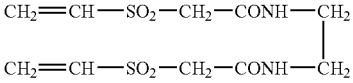
H-1
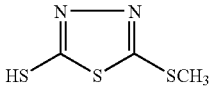
F-1
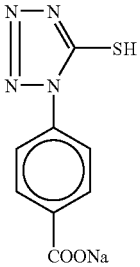
F-2
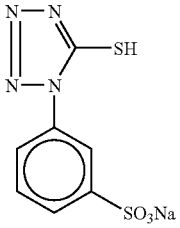
F-3
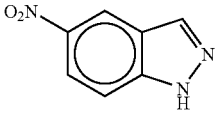
F-4
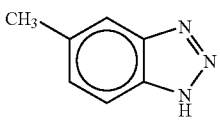
F-5
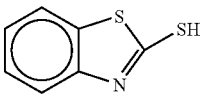
F-6

-continued
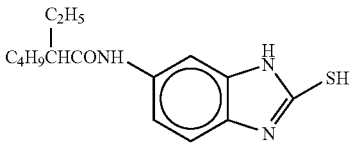
F-7
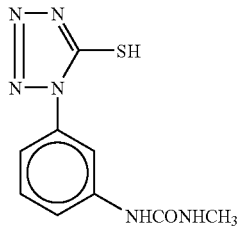
F-8
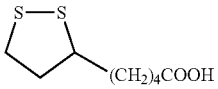
F-9
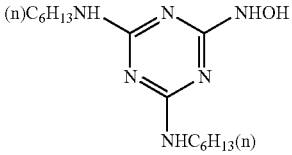
F-10
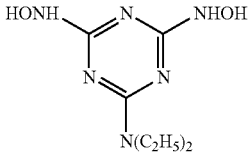
F-11
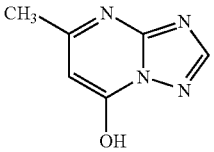
F-12
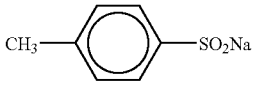
F-13
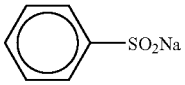
F-14
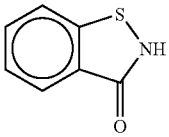
F-15
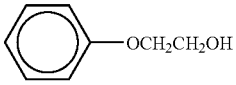
F-16
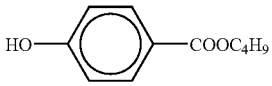
F-17
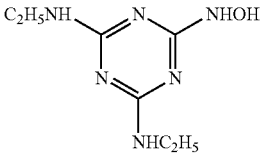
F-18
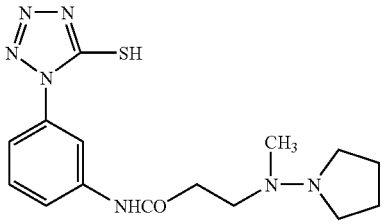
F-19
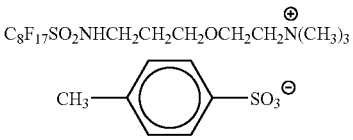
W-1
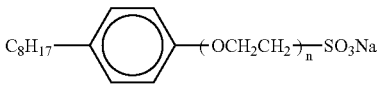
n = 2 ~ 4
W-2
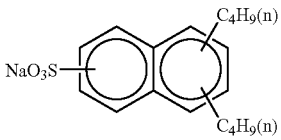
W-3
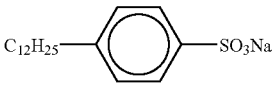
W-4

-continued

W-5

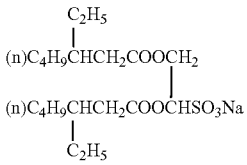

W-6

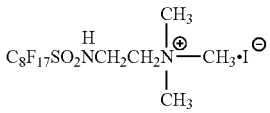

W-7

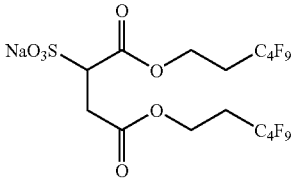

W-8

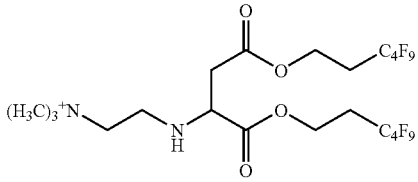

W-9

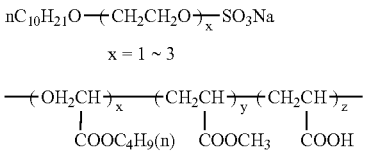

x/y/z = 20/60/20 (mass ratio)
Average molecular weight:
about 36,000

W-10

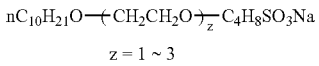

W-11

The above silver halide color photographic light-sensitive material is designated to as Sample 201.

(Preparation of Samples 202 to 208)

Samples 202 to 208 were prepared in the same manner as Sample 201, except that Compound A in the Emulsion Em-K in the above 14th layer was changed to the respective compound, as shown in Table 4.

TABLE 4

| Sample | Added compound | Fog | Relative sensitivity | Remarks |
|---|---|---|---|---|
| 201 | Compound A | 0.39 | 100 | Comparative example |
| 202 | Compound B | 0.38 | 98 | Comparative example |
| 203 | Compound C | 0.39 | 97 | Comparative example |
| 204 | Compound 8 according to this invention | 0.32 | 127 | This invention |
| 205 | Compound 10 according to this invention | 0.36 | 133 | This invention |
| 206 | Compound 11 according to this invention | 0.29 | 125 | This invention |
| 207 | Compound 15 according to this invention | 0.34 | 132 | This invention |
| 208 | Compound 24 according to this invention | 0.30 | 126 | This invention |

The above Samples 201 to 208 each were subjected to exposure to light for (1/100) sec, through a continuous wedge and a gelatin filter SC-39 (trade name) manufactured by Fuji Photo Film Co., Ltd.

Each sample after exposure to light was processed with the following method.

(Processing method)

| Step | Processing Time | Processing Temperature |
|---|---|---|
| Color-Developing | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilizing | 30 sec | 38° C. |
| Drying | 4 min 20 sec | 55° C. |

The compositions of the processing solutions are shown below.

| (Color-developer) | (Unit, g) |
|---|---|
| Diethylenetriaminepentaacetic acid | 1.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)amino]-2-methylaniline sulfate | 4.5 |
| Water to make | 1.0 liter |
| pH (adjusted using potassium hydroxide and sulfuric acid) | 10.05 |

| (Bleaching solution) | (unit, g) |
|---|---|
| Ethylenediaminetetraacetate iron(III) sodium trihydrate | 100.0 |
| Disodium ethylenediaminetetraacetate | 10.0 |
| 3-Mercapto-1,2,4-triazole | 0.03 |
| Ammonium bromide | 140.0 |
| Ammonium nitrate | 30.0 |
| Aqueous ammonia (27%) | 6.5 ml |
| Water to make | 1.0 liter |
| pH (adjusted using aqueous ammonia and nitric acid) | 6.0 |

-continued

| (Fixing solution) | (unit, g) |
|---|---|
| Disodium ethylenediaminetetraacetate | 0.5 |
| Ammonium sulfite | 20.0 |
| Ammonium thiosulfate aqueous solution (700 g/L) | 295.0 ml |
| Acetic acid (90%) | 3.3 |
| Water to make | 1.0 liter |
| pH (adjusted using aqueous ammonia and nitric acid) | 6.7 |
| **(Stabilizing solution)** | **(unit, g)** |
| p-Nonylphenoxypolyglycidol (average polymerization degree of glycidol: 10) | 0.2 |
| Ethylenediaminetetraacetic acid | 0.05 |
| 1,2,4-Triazole | 1.3 |
| 1,4-Bis(1,2,4-triazole-1-ylmethyl)pyperazine | 0.75 |
| Hydroxyacetic acid | 0.02 |
| Hydroxyethyl cellulose (manufactured by Daicell Chemicals Co., Ltd., HEC SP-2000 (trade name)) | 0.1 |
| 1,2-Benzisothiazoline-3-one | 0.05 |
| Water to make | 1.0 liter |
| pH | 8.5 |

(Fog and Yellow Sensitivity of the Light-Sensitive Materials)

The sensitometry curve of each sample that had been subjected to the above processing was found, to know values of the yellow fog density and the relative sensitivity. The relative sensitivity of each sample was obtained by finding the logarithmic value of the inverse number of the exposure amount that gave a yellow color density higher by +0.2 than the yellow fog density, and then expressing it as a relative value, taking the value of Sample 201 as 100. The smaller the value is, the less the fog is. The larger the relative sensitivity that is shown as to the yellow density is, the higher the sensitivity is, and a higher sensitivity is preferable.

As is apparent from the results in Table 4, the color negative films containing the silver halide grains, which were chemically sensitized in the presence of the compound represented by formula (1), were remarkably high in sensitivity and low in fog.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A silver halide emulsion, which is chemically sensitized by a compound represented by formula (I):

Formula (1)

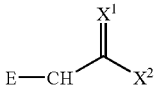

wherein, in formula (1), Ch represents a sulfur atom, a selenium atom, or a tellurium atom; $X^1$ represents $NR^1$, or $N^+(R^2)R^3Y^-$, in which $R^1$ represents a hydrogen atom, an alkyl group, an alkenyl group, an alkynyl group, an aryl group, or a heterocyclic group, and $R^2$ and $R^3$ each independently represent an alkyl group, an alkenyl group, an alkynyl group, an aryl group, or a heterocyclic group, and $Y^-$ represents an anionic ion; $X^2$ represents a hydrogen atom, an alkyl group, an alkenyl group, an alkynyl group, an aryl group, a heterocyclic group, $OR^4$, or $N(R^5)R^6$, in which $R^4$, $R^5$, and $R^6$ each independently represent a hydrogen atom, an alkyl group, an alkenyl group, an alkynyl group, an aryl group, or a heterocyclic group; and E is a group selected from groups represented by formula (2), (3), (4), or (5):

Formula (2)

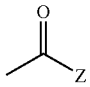

Formula (3)

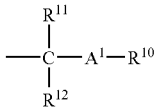

Formula (4)

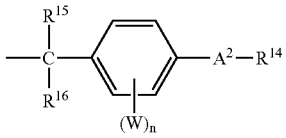

Formula (5)

wherein, in formula (2), Z represents a hydrogen atom, an alkyl group, an alkenyl group, an alkynyl group, an aryl group, a heterocyclic group, $OR^7$, or $N(R^8)R^9$, in which $R^7$, $R^8$, and $R^9$ each independently represent a hydrogen atom, an alkyl group, an alkenyl group, an alkynyl group, an aryl group, or a heterocyclic group;

wherein, in formula (3), $A^1$ represents an oxygen atom, a sulfur atom, or $NR^{13}$; and $R^{10}$, $R^{11}$, $R^{12}$, and $R^{13}$ each independently represent a hydrogen atom, an alkyl group, an alkenyl group, an alkynyl group, an aryl group, or a heterocyclic group;

wherein, in formula (4), $A^2$ represents an oxygen atom, a sulfur atom, or $NR^{17}$; $R^{14}$ represents a hydrogen atom, an alkyl group, an alkenyl group, an alkynyl group, an aryl group, a heterocyclic group, or an acyl group; $R^{15}$, $R^{16}$, and $R^{17}$ each independently represent a hydrogen atom, an alkyl group, an alkenyl group, an alkynyl group, an aryl group, or a heterocyclic group; W represents a substituent; n is an integer from 0 to 4; when n is 2 or more, Ws may be the same or different; and wherein, in formula (5), L represents a divalent linking group; and EWG represents an electron withdrawing group.

2. The silver halide emulsion as claimed in claim 1, $X^2$ represents $N(R^5)R^6$.

3. The silver halide emulsion as claimed in claim 2, wherein E is a group selected from the groups represented by formula (3) or (4).

4. The silver halide emulsion as claimed in claim 3, wherein Ch is a selenium atom.

5. The silver halide emulsion as claimed in claim 1, wherein $X^1$ represents $NR^1$.

6. The silver halide emulsion as claimed in claim 1, wherein, in formula (1), Ch is a sulfur atom or a selenium atom; $X^1$ represents $NR^1$ or $N^+(R^2)R^3$; $X^2$ represents an alkyl group, an alkenyl group, an alkynyl group, an aryl group, a heterocyclic group, $OR^4$, or $N(R^5)R^6$; and E is selected from the groups represented by formula (3) or (4).

7. The silver halide emulsion as claimed in claim 1, wherein the compound represented by formula (1) is used in an amount of $1\times10^{-7}$ to $5\times10^{-3}$ mol per mol of silver halide.

8. The silver halide emulsion as claimed in claim 1, which is further sensitized by a gold sensitizer.

9. The silver halide emulsion as claimed in claim 1, which comprises silver halide grains composed of cubic, tetradecahedral, or octahedral crystal grains, substantially having (100) planes, which grains may be rounded at the apexes thereof and may have planes of higher order, and wherein the proportion of said silver halide grains accounts for 50% or more in terms of the total projected area of all the silver halide grains contained in the emulsion.

10. The silver halide emulsion as claimed in claim 9, wherein a silver chloride content of the silver halide emulsion is 95% or more.

11. The silver halide emulsion as claimed in claim 1, which comprises silver halide grains composed of tabular grains having an aspect ratio of 2 or more and being composed of (100) or (111) planes as the main face, and wherein the proportion of said silver halide grains accounts for 50% or more in terms of the total projected area of all the silver halide grains contained in the emulsion.

12. The silver halide emulsion as claimed in claim 11, wherein the tabular grains are silver iodobromide or chloroiodobromide tabular grains.

13. A silver halide photographic light-sensitive material having, on a support, at least one silver halide emulsion layer, wherein at least one layer of said at least one silver halide emulsion layer contains the silver halide emulsion according to claim 1.

* * * * *